US006964535B2

(12) United States Patent
Bell et al.

(10) Patent No.: US 6,964,535 B2
(45) Date of Patent: Nov. 15, 2005

(54) ADVANCED CLEANING SYSTEM WITH OFF-HEAD MOUNTED NOZZLE

(75) Inventors: Russell Bell, Pleasanton, CA (US); Cherie Bulala, Pleasanton, CA (US); Susan Huestis, Pleasanton, CA (US); Michael J. Hall, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 129 days.

(21) Appl. No.: 10/350,804

(22) Filed: Jan. 24, 2003

(65) Prior Publication Data

US 2003/0209263 A1 Nov. 13, 2003

Related U.S. Application Data

(63) Continuation-in-part of application No. 09/689,433, filed on Oct. 11, 2000, now Pat. No. 6,540,424, and a continuation-in-part of application No. 10/233,773, filed on Aug. 30, 2002

(60) Provisional application No. 60/317,911, filed on Sep. 6, 2001, and provisional application No. 60/192,040, filed on Mar. 24, 2000.

(51) Int. Cl.[7] ..... A46B 11/00

(52) U.S. Cl. ..... 401/140; 401/138

(58) Field of Search ..... 401/136–140

(56) References Cited

U.S. PATENT DOCUMENTS

| | | | | |
|---|---|---|---|---|
| 418,959 A | | 1/1890 | Pilson | |
| 1,310,290 A | | 7/1919 | Piechowics | |
| D92,532 S | | 6/1934 | Graham | |
| D95,904 S | | 6/1935 | Fuerst | |
| D102,368 S | | 12/1936 | Higgins | |
| 2,137,944 A | * | 11/1938 | MacLeod | 401/140 |
| 2,238,360 A | | 4/1941 | Forster | |
| 2,432,015 A | * | 12/1947 | Hodshon | 401/138 |
| 2,470,837 A | | 5/1949 | Polson | |

(Continued)

FOREIGN PATENT DOCUMENTS

| | | | |
|---|---|---|---|
| DE | 3940123 A | * | 6/1990 |
| DE | 3940123 A1 | | 12/1998 |
| EP | 0161113 A2 | | 11/1985 |
| EP | 0 390 430 | | 3/1990 |
| EP | 0733320 A1 | | 8/1996 |
| WO | WO 97/29664 | | 8/1997 |
| WO | WO 97/35510 | | 10/1997 |
| WO | WO 98/11812 | | 3/1998 |
| WO | WO 98/23200 | | 6/1998 |
| WO | WO 98/42246 | | 10/1998 |
| WO | WO 00/27271 | | 5/2000 |
| WO | WO 00/27746 | | 5/2000 |
| WO | WO 00/54647 | | 9/2000 |
| WO | WO 01/23510 | | 4/2001 |

OTHER PUBLICATIONS

U.S. Appl. No. 10/606,370, filed Jun. 25, 2003.
U.S. Appl. No. 29/140,155, filed Apr. 11, 2001.

(Continued)

*Primary Examiner*—David J. Walczak
*Assistant Examiner*—Huyen Le
(74) *Attorney, Agent, or Firm*—Ray K. Shahani, Esq.; Monica H. Winghart, Esq.

(57) ABSTRACT

An advanced cleaning system having a handle portion with a proximal end and a distal end, a cleaning head portion, the cleaning head portion adapted for use with a removable cleaning pad, and a cleaning fluid reservoir fluidically coupled to the cleaning head portion such that cleaning fluid is controllably allowed to flow via gravity onto the surface to be cleaned adjacent the cleaning head portion.

22 Claims, 37 Drawing Sheets

U.S. PATENT DOCUMENTS 2,664,278 A 12/1953 Aghnides
2,698,954 A 1/1955 Muirheid
D178,876 S 10/1956 Glaberson
2,764,774 A 10/1956 Belsky et al.
2,768,401 A * 10/1956 Becker et al. ..... 222/191
2,782,919 A 3/1957 Ansell
D190,626 S 6/1961 Musichuk
3,016,556 A 1/1962 Greenleaf
3,055,031 A 9/1962 Rachlin
3,126,573 A 3/1964 Vosbikian et al.
D200,364 S 2/1965 Brody
D201,791 S 8/1965 Hershberger et al.
3,221,996 A 12/1965 Emmert et al.
D206,913 S 2/1967 Hills
3,377,123 A 4/1968 Leeson
3,457,016 A 7/1969 Gotberg
3,784,311 A 1/1974 Failing
3,877,103 A * 4/1975 Nash ..... 15/147.1
3,932,043 A 1/1976 Joffre
4,059,358 A 11/1977 Arai
4,065,536 A 12/1977 Lucas
4,069,066 A 1/1978 Hindle et al.
D257,504 S 11/1980 Weckman
4,480,793 A 11/1984 Grande
4,603,450 A 8/1986 Osberghaus et al.
4,606,958 A 8/1986 Haq et al.
4,680,826 A 7/1987 Schunter
4,714,200 A 12/1987 Sayama
4,778,298 A 10/1988 Shin et al.
4,802,782 A 2/1989 Scalf
4,843,674 A 7/1989 Jones
4,863,299 A 9/1989 Osberghaus et al.
D306,924 S 3/1990 Shapton
4,927,283 A 5/1990 Fitjer
4,936,510 A 6/1990 Weinstein
4,955,748 A 9/1990 Krumholz
4,983,060 A 1/1991 Steinbach
4,987,632 A 1/1991 Rowe et al.
4,991,250 A 2/1991 Young
4,995,133 A 2/1991 Newell
5,071,489 A 12/1991 Silvenus et al.
5,094,559 A 3/1992 Rivera et al.
5,115,538 A 5/1992 Cochran et al.
5,141,348 A 8/1992 'tartt
5,195,999 A 5/1993 Harada et al.
D338,090 S 8/1993 Kamiyama
5,253,387 A 10/1993 Kresse et al.
D354,683 S 1/1995 Rupert
5,390,390 A 2/1995 Kresse et al.
5,419,015 A 5/1995 Gracia
5,461,749 A 10/1995 Ahlberg et al.
D364,014 S 11/1995 Langeland et al.
D364,948 S 12/1995 Hunt
5,603,139 A 2/1997 Alazet
5,609,255 A 3/1997 Nichols
D380,359 S 7/1997 Meisner et al.
5,735,620 A 4/1998 Ford
D394,607 S 5/1998 Monaghan et al.
5,769,324 A 6/1998 Leonhart
5,779,155 A 7/1998 Schennum et al.
5,784,755 A 7/1998 Karr et al.
D396,908 S 8/1998 Beechuk et al.
D401,703 S 11/1998 Beechuck et al.
D398,099 S 12/1998 Leung
5,842,504 A 12/1998 Schennum et al.
5,842,682 A 12/1998 Schennum et al.
5,849,805 A 12/1998 Dyer
5,858,515 A 1/1999 Stokes et al.
5,865,551 A 2/1999 Lalli et al.
5,888,006 A 3/1999 Ping et al.
5,908,255 A 6/1999 Branch
5,953,784 A 9/1999 Suzuki et al.
5,960,508 A 10/1999 Holt et al.
5,962,112 A 10/1999 Haynes et al.
5,988,920 A 11/1999 Kunkler et al.
6,000,088 A 12/1999 Wright et al.
6,003,191 A 12/1999 Sherry et al.
6,045,622 A 4/2000 Holt et al.
6,048,123 A 4/2000 Holt et al.
6,052,856 A 4/2000 DeMoya et al.
D425,274 S 5/2000 Kunkler
D428,677 S 7/2000 Saunders et al.
6,101,661 A 8/2000 Policicchio et al.
6,165,160 A 12/2000 Suzuki et al.
D443,121 S 5/2001 Hamm et al.
6,305,046 B1 10/2001 Kingry et al.
6,316,687 B1 11/2001 Davis et al.
6,319,593 B1 11/2001 Kenmochi et al.
6,369,291 B1 4/2002 Uchimoto et al.
D462,150 S 8/2002 Rader et al.

OTHER PUBLICATIONS

U.S. Appl. No. 29/140,102, filed Apr. 11, 2001.
U.S. Appl. No. 29/140,150, filed Apr. 11, 2001.
U.S. Appl. No. 29/140,154, filed Apr. 11, 2001.
U.S. Appl. No. 29/140,104, filed Apr. 11, 2001.
U.S. Appl. No. 29/1470,162, filed Apr. 11, 2001.
U.S. Appl. No. 29/160,918, filed May 17, 2002.
U.S. Appl. No. 29/160,919, filed May 17, 2002.
U.S. Appl. No. 29/166,630, filed Aug. 30, 2002.
U.S. Appl. No. 291/186,191, filed Jul. 10, 2003.
U.S. Appl. No. 29/186,188, filed Jul. 10, 2003.
U.S. Appl. No. 29/186,189, filed Jul. 10, 2003.
Webester's Third New international Dictionary, 1976 by G. & C. Merriam Co., pp. 2208–2209 and 2258–2259.
Chemical Engineers' Handbook, 1973 by Robert H. perry and Cecil H. Chilton pp. 5–4, 18–58 and 18–59.
U.S. Appl. No. 10/233,773, filed Aug. 30, 2002.
U.S. Appl. No. 10/234,959, filed Aug. 30, 2002.
U.S. Appl. No. 10/233,774, filed Aug. 30, 2002.
U.S. Appl. No. 10/351,293, filed Jan. 24, 2003.
U.S. Appl. No. 10/350,803, filed Jan. 24, 2003.

* cited by examiner

501

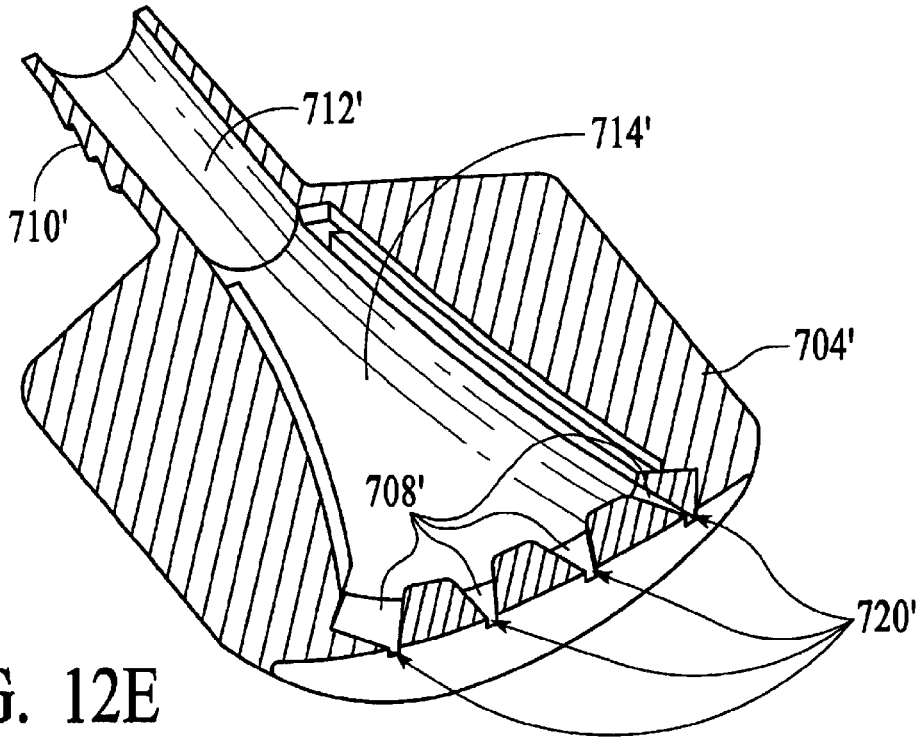
FIG. 12E
FIG. 12F
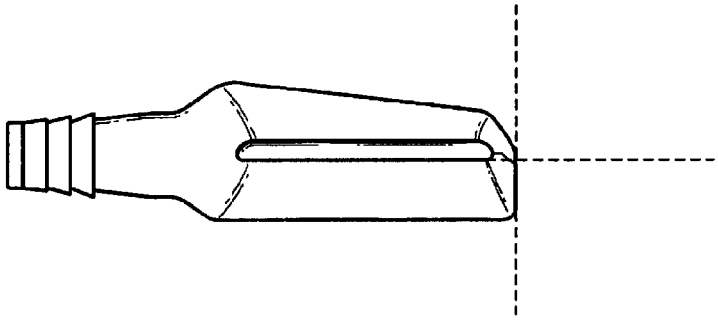
FIG. 12G
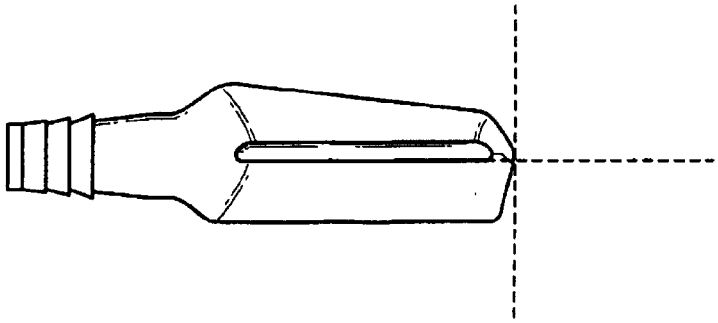

PERFORMANCE TESTING DATA
Valves are Final Unit Cavity parts
Vent tube has 2 o-rings
flex dome = 70 durometer
o-ring = 70 durometer
Testing: Flex Dome is always filled during testing.
Washers were new design with longer posts (changed OD)
Duck Bills: 30D oil-filled (orange)

| Valve # | 47° Flowrate ml/s | 33° Flowrate ml/s | 33° Stream Projection, Inside | 33° Stream Projection, Outside | 47° Stream Angle, Inside | 47° Stream Projection, Inside | 47° Stream Projection, Outside | 47° Stream Angle, Inside | 33° Stream Angle, Outside | 47° Vacuum Pressure | 33° Vacuum Pressure | Leak Front Nozzle? |
|---|---|---|---|---|---|---|---|---|---|---|---|---|
| 1 | 3.56 | 2.6 | 1.75 | 2 | 6L/15R | 35L/41R | 2.25 | 6L/15R | 41 | -2.5 | -2.7 | No |
| 2 | 3.73 | 2.76 | 1.5 | 1.75 | 9L/12R | 38 | 2 | 6L/15R | 41 | -2.8 | -2.6 | No |
| 3 | 3.67 | 2.76 | 1.5 | 2 | 6L/9R | 38L/35R | 2 | 6L/12R | 38 | -2.6 | -2.7 | No |
| 4 | 3.72 | 2.66 | 1.5 | 1.75 | 6L/9R | 35 | 2.25 | 6L/12R | 41L/38R | -2.8 | -2.4 | No |
| 5 | 3.65 | 2.67 | 1.75 | 2 | 6L/15R | 38 | 2 | 6L/15R | 41 | -3.2 | -2.8 | No |
| 6 | 3.82 | 2.44 | 1.5 | 2 | 6L/12R | 35 | 2 | 6L/12R | 38 | -2.9 | -2.3 | No |
| 7 | 3.94 | 2.68 | 1.75 | 2 | 3L/12R | 35L/38R | 2.25 | 3L/12R | 38 | -2.5 | -2 | No |
| 8 | 3.63 | 2.65 | 1.75 | 2 | 6L/15R | 35L/38R | 2.25 | 6L/15R | 41 | -2.8 | -2.4 | No |
| 9 | 3.86 | 2.64 | 1.5 | 1.75 | 6L/15R | 35L/38R | 2 | 6L/15R | 41 | -2.9 | -2.6 | No |
| 10 | 3.76 | 2.8 | 1.75 | 2 | 6L/12R | 38 | 2 | 6L/12R | 38 | -3 | -2.5 | No |
| 11 | 3.59 | 2.65 | 1.75 | 2 | 6L/12R | 32R/35R | 2.5 | 6L/12R | 32L/35R | -2.9 | -2.7 | No |
| 12 | 3.43 | 2.51 | 1.75 | 2 | 6L/12R | 29L/35R | 2.5 | 6L/12R | 29L/35R | -3 | -3 | No |
| 13 | 3.72 | 2.7 | 1.75 | 2 | 3L/12R | 29L/35R | 2.25 | 3L/12R | 29L/35R | -3.5 | -2.8 | No |
| 14 | 3.99 | 2.62 | 1.75 | 2.5 | 3L/12R | 26L/35R | 2.5 | 3L/12R | 29L/35R | -2.5 | -3.1 | No |
| Avg | 3.72 | 2.65 | 1.65 | 1.98 | #DIV/01 | na | 2.20 | na | 39.67 | -2.85 | -2.61 | na |
| std | 0.15 | 0.10 | 0.12 | 0.18 | #DIV/01 | na | 0.20 | na | 1.58 | 0.28 | 0.29 | na |
| high | 3.99 | 2.8 | 1.75 | 2.5 | 15 | 41 | 2.5 | 15 | 41 | -2.5 | -2 | 0 |
| low | 3.43 | 2.44 | 1.5 | 1.75 | 3 | 26 | 2 | 3 | 26 | -3.5 | -3.1 | 0 |

FIG. 15

ADVANCED CLEANING SYSTEM WITH OFF-HEAD MOUNTED NOZZLE

RELATED INVENTIONS

This Application is a Continuation-In-Part (CIP) of related U.S. patent application Ser. No. 09/689,433 filed Oct. 11, 2000 now U.S. Pat. No. 6,540,424 entitled ADVANCED CLEANING SYSTEM, which is incorporated herein by reference in its entirety, and claims any and all benefits to which it is entitled therefrom. This Application is also a CIP of pending U.S. patent application Ser. No. 10/233,773 filed Aug. 30, 2002 entitled FLUID DISTRIBUTION NOZZLE AND STREAM PATTERN, which is incorporated herein by reference in its entirety, and claims any and all benefits to which it is entitled therefrom. This application is also related to and incorporates by reference, in its entirety, U.S. Provisional Patent Applications Ser. Nos. 60/192,040 and 60/317,911 filed Mar. 24, 2000 and September 6, 2001 respectively, and claims any and all benefits to which it is entitled therefrom.

FIELD OF THE INVENTION

The present invention is related to an advanced cleaning system useful for removing soils, stains and debris from hard surfaces. In particular, the invention is related to an advanced cleaning system having a handle which attaches to a head portion to which a disposable cleaning pad can be removably attached, and a replaceable cleaning fluid reservoir which removably fits within a housing portion on the handle and communicates cleaning fluid to a nozzle portion which removably attaches to the head portion.

BACKGROUND OF THE INVENTION

Cleaning devices and systems for use in the home, industrially or otherwise include a broad range of technology. With regard to hand-held, mop-like devices used by an individual, the prior art is replete with variations. Conventional floor, ceiling, wall or other surface mops typically have a rigid, elongated handle portion, the handle having a proximal and a distal end. The handle portion is held closer to the proximal end, while a cleaning head is placed at the distal end of the handle. Typically, mop heads for use indoors are about 3–4 inches wide and about 9–12 inches long, and they typically have a removable sponge or other type absorbent pad portion. As is well know, once a cleaning pad becomes worn out or soiled beyond utility, it is removed and replaced with a fresh cleaning pad.

Typically, a mop head is dipped into a pail or bucket containing water and a cleaning agent. The mop head is wrung out so as not to deposit too great an amount of cleaning fluid on the surface being cleaned. It would be highly useful to provide a hand-held mopping system with an on-board, disposable, rechargeable or replaceable fluid reservoir.

U.S. Pat. No. 5,071,489 issued Dec. 10, 1991 to Silvenis et al. teaches a floor cleaner using disposable sheets. The apparatus comprises a handle portion pivotally attached to a cleaning head member with a flat lower surface. The lower surface of the member has frictional means thereon which are intended to maintain a pre-moistened fabric sheet between the surface and an area to be cleaned. The frictional means are a series of raised portions, etc.

U.S. Pat. No. 5,609,255 issued Mar. 11, 1997 to Nichols teaches a washable scrubbing mop head and kit. The device and system contains a multi-part handle, head portion, and an attachable sponge mop pad.

U.S. Pat. No. 5,888,006 issued Mar. 30, 1999 to Ping et al. teaches a cleaning implement having a sprayer nozzle attached to a cleaning head member. Cleaning fluid sprays out of a sprayer nozzle portion attached to a cleaning head mounted at the base of a handle portion, the head portion mounted to the handle portion with a universal joint.

U.S. Pat. No. 5,953,784 issued Sep. 21, 1000 to Suzuki et al. teachers a cleaning cloth and cleaning apparatus. The apparatus includes a handle with a front, flat head section for insertion into a bag-like cleaning cloth.

U.S. Pat. No. 5,988,920 issued Nov. 23, 1999 to Kunkler et al. teaches a cleaning implement having a protected pathway for a fluid transfer tube. The cleaning implement has a fluid reservoir coupled to a dispenser with a universal joint, and a fluid transfer tube, the fluid transfer tube at least partially positioned to pass through the universal joint.

U.S. Pat. No. 5,960,508 issued Oct. 5, 1999 to Holt et al. teaches a cleaning implement having controlled fluid absorbency. U.S. Pat. No. 6,003,191 issued Dec. 21, 1999 to Sherry et al. teaches a cleaning implement. U.S. Pat. No. 6,048,123 issued Apr. 11, 2000 to Holt et teaches a cleaning implement having high absorbent capacity. Overall maximum fluid absorbencies, rates of absorbency, and squeeze-out rates are defined, and examples of materials which exhibit those types of behavior are provided. As best understood, these inventions are directed to the use of superabsorbent materials, and not the use of conventional, natural and synthetic materials.

A microfiber is atypically, and others are included herein as well, made of a polyester/polyamide blend that has a thickness finer than 1/100 of a human hair. In the industry of fibers and fabrics, the following classifications of fibers is considered standard:

| Yarn Count | Fiber Classification |
|---|---|
| >7.0 dpf* | coarse fiber |
| 2.4–7.0 dpf | normal fiber |
| 1.0–2.4 dpf | fine |
| 0.3–1.0 dpf | microfiber |
| <0.3 dpf | ultra-microfiber |

*dpf = denier per filament
Note:
A filament with a thickness of 1 denier corresponds to a yarn length of 9,000 meters/gram. Thus, a 0.2 denier fiber corresponds to a yarn length of 45 kilometers/gram

SUMMARY AND ADVANTAGES

In one aspect of the present invention, a cleaning system comprises a cleaning tool having a handle portion, the handle portion having a proximal end and a distal end; a cleaning head portion, the cleaning head portion adapted for use with a removable cleaning pad; a cleaning pad; and a cleaning fluid reservoir fluidly coupled to the cleaning head portion such that cleaning fluid is controllably allowed to flow by gravity onto the surface to be cleaned adjacent the cleaning head portion. The cleaning tool further comprises a nozzle portion mounted to the head portion. The head portion of the cleaning system is coupled to the handle portion with a yoke means.

In another aspect of the present invention, a kit is provided for the cleaning system which includes the following tool components: a handle portion, the handle portion having a proximal end and a distal end; a cleaning head portion; one or more removable cleaning pads; and means for removably coupling a cleaning fluid reservoir to the system for dispensing cleaning fluid adjacent the cleaning head portion. The kit includes an optimum number of parts that can fit into an optimum size container for display purposes, such as in a store.

In yet a further aspect of the present invention, a method is provided for applying a fluid to a surface with a device comprising a handle portion, a head portion, and a fluid reservoir attached thereto, with the method comprising the following steps: obtaining the handle portion; mechanically coupling a fluid reservoir to a handle portion and fluidically coupling the fluid reservoir to the head portion; controllably dispensing the fluid onto the surface; and distributing the fluid dispensed onto the surface with the head portion.

In one aspect of the present invention, a mopping device with an on-board, rechargeable, and removable fluid reservoir that does not require disposable or replaceable parts.

A further aspect of an embodiment of the current invention is a handheld device with a gravitational fluid dispensing system, i.e. the dispensing fluid by gravitational force only. This device can be applied to uses where a fluent material needs to be applied to a surface, such other cleaning or sanitation uses, gardening or agricultural uses, marking or painting uses, etc.

A further advantage of the current invention is that the fluid dispensing system is fluid-tight and does not leak in any orientation. A further advantage of the current invention is that the fluid flow from the fluid dispensing system is uniform and is not disrupted by effects such as air traveling back through the fluid outlet to counteract negative air pressure in the fluid reservoir. The elimination of air backflow occurs because the air inlet system in the current invention maintains the air pressure in the reservoir during operation.

In yet another aspect of the present invention, a device is provided for applying a fluent material to a surface with a tool comprising a sealed reservoir with a valve-controlled outlet. Further the device can be placed in a holster with a triggering mechanism for actuating the valve in the device and thereby control the flow of the fluent material through the device outlet. For example, this device could have applications in situations where the user desires apply a fluent material in a contained, sealed unit.

Some of the specific features of the present invention as disclosed along with their advantages are summarized below:

Fluid Dispensing by Gravity:

In the present invention the cleaning fluid is dispensed by gravity. Fluid dispensing does not require pumps, motors, or any other additional power source for delivering fluid from the fluid reservoir to the surface.

A Fully Removable Fluid Dispensing System:

In the present invention the fluid dispensing system, embodied in the fluid reservoir, valve, outlet tube and nozzle in one embodiment of the current invention, is fully removable from the mop.

Although some embodiments of the invention uses triggering mechanism for controlling fluid dispensing, the present invention does not require these triggering mechanism for delivering fluid as the valve can be actuated manually by the operator.

Elimination of Destructive Methods in the Fluid Dispensing System:

An additional feature of the removable fluid dispensing system is elimination of destructive methods needed to delivery fluid. The current invention eliminates destructive methods such as puncturing or seal-breaking methods, etc. Further, the current invention eliminates the need for methods or materials used to offset or counteract the use of destructive methods, such as self-sealing caps or barriers, etc.

Rechargeable Fluid Reservoir Without Replacement Parts:

As the current invention do not use destructive methods, and in some embodiments of the current invention the fluid reservoir can be accessed by the user through a bottle cap or other similar device, then an additional feature of the present invention is that the fluid dispensing system does not require replacement parts in order recharge the fluid reservoir.

Hand-powered Control Mechanism:

Embodiments of the present invention do not use electrical, hydraulic or other non-human powered systems. Embodiments of the present invention use a mechanical hand-powered triggering mechanism. According the need for electrical circuitry, electrical switches or electrical power sources in the system is eliminated as is the need for motors or pumps.

Elimination of Liquid-tight Requirements in the Handle, Trigger, and Holster Sub-systems:

As the present invention does not require the handle, trigger, or holster sub-systems as components of the fluid dispensing system and the control of fluid dispensing uses a mechanical hand-powered mechanism then an additional feature of the current invention is the elimination for any liquid-tight interconnections or barriers of the handle, trigger, and holster sub-systems.

Increased Safety:

As embodiments of the present invention eliminate the need for electrical devices, motors, pumps, hydraulics, destructive methods, and liquid-tight interconnections or barriers, then a further feature of the present invention is a more safe operating experience for the user than other related inventions.

Uniformly Balanced Handle:

As embodiments of the present invention do not have the additional weight of batteries, motors, pumps or hydraulics placed at either the proximal or distal end of the handle, then the handle has the added feature of being more uniformly balanced in weight.

Robust Shaft:

Further, as embodiments of the present invention use mechanical linkages in the shaft section of the handle sub-system, and the weight of the shaft section does not need to be reduced to offset any non-uniform weight characteristics in the system, then a further feature of the current invention is that the shaft section can be solid and robust.

Familiarity in User Operation:

As embodiments of the present invention have the advantages of fluid dispensing by gravity, a fully removable fluid dispensing system, a mechanical hand-powered triggering mechanism, a uniform continuous fluid flow, and a uniformly balanced and robust handle, then an additional feature of the present invention is that the overall user experience more closely emulates the use and operation of a conventional mop.

It is a further advantage and objective of the present invention to provide an advanced cleaning system as described herein which is capable of producing a predetermined fluid distribution pattern.

It is a further advantage and objective of the present invention to provide an advanced cleaning system with a nozzle portion mounted off the head portion, such as on the handle portion, as described herein.

It is a further advantage and objective of the present invention to provide an advanced cleaning system with nozzle portion mounted off the head portion in which the stream distribution pattern is essentially the same as the stream pattern developed using the head-mounted nozzle system.

It is a further advantage and objective of the present invention to provide an advanced cleaning system with nozzle portion mounted off the head portion in which the stream distribution pattern is essentially or somewhat independent of the angle or orientation of the handle portion of the advanced cleaning system.

BRIEF DESCRIPTION OF THE DRAWINGS

FIG. 8K is a representative isometric section view of yet another preferred embodiment of a valve sub-assembly 800*b* of a cleaning system 100 of the present invention.

FIGS. 12C–12G are representative detail views of portions of the nozzle assembly 700' such as shown in FIGS. 12A and 12B.

FIG. 15 is a table showing experimental data obtained utilizing the test station 1000 shown in FIG. 14B.

DETAILED DESCRIPTION OF THE PREFERRED EMBODIMENTS

Figure 1:
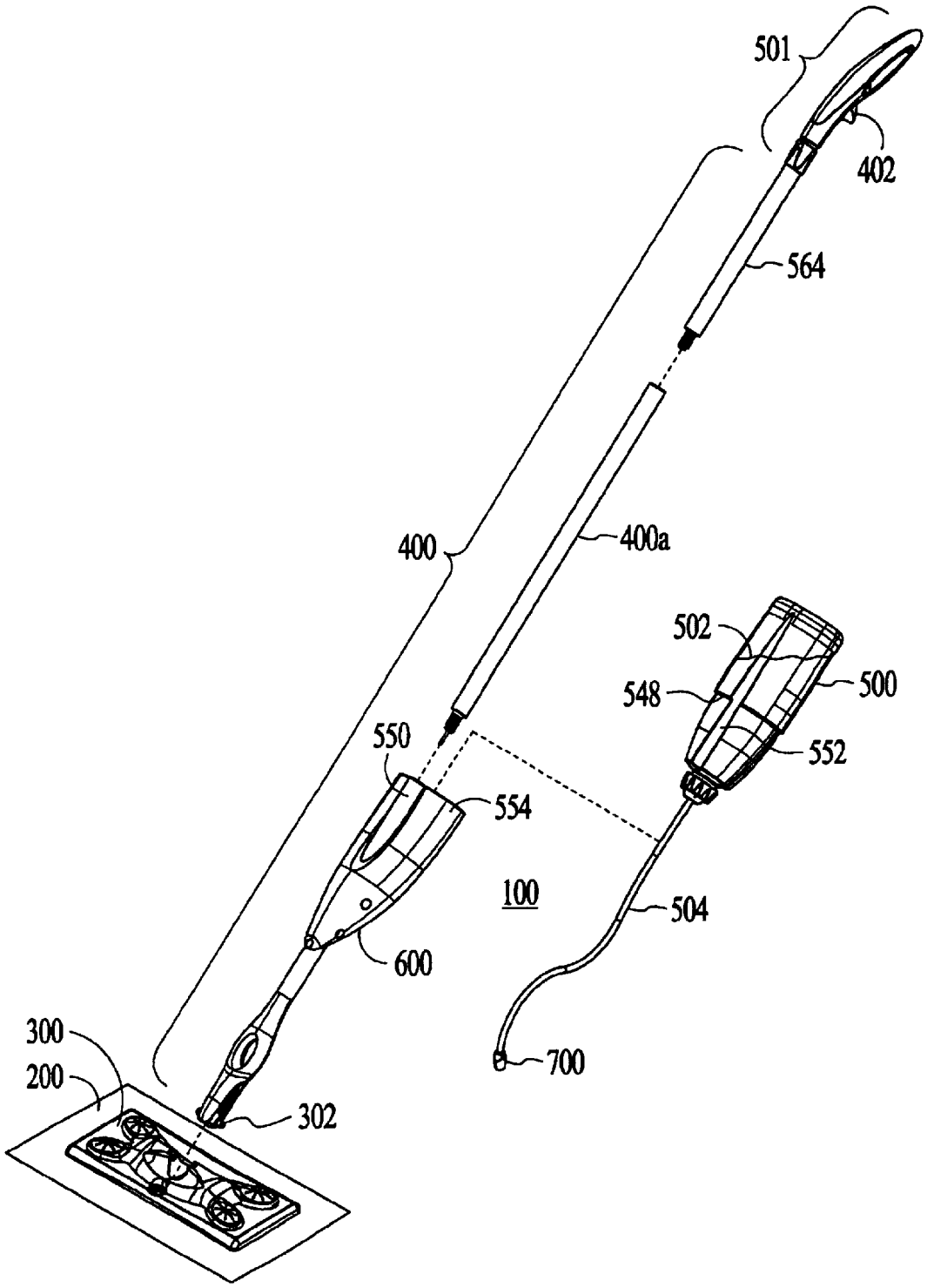
FIG. 1 is a representative exploded view of a preferred embodiment of a cleaning system 100 of the present invention.

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

It will be understood that in the event parts of different embodiments have similar functions or uses, they may have been given similar or identical reference numerals and descriptions. It will be understood that such duplication of reference numerals is intended solely for efficiency and ease of understanding the present invention, and are not to be construed as limiting in any way, or as implying that the various embodiments themselves are identical.

Figure 2:
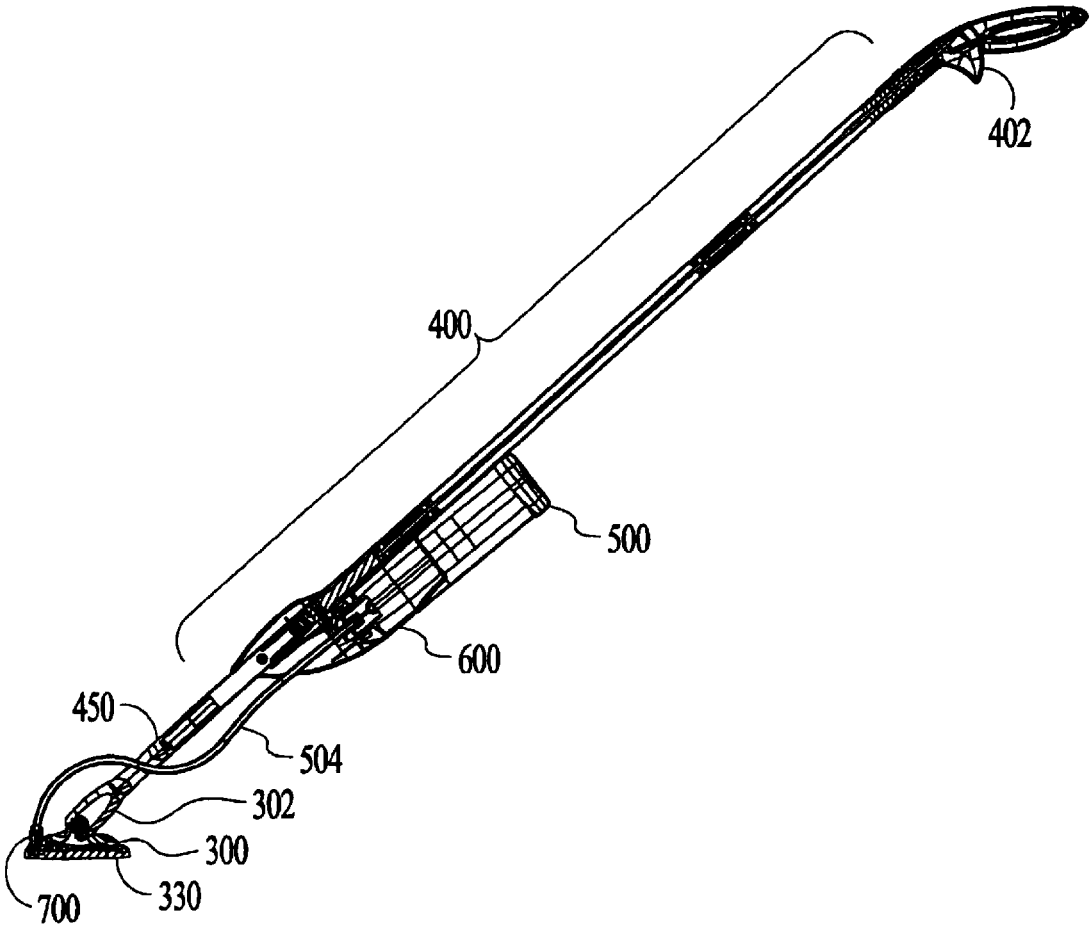
FIG. 2 is a representative cross section view of a preferred embodiment of a cleaning system 100 of the present invention.

FIG. 1 is a representative exploded view of a preferred embodiment of a cleaning system 100 of the present invention. FIG. 2 is a representative cross section view of a preferred embodiment of a cleaning system 100 of the present invention. The cleaning tool 100 consists of a preferred embodiment of an absorbent cleaning pad or sheet 200 which is removably mounted onto a cleaning head assembly 300. The head sub-assembly 300 is attached via universal joint 302 to a handle sub-assembly 400. The handle sub-assembly 400 can be disassembled for easy storage. A fluid reservoir 500 which is intended to carry a liquid cleaning solution 502 can be mounted on the handle sub-assembly 400 within a suitably designed holster sub-assembly 600. The fluid reservoir 500 has a flow delivery tube 504 which leads through a yoke portion on the handle sub-assembly to an fluid nozzle sub-assembly 700 which is mounted on the cleaning head sub-assembly 300 near the leading edge of the absorbent pad or sheet 200. A trigger mechanism 402 located on the proximal end of the handle sub-assembly 400 actuates a valve system for providing flow of fluid from the fluid reservoir 500 through the nozzle sub-assembly 700.

It will be understood that the mechanical linkages described herein between the shaft sections of the handle portion 400 can all be configured to be collapsible, disassemblable, telescoping, bayonet mounted and linked, etc.

Such adaptability for the system is designed to enhance storage, packaging, and utility of the system 100 of the present invention.

In a preferred embodiment, the handle portion 400 comprises sections which interlock together in a bayonet-type configuration. The sections are each distinctively keyed, sized or shaped to confirm that the advanced cleaning system 100 is assembled properly. In a preferred embodiment, the system is a one-time assembly system, and is basically a no-disassembly system. The shaft section 400*a* and others, can be single assembly, over-torque-proof design, such as incorporating advanced, flanged or cone-shaped collars and keyed end sections, are also important and will be included within the present invention. In a preferred embodiment, the system is automatically self-adjusting, and the handle is self-aligning. The trigger draw can be set automatically, once the system is assembled.

In a preferred embodiment, the delivery tubing 504 comprises 0.25 inch inside or outside diameter plastic or ruber tubing. The internal diameter can be larger or smaller, as desired or suitable. The tubing 504 can be replaceable and/or reusable, as desired or appropriate.

Figure 3A:
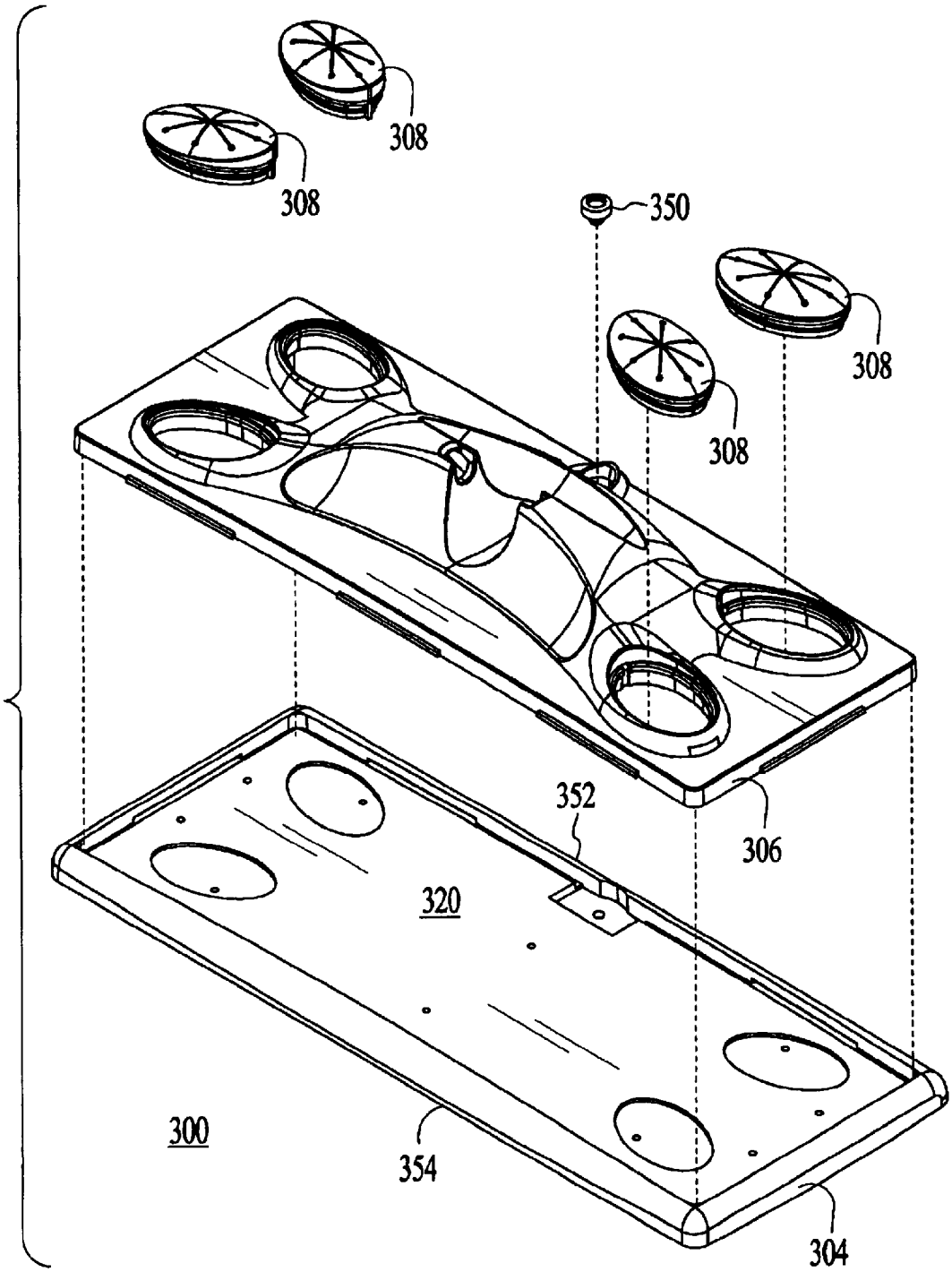
FIG. 3A is a representative exploded view of a preferred embodiment of a head sub-assembly 300 of a cleaning system 100 of the present invention.

FIG. 3A is a representative exploded view of a preferred embodiment of a head sub-assembly 300 of a cleaning system 100 of the present invention. The head sub-assembly 300 consists of a pad portion 304, a formed enclosure portion 306 and about 4 pinchers 308. In a preferred embodiment, the length and width of the pad portion 304 will be about 11 inches and 4 inches, respectively. The enclosure portion 306 will be integrally or otherwise formed, and can be formed separately or as part of the pad portion 304. It will be known to those skilled in the art that the overall size, shape and materials of construction of the pad portion 304 shall be varied upon the specific cleaning application intended.

As shown, nozzle snap 350 is positioned at the front, leading edge 352 of the pad portion 304. The nozzle snap 350 can be replaced with any nozzle portion 700 (as shown best in FIGS. 10A–10E) retaining means. Furthermore, it is also an option to have the head assembly 300 configured such that flow of cleaning fluid 502 flows through the head assembly 300 and out the nozzle assembly 700.

Figure 3B:
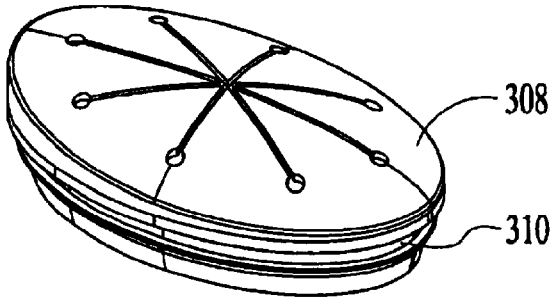
FIG. 3B is a representative isometric view of a preferred embodiment of a pincher 308 of a head sub-assembly 300 of a cleaning system 100 of the present invention.
Figure 3C:
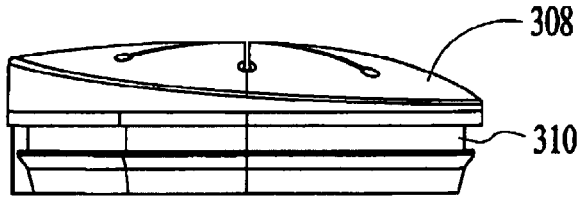
FIG. 3C is a representative side view of a preferred embodiment of a pincher 308 of a head sub-assembly 300 of a cleaning system 100 of the present invention.
Figure 3D:
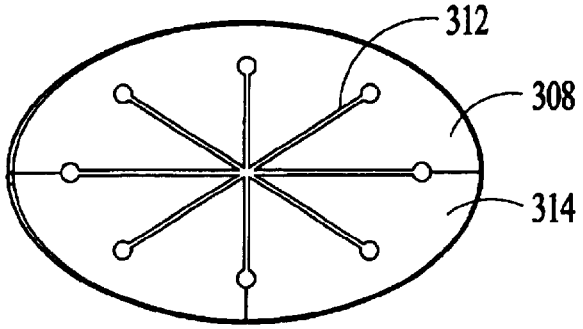
FIG. 3D is a representative top view of a preferred embodiment of a pincher 308 of a head sub-assembly 300 of a cleaning system 100 of the present invention.

FIG. 3B is a representative isometric view of a preferred embodiment of a pincher 308 of a head sub-assembly 300 of a cleaning system 100 of the present invention. FIG. 3C is a representative side view of a preferred embodiment of a pincher 308 of a head sub-assembly 300 of a cleaning system 100 of the present invention. FIG. 3D is a representative top view of a preferred embodiment of a pincher 308 of a head sub-assembly 300 of a cleaning system 100 of the present invention. Pinchers 308 and other mechanical securing means are well known in the art. Such pinchers 308 or other cleaning pad 200 (not shown) securing means will be formed of rubber or other flexible and resilient elastomeric or polymeric material. A circular rib 310 or other mechanical structure is useful for seating and securing the pincher 308 into the enclosure portion 306. The precise design of the slots 312 cut into the top surface 314 of the pinchers 308 can be modified as desired or needed.

Figure 3E:
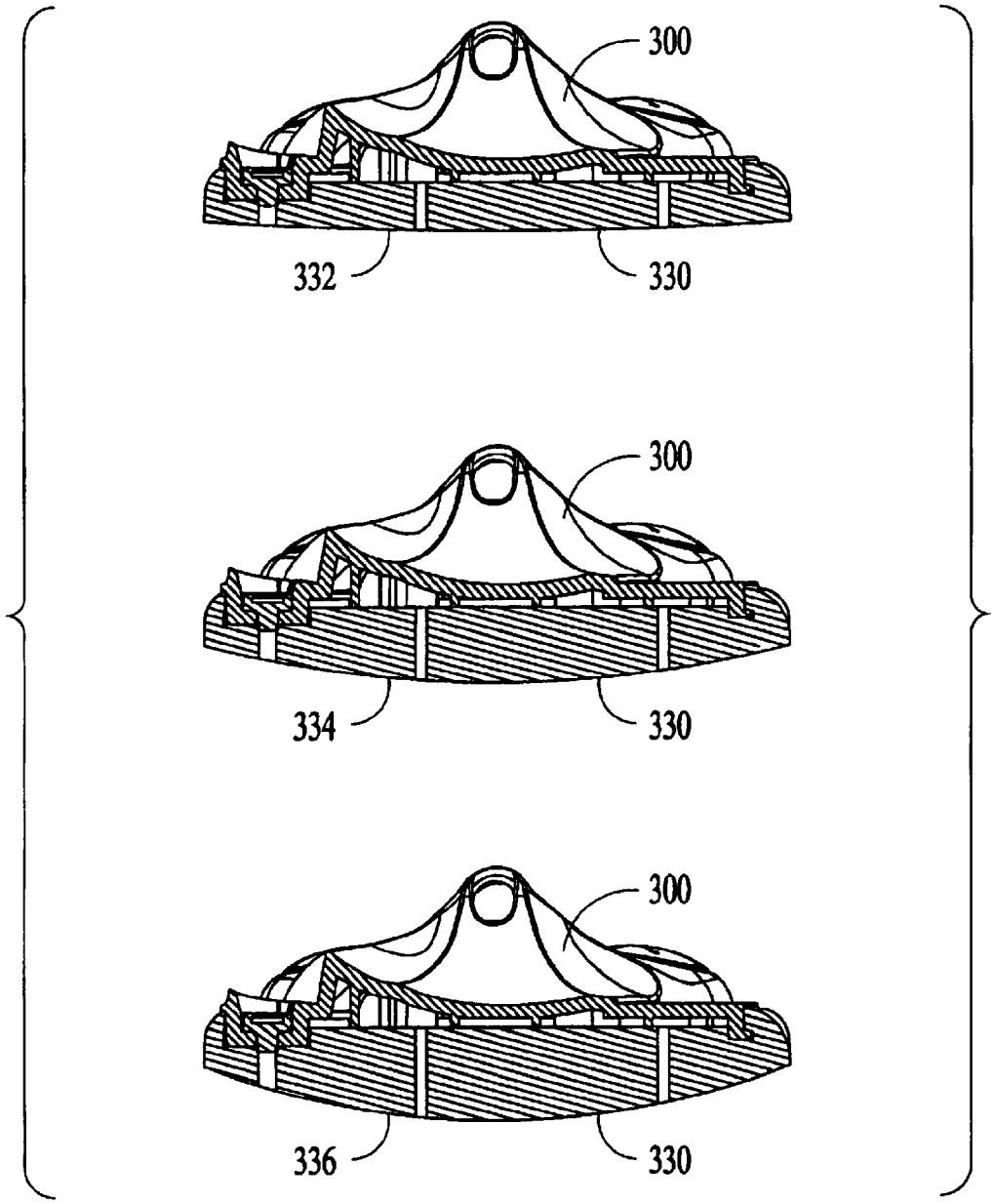
FIG. 3E is a set of three representative side views of preferred embodiments of a convex lower surface 330 of a head sub-assembly 300 of a cleaning system 100 of the present invention.

FIG. 3E is a set of three representative cross section views of preferred embodiments of the convex lower surface 330 of a head sub-assembly 300 of a cleaning system 100 of the present invention, such as shown in at least FIGS. 2 and 3A. It will be understood by those skilled in the art that as the cleaning system 100 of the present invention is used, in a typical floor or ground surface cleaning experience, the system is placed with the lower side 330 of the head assembly 300 facing downward. In the preferred embodiments shown, the lower side 332 of the head assembly 300 is slightly convex, the lower side 334 of the head assembly 300 is more convex, and the lower side 336 of the head assembly 300 is greatly convex. It will be understood that the radius of curvature of the lower surface 332 will be greater than the radius of curvature of lower surface 334 which will be also be greater than the radius of curvature of the lower surface 336.

In the preferred embodiments shown in FIG. 3E, it will be understood that during the cleaning experience, the leading edge 352 of the cleaning head assembly 300 is going to accumulate the greatest amount of debris initially. When the lower surface 330 of the cleaning head assembly 300 is essentially flat, the leading edge 352 of the head assembly 300 the leading edge 352 will become loaded with dirt very quickly as the head 300 is moved forward across the surface to be cleaned 712 (such as shown in FIGS. 10E and 10F). Thus, by providing an increasingly convex shaped lower surface 332, 334 or 336, the leading edge 352 will become decreasingly loaded earlier than the leading edge 352. It will be understood, therefore, that by providing a hemispherically or wedge or other-shaped lower surface 330, the loading of dirt and debris on the leading edge 352 as well as elsewhere on the lower surface 330–336 can be carefully controlled and optimized. It will be understood that the scope of the present invention includes flat as well as convex, wedge shaped, trapezoidal, stepped, or other shaped lower cleaning and contacting surface.

In a preferred embodiment, the cleaning head assembly 300 is optimized to prevent head flipping, such as when applying increased force to the head or when there is an increased frictional force between the cleaning head portion 300 and the floor or other surface being cleaned. In a preferred embodiment, the u-joint 302 is settled into a well or depression or cavity in the top portion of the head assembly 300. It has been found that by bringing the point at which the u-joint 302 is placed relatively closer to the lower surface of the cleaning head assembly, flipping of the head is reduced.

Figure 4A:
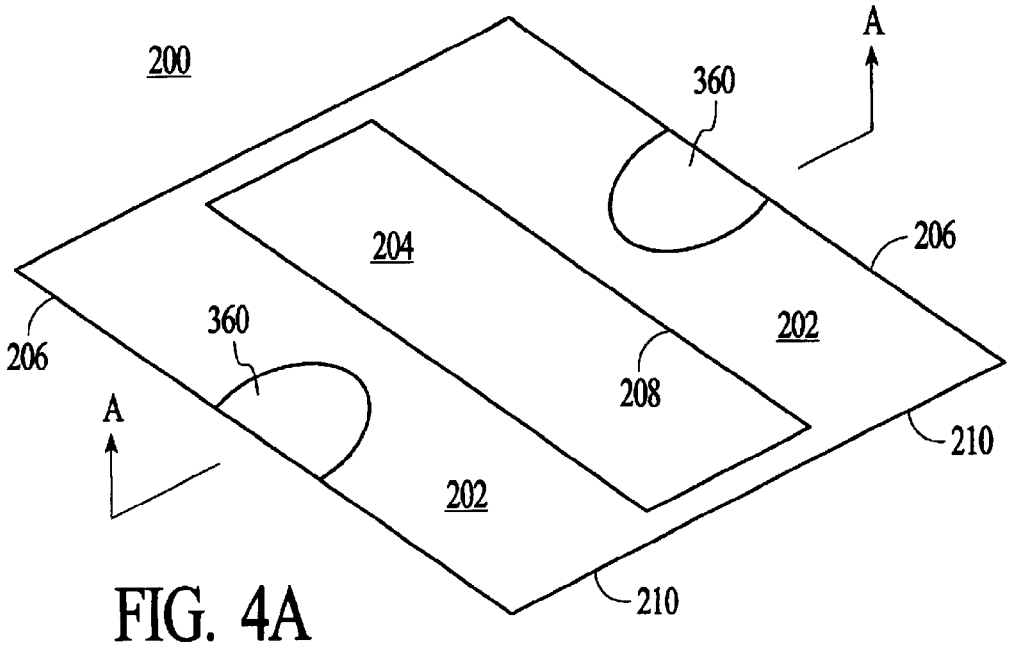
FIG. 4A is a representative view of a preferred embodiment of a cleaning pad 200 of a cleaning system 100 of the present invention.
Figure 4B:
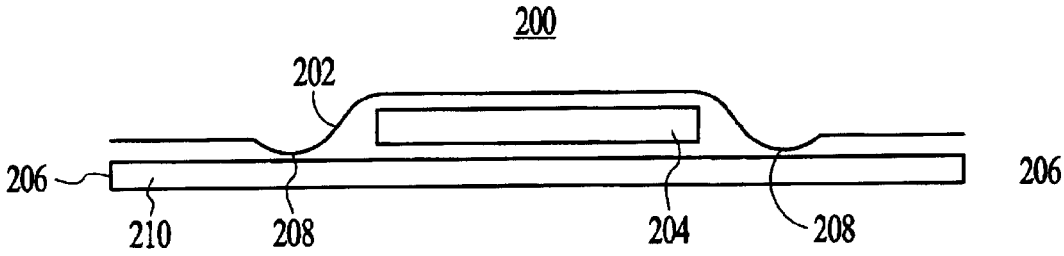
FIG. 4B is a representative cross section view of a preferred embodiment of a cleaning pad 200 of a cleaning system 100 of the present invention, such as taken along A—A.

FIG. 4A is a representative view of a preferred embodiment of a cleaning pad 200 of a cleaning system 100 of the present invention. FIG. 4B is a representative cross section view of a preferred embodiment of a cleaning pad 200 of a cleaning system 100 of the present invention, such as taken along A—A.

With regard to FIGS. 4A and 4B, the cleaning pad 200 consists of a surface (to be cleaned) contacting portion 202 which is the portion of the cleaning pad 200 which comes into direct contact with dirt and debris. This lower, surface contacting portion 202 lifts and locks dirt, dust, debris, hair, fluid, liquid, powder and other spills and materials and any other unwanted matter into itself. On one side of the surface contacting portion 202 there is a narrow strip of absorbent material 204 which has roughly the equivalent, or somewhat larger or somewhat smaller than, length and the width as the pad portion 304 of the head sub-assembly 300 (shown best in FIGS. 1–3A). It will be understood that this absorbent material may be any known material which has the ability to absorb fluid, including superabsorbent materials.

Additionally, a polyethylene film backing layer 206 is bonded at points 208 to the surface contacting portion 202. The film backing layer 206 can be formed of polyethylene or any suitable plastic, rubber, other elastomeric, polymeric or other flexible or otherwise suitable and desirable material which may be available. An advantage of using a fluid impervious material for the backing layer 206 is to prevent fluid leakage into and onto the head sub-assembly 300. Therefore, the use of any essentially fluid or dirt impermeable or impervious material would be useful in this application as backing layer 206 and will, therefore, be claimed within the scope of this patent. It will be known to those skilled in the art that the bonding 208 may be formed by heat sealing or thermo-sealing, various adhesives, any suitable bonding or sealing method, stitching, etc. Thus, absorbent material 204 is retained in a fixed position relative to the lower portion 202 by bonded points 208.

In a preferred embodiment, one or more portions of the cleaning pad 200 and/or the surface contacting portion 202 and/or the absorbent material 204 comprises a point unbonded web material as described in U.S. Pat. No. 5,858,112 issued Jan. 12, 1999 to Stokes et al. and U.S. Pat. No. 5,962,112 issued Oct. 5, 1999 to Haynes et al. or other material such as described by U.S. Pat. No. 4,720,415 issued Jan. 19, 1988 to Vander Wielan et al. or any superabsorbent material such as described in U.S. Pat. No. 4,995,133 issued February 1991 and U.S. Pat. No. 5,638,569 both issued to Newell, U.S. Pat. No. 5,960,508 issued Oct. 5, 1999 to Holt et al., and U.S6,003,191 issued Dec. 21, 1999 to Sherry et al., all of which are hereby expressly incorporated by reference herein, in their entirety.

In a preferred embodiment, the cleaning pad 200 and/or the surface contacting portion 202 comprises a spunbond fiber nonwoven web having a basis weight of approximately 68 grams per square meter. The spunbond fibers comprise bicomponent fibers having a side-by-side configuration where each component comprise about 50%, by volume, of the fiber. The spunbond fibers will comprise first and second polypropylene components and/or a first component comprising polypropylene and a second component comprising propylene-ethylene copolymer. About 1% or more or less of titanium oxide or dioxide is added to the fiber(s) in order to improve fiber opacity. The spunbond fiber nonwoven web s thermally bonded with a point unbonded pattern. The nonwoven web is bonded using both heat and compacting pressure by feeding the nonwoven web through a nip formed by a pair of counter-rotating bonding rolls; the bonding rolls comprise one flat roll and one engraved roll. The bonded region of the nonwoven web comprises a continuous pattern that corresponds to the pattern imparted to the engraved roll. Further, the bonded region is applied to the web when it passes through the nip. The bonded region will range between approximately about 27% to about 35% of the area of the nonwoven web and forms a repeating, non-random pattern of circular unbonded regions. Absorbency enhancing or superabsorbent materials, including superabsorbent polymers, powders, fibers and the like may be combined with the cleaning pad 200.

In a preferred embodiment, the unbonded regions of the cleaning pad material 200 as described above are used as the surface 202 to be placed in contact with the surface to be cleaned 712. These unbonded regions, laminated or pressed onto the layer of fibers which is opposite the unbonded region, are highly effective at lifting and locking the dirt, dust, debris, hair, spilled or applied fluids, cleaning solutions, etc. In preferred embodiments, the unbonded portions of the material can be imparted with a scrubby or scruffy surface treatment or composition of material, such as a powder, abrasive, cleaning agent, physical texturing of the fibers, hot air or fluid disruption of the unbonded fibers or other portions to enhance their cleaning capacity and efficacy.

In a preferred embodiment, the absorbent material 204 or elsewhere in the pad 200 comprises a laminate of an air-laid composite and a spunbond fiber nonwoven web. The nonwoven web comprises monocomponent spunbond fibers of polypropylene having a basis weight of approximately 14 grams per square meter. The air-laid composite comprises from about 85% to about % kraft pulp fluff and from about 10% to about 15% bicomponent staple fibers. The bicomponent staple fibers have a sheath-core configuration; the core component comprises polyethylene terephthalate and the sheath component comprises polyethylene. The air-laid composite has a basis weight between about 200 and about 350 grams per square meter and an absorbency of between about 8 and about 11 grams per gram. With regard to absorbency, the stated absorbency was determined under no load by placing a 4"×4" sample in three inches of tap water for three minutes, the sample is then removed from the water and held by a corner allowing it to gravity drip for one minute. The (wet weight—dry weight)/dry weight yields the gram per gram absorbency.

In preferred embodiments of the cleaning pad 204, PET or other hydrophillic fibers useful for scrubbing are employed. Additionally, nylon fibers are useful as they increase the coefficient of friction when they become wet. Increasing the coefficient of friction between the cleaning pad 200 and the surface being cleaned or coated is useful for better cleaning, coating performance. Any component of the cleaning pad 200 may be composed of microfibers and ultra-microfibers having a denier per filament (dpf) less than or equal to about 1.0.

In a preferred embodiment, the cleaning pad 200 is loaded or doped with micro-encapsulated, amounts of cleaning compounds. The cleaning fluid itself 502 can be micro-encapsulated, and individual cleaning compounds can be used separately. These would includes, without limitation: anti-microbial, sanitizing and de-odorizing agents, cleaning agents, waxes, polishes or shining agents, softening agents, friction-enhancing compounds or surfaces, perfumes, etc. multi-phases systems may also be applied to a floor or other surface in this way.

When the cleaning pad 200 is positioned such that the pad portion 304 of the head sub-assembly 300 is aligned with the absorbent material 204, and the film backing 206 is adjacent the lower surface of the pad portion 304 of the head subassembly 300, it will be known to those skilled in the art that the rectangular sections 210 can be folded over the lengthwise edges 320 of the pad portion 304, including the leading edge 352 and the back edge 354, and pinched into the slotted portions 312 of the pinchers 308. In this manner, the cleaning pad 200 will be retained on the head portion or assembly 300 in a desired position.

In a preferred embodiment, one or two sections of the absorbent material 202 are removed from the lengthwise portions 320, resulting in one or more notches 260 in the cleaning pad means 200. These notches 260 make it easier for the user to attach the cleaning pad or sheet 200 to the cleaning head assembly 300 without flow or delivery of cleaning fluid liquid 502 is not interrupted or impeded. Providing a double notched 360 cleaning pad or sheet 200 makes it possible for the user to orient the cleaning pad in at least two different configurations without obstructing flow of cleaning solution or fluid 502.

Figure 4C:
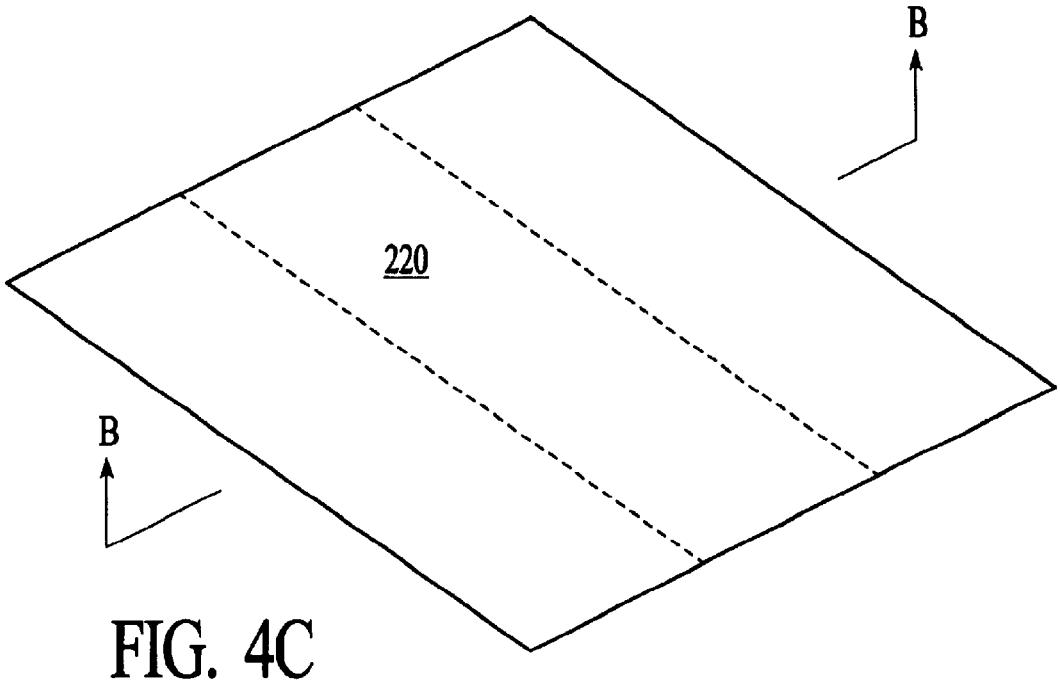
FIG. 4C is a representative view of a preferred embodiment of a cleaning pad or sheet 200 of a cleaning system 100 of the present invention.

As best shown in FIG. 4A, notch 360 located on one or two side panels 210 such as indicated is particularly adapted for use when the contour of the head sub-assembly 300 and the position of the nozzle assembly 700 thereon requires clearance for delivery of cleaning fluid 502 therefrom. This cleaning fluid delivery notch 360 can be shaped or otherwise formed as desired, including perforated section which is torn out by the consumer, a slit portion, various shaped section cut-out, FIG. 4C is a representative view of a preferred embodiment of a cleaning pad or sheet 200 of a cleaning system 100 of the present invention. It will be understood that the cleaning pad 200 used with the cleaning system 100 of the present invention may be any useful or desirable cleaning pad or cloth, unwoven, non-woven or woven materials, co-materials, bonded or laminated materials, for any of various structurally distinct construction. Furthermore, any optimum or possible combination or synthesis of the various embodiments of cleaning pads shown in FIGS: 1, 4A–4F will be useful herein and, therefore, are included within the scope of this invention.

Figure 4D:
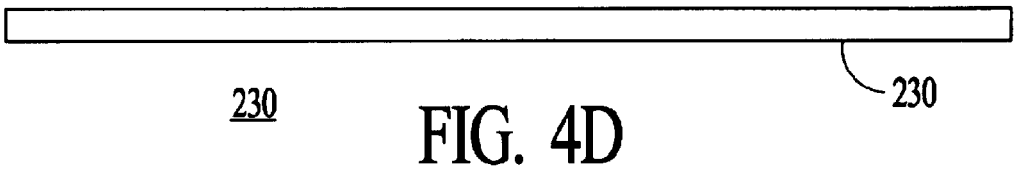
FIG. 4D is a representative cross section view of a preferred embodiment of a cleaning pad 230 of a cleaning system 100 of the present invention, such as taken along B—B.

FIG. 4D is a representative cross section view of a preferred embodiment of a cleaning pad 230 of a cleaning system 100 of the present invention, such as taken along B—B. It will be understood by the foregoing and the following that this invention includes providing a single layer portion of material for the cleaning pad 230 which is capable of being fluid absorbent and will scrub a surface while maintaining integrity. As described, the single layer portion of material cleaning pad 230 can be formed by any material or material-forming process known, including woven and non-woven materials, polymers, gels, extruded materials, laminates, layered materials which are bonded together integrally and thus form a co-material, fused materials, extruded materials, air laying, etc. additionally, materials which are useful include sponges, fabrics, etc.

Figure 4E:
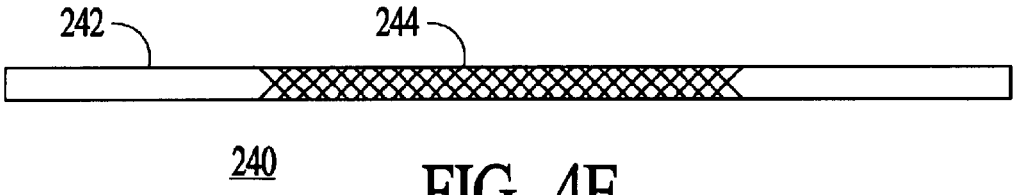
FIG. 4E is a representative cross section view of a preferred embodiment of a cleaning pad 240 of a cleaning system 100 of the present invention.

FIG. 4E is a representative cross section view of a preferred embodiment of a cleaning pad 240 of a cleaning system 100 of the present invention. The cleaning pad 240 is formed of discrete sections or portions. Peripheral edge sections 242 are useful for pinching into the pinchers 308 of the head assembly 300. Adjacent to edge sections can be one or more lengthwise or widthwise orientated strips of material 244 which will have enhanced, preselected, predetermined and other desirable and advantageous properties for cleaning and mopping surfaces.

Figure 4F:
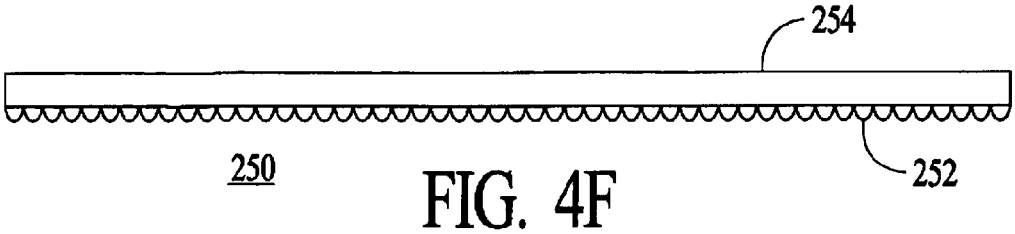
FIG. 4F is a representative cross section view of a preferred embodiment of a cleaning pad 250 of a cleaning system 100 of the present invention.

FIG. 4F is a representative cross section view of a preferred embodiment of a cleaning pad 250 of a cleaning system 100 of the present invention. The cleaning pad 250 is formed of layers of material or is a single layer of material, as discussed above and elsewhere herein, but there is an enhanced surface contacting side 252. This enhanced surface contacting layer or portion of cleaning pad 250 can be optimized for providing a cleaning fluid to the surface, such as with micro capsules or encapsulated fluids or agents. The enhanced surface 252 of the cleaning pad 250 can have scrubbing or abrasive qualities. The enhanced surface 252 can also be formed by a mechanical stamping, bonding, pressing, compression, extrusion, sprayed, sputtered, laminated or other surface forming or affecting process.

Furthermore, the upper layer 254 of the cleaning pad 250 will be formed of any suitable material, if different than that of the enhanced surface 252. In general, however, the upper layer 254 can be formed of a fluid membrane or an impervious or absorbent or other non-absorbent material. Such upper layer 254 can be laminated, heat sealed, fused, compressed with, glued to or otherwise in contact with the surface contacting portion 252.

It will be understood that various absorbent materials 204 are able to absorb and hold fluids, preventing dripping or "squeeze-out", even under applied pressure. Thus, as a user uses the system 100, the cleaning pad 200 will absorb spilled or applied fluids, including cleaning fluids, polishes, special surface coatings, etc. As the user continues through the cleaning experience, whereas conventional materials may tend to allow the absorbed fluid to be re-released, such as at the sides, front or back of the drawing movement of the head assembly 300. This absorbent material 204 or other portion of the cleaning pad 200 will be enhanced to prevent release, drippage or squeeze-out of fluid absorbed therein.

In a preferred embodiment, an internal or external or combination cage, frame, ribcage, scrim or scrim assembly for providing an enhanced structure to the cleaning pad 200 will be used. This scrim or internal frame system for the cleaning pad 200 or the absorbent portion 204 thereof, is intended to provide a structure such that fluid can be absorbed into the cleaning pad 200 but fluid release is avoided. The scrim can also take the form of an open-textured or fishnet-type knit material. The open weave or mesh of the scrim material enhances the capacity to hold, lift and lock or other wise entrap and remove dirt, dust, hair, lint, fuzz, and other debris or soils to be removed by the system 100. The scrim material, being a rigid, more durable, stiffer or thicker material than other portions of the cleaning pad 200, will prevent the cleaning pad 200 from being compressed during use, or otherwise, such that the fluid absorbed into the absorbent portion 204 or elsewhere on the cleaning pad 200 will not be squeezed out. International Publication Number WO 98/42246 published 1 Oct. 1998 describes additional embodiments of a cleaning implement comprising a removable cleaning pad 200, including a scrim and scrim portion for scrubbing, and is incorporated herein in its entirety by reference.

Figure 4G:
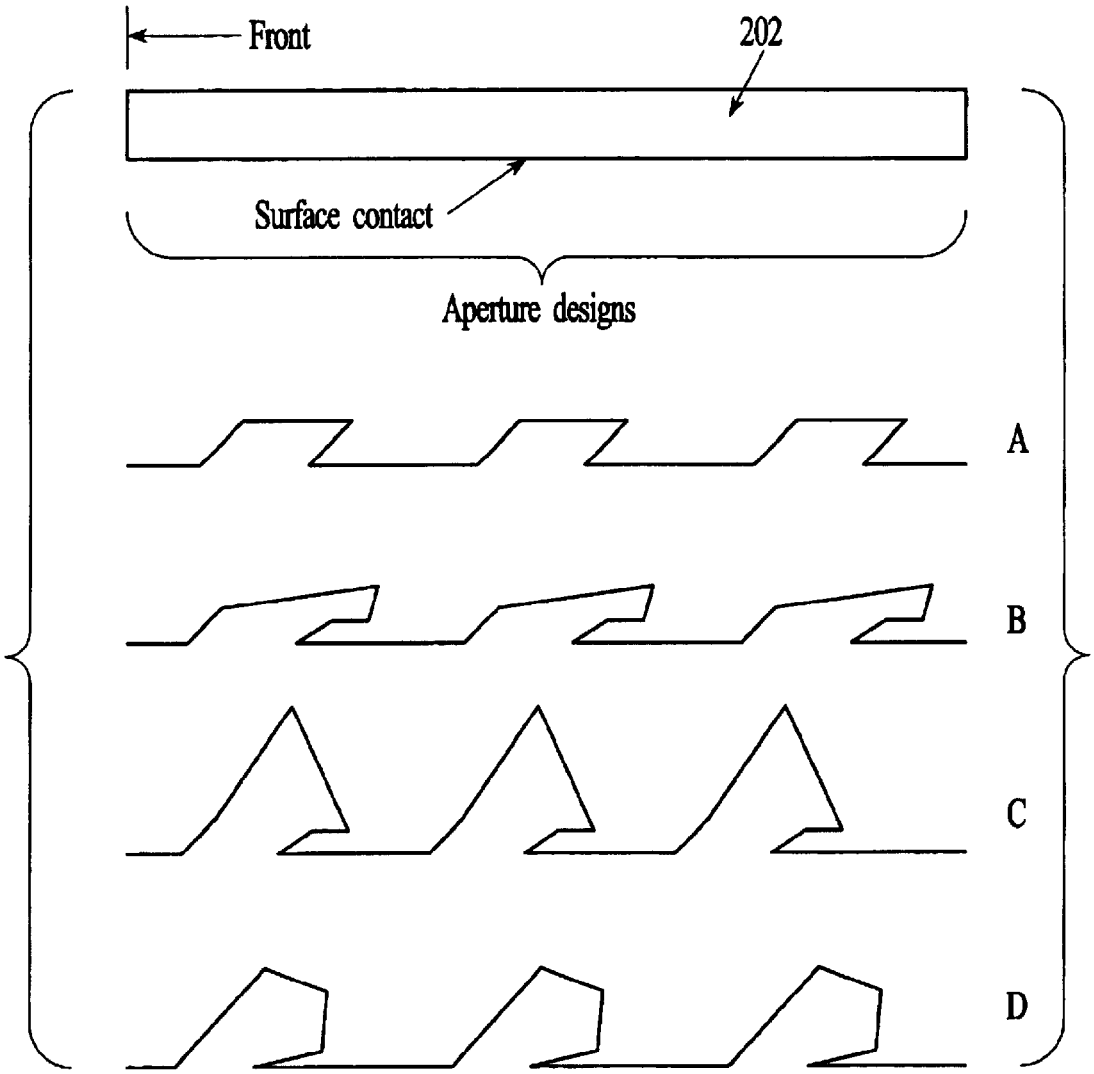
FIG. 4G is a representative cross section view of a preferred embodiment of a cleaning pad 200 and 4 different embossing patterns 203 overlaid the surface contacting portion 202 of a cleaning system 100 of the present invention.

Thus, it will be understood that a preferred embodiment of the cleaning pad 200 of the present invention includes any suitable open pore, burlap or fishnet type sponge structure for snagging, or collecting particulate. Such cleaning pad 200 can be enhanced by providing embossing 203 (as best shown in FIG. 4G) and/or providing slits or pre-cut holes, openings, slots or other apertures, with or without removing material when creating those openings. The surface contacting portion 202 of a cleaning pad 200 can be sliced or slotted prior to assembly, if using more than one component. In a preferred embodiment, the cleaning portion 202 or other portion of the pad 200 is a robust material marketed by PGI as Lavette Super.

In a preferred embodiment, the cleaning pad or sheet 200 comprises strips or stripes of scrubbing or abrasive material. Such abrasive will be surface-safe, so as not to damage the finish, polish or other desirable qualities of a smooth floor or other surface to be cleaned In preferred embodiments, the cleaning pad 200 has an absorbent portion 204 which is comprised of a plurality of layers of absorbent material. The layers can be formed by individual slices, a single, rolled section of material which is simply flattened into a layered, absorbent portion 204. As described, such can be formed of rayon, polyester, nylon material, pulp, combinations and composites and multi-and bi-component materials can be used.

FIG. 4G is a representative cross section view of a preferred embodiment of a cleaning pad 200 and 4 different embossing patterns 203 overlaid the surface contacting portion 202 of a cleaning system 100 of the present invention. The surface contacting portion 202 can contain apertures 203 designed to scoop up and entrap dirt, hair, crumbs, and dust. Aperture designs 203 include many, such as those shown as A, B, C, and D. The aperture designs 203 shown are merely representative of a few of the possible designs, and while others will become apparent to those skilled in the art, they will be covered within the scope and purview of the present invention.

Figure 5A:
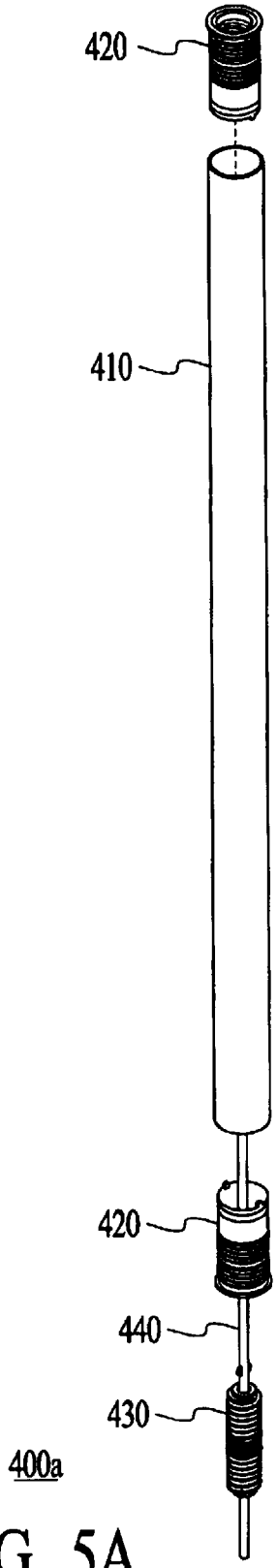
FIG. 5A is a representative exploded view of a preferred embodiment of a mid portion 400*a* of a handle sub-assembly 400 (as shown in FIGS. 1 and 2) of a cleaning system 100 of the present invention.

FIG. 5A is a representative exploded view of a mid portion 400*a* of a handle sub-assembly 400 such as shown in FIGS. 1 and 2 of a cleaning system 100 of the present invention. It will be known based on the foregoing and the following that the mid portion 400*a* of the handle sub-assembly 400 can have various embodiments, and but essentially a single preferred embodiment are described herein. The handle sub-assembly 400 consists of a shaft section 410 with a sleeve member 420 pressed onto place at either end. Further, it will be known to those skilled in the art that additional means for securing the sleeve members 420 into the ends of the shaft sections 410 will be available, including threaded ends, pins, welding, other types of press fittings, compression and expansion fittings or adhesives, and other common or custom coupling or attachment means, etc.

Figure 5E:
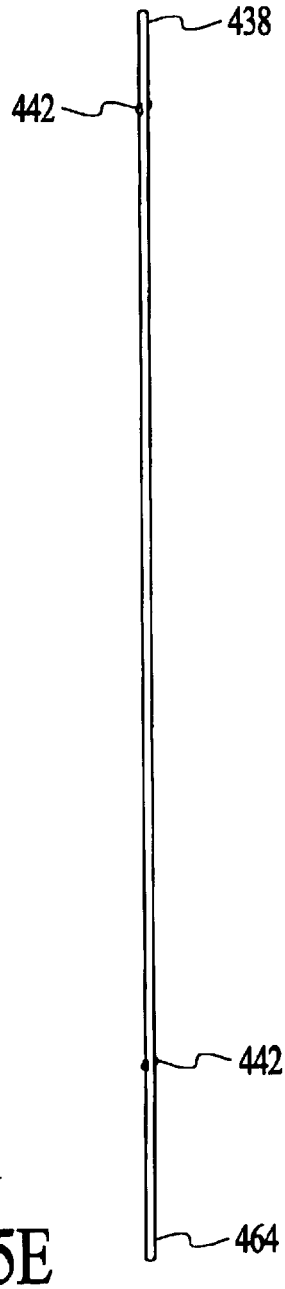
FIG. 5E is a representative view of a preferred embodiment of a push rod 440 of a handle sub-assembly 400 of a cleaning system 100 of the present invention.
Figure 5B:
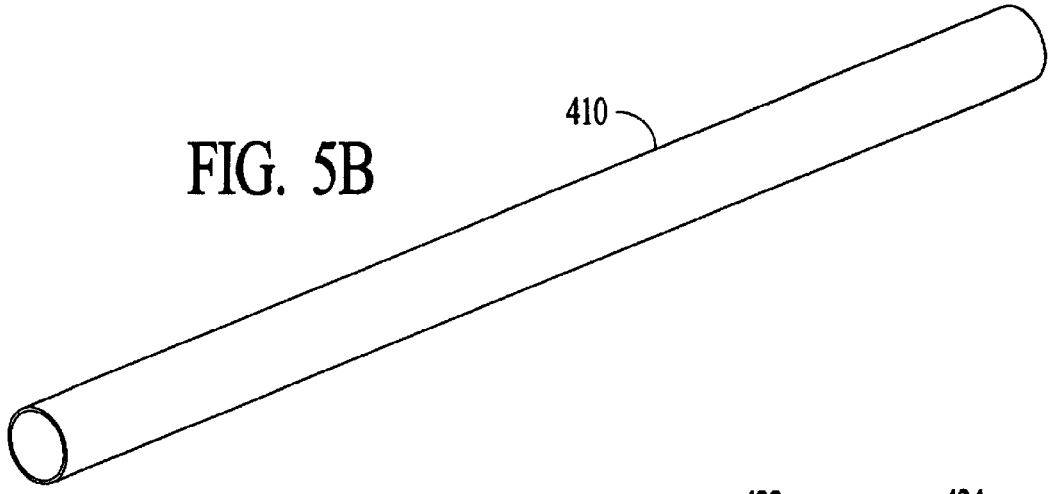
FIG. 5B is a representative isometric view of a preferred embodiment of a shaft section 410 of a handle sub-assembly 400 of a cleaning system 100 of the present invention.

FIG. 5B is a representative isometric view of a preferred embodiment of a shaft section 410 of a handle sub-assembly 400 of a cleaning system 100 of the present invention. The tubular shaft section 410 can be formed of any of a variety of materials and methods, including but not limited to the following materials and methods of forming those: glass, paper, cardboard, wood, any metals including steels, aluminum, titanium, alloys including chrome, molybdenum, plastics, composites including fiber glass, formica, natural and synthetic, man-made materials, canes, tubular members made of carbon components, crystals, fibers, alloys, etc., by extrusion, pressing, braking, rolling sheet portions, stamping, carved, otherwise shaped, formed, prepared and/or assembled.

Figure 5D:
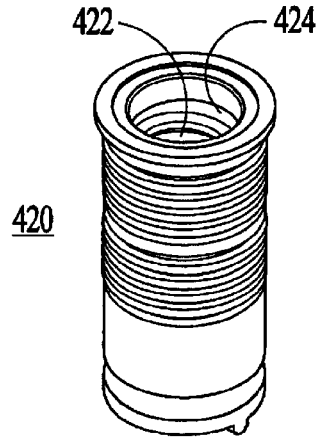
FIG. 5D is a representative isometric view of a preferred embodiment of a sleeve member 420 of a handle sub-assembly 400 of a cleaning system 100 of the present invention.
Figure 5C:
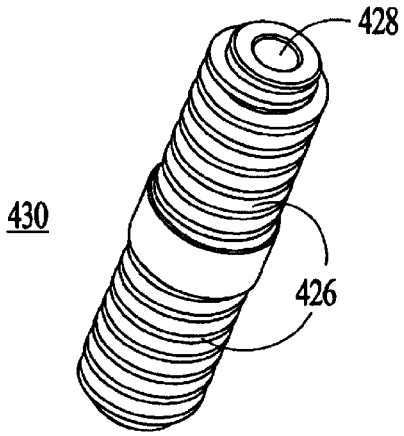
FIG. 5C is a representative isometric view of a preferred embodiment of a threaded shaft coupling member 430 of a handle sub-assembly 400 of a cleaning system 100 of the present invention.

FIG. 5C is a representative isometric view of a preferred embodiment of a shaft coupling 430 of a handle sub-assembly 400 of a cleaning system 100 of the present invention. FIG. 5D is a representative isometric view of a preferred embodiment of a sleeve member 420 of a handle sub-assembly 400 of a cleaning system 100 of the present invention.

The threaded shaft coupling member 430 has one or more helically threaded portions 426 which align and thread into matching threaded portion 424 in the sleeve member 420. It will be apparent, therefore, that by coupling multiple shaft sections 410 together with shaft coupling members 430 between different shaft sections 410, a handle sub-assembly 400 having essentially any desired length or other geometry may be obtained. Additionally, an opening or hole 428 extends through the coupling member 430.

FIG. 5E is a representative view of a preferred embodiment of a push rod 440 such as of a mid-portion 400*a* handle sub-assembly 400 of a cleaning system 100 of the present invention. The push rod 440 extends through holes 422 passing through the sleeve members 420 and through the openings 428 through the coupling members 430. Local deformations 442 at either end of the push rod 440 serve as detents or stops for controlling translation of the push rod 440 as desired.

Figure 5F:
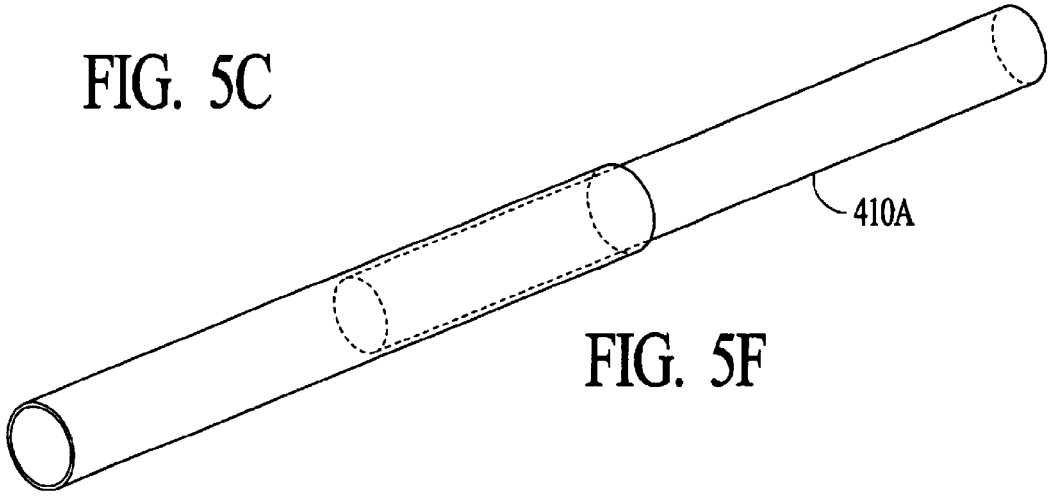
FIG. 5F is a representative view of a preferred embodiment of a telescoping shaft section 410*a* of a handle sub-assembly 400 (as shown in FIGS. 1 and 2) of a cleaning system 100 of the present invention.

FIG. 5F is a representative view of a preferred embodiment of a telescoping shaft section 410*a* of a handle sub-assembly 400 (as shown in FIGS. 1 and 2) of a cleaning system 100 of the present invention.

It will be understood by the foregoing and the following that the handle sub-assembly 400 of a cleaning system 100 can comprise one or more shaft sections 410 in a coupled, hinged, telescoping, collapsible, expanding or other configuration. A plurality of telescoping or collapsing shaft sections 410 in combination is space-saving, convenient to use and economical to manufacture, and is included within the scope of the present invention.

Figure 6A:
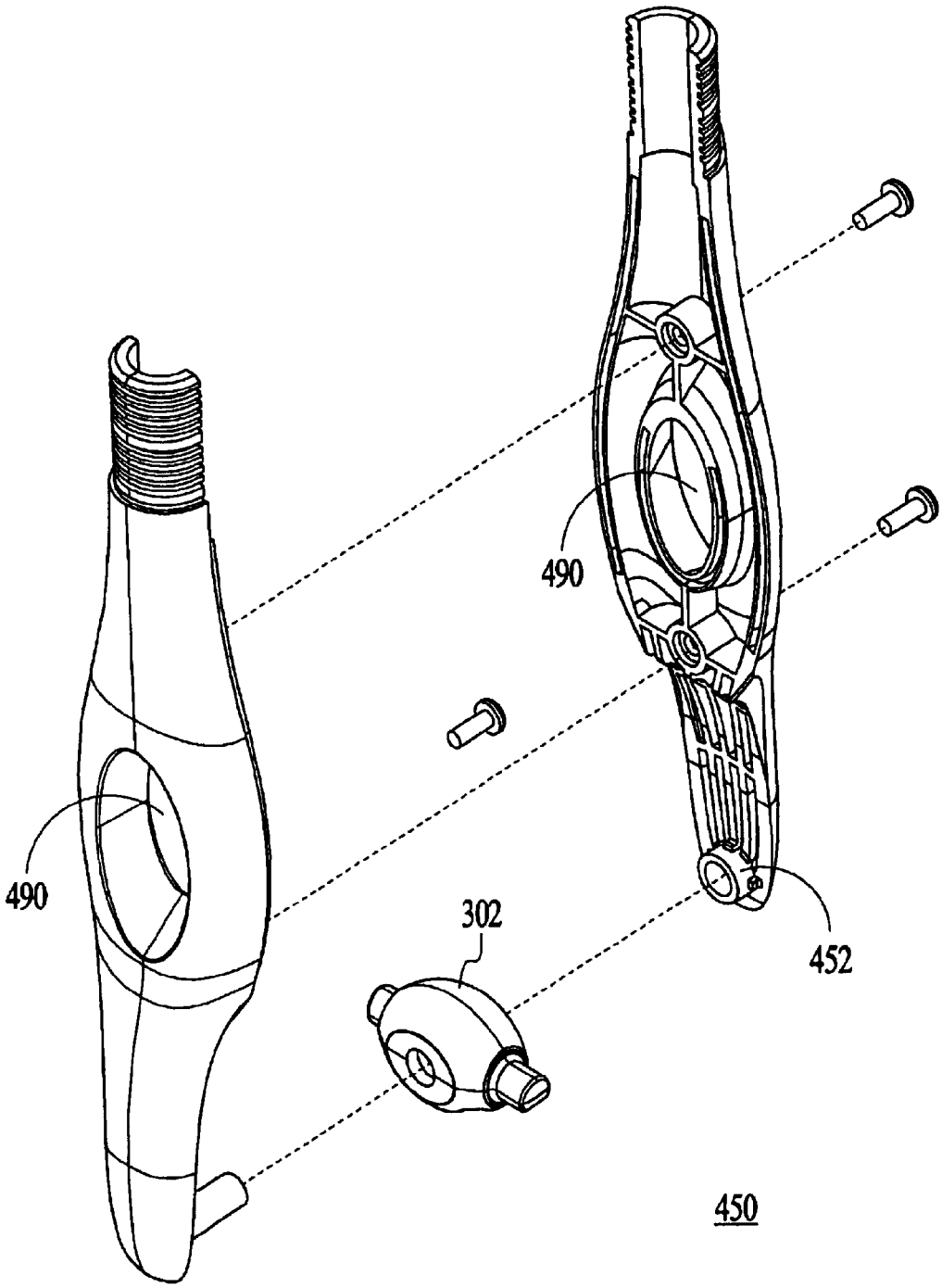
FIG. 6A is a representative isometric view with hidden lines of a preferred embodiment of a yoke section 450 and universal joint 302 of a handle sub-assembly 400 of a cleaning system 100 of the present invention.

FIG. 6A is a representative isometric view with hidden lines of a preferred embodiment of a yoke section 450 and a universal joint 302 of a handle sub-assembly 400 of a cleaning system 100 of the present invention. The yoke section 450 can be formed by injection molding, extrusion, etc. A coupling portion 452 is adapted for coupling to the universal joint 302 which couples to the head assembly 300 as shown in FIG. 1. Thus, upward and downward motion of the handle assembly 400 can be achieved. Furthermore, by mounting the universal joint 302 onto the head assembly 300, the universal joint 302 can swivel and the handle assembly 400 can move laterally. A central opening 490 through the yoke section 450 is particularly useful for passing a fluid delivery tube 504 through for attachment of a nozzle sub-assembly 700 to a head portion 300.

Figure 6B:
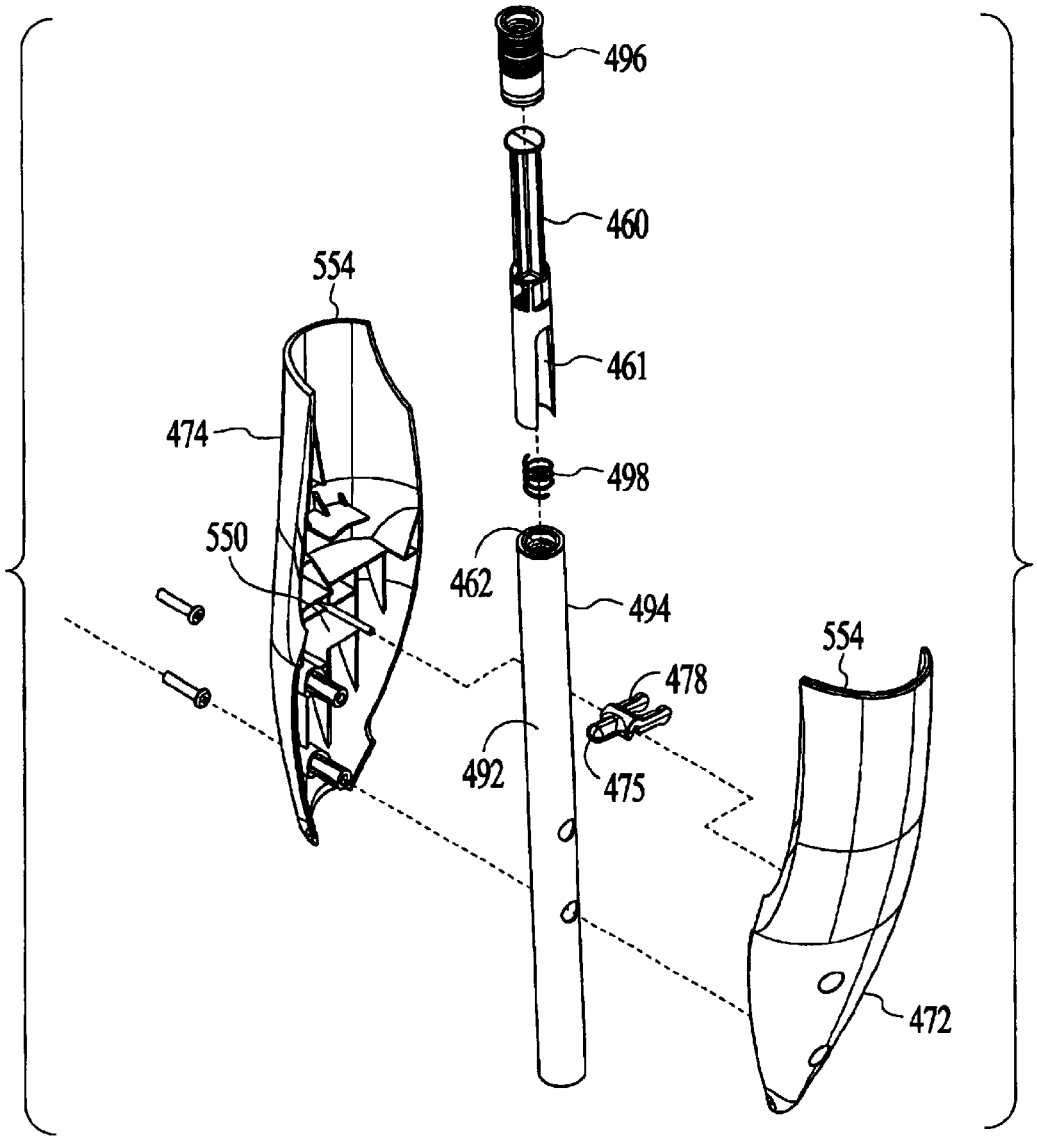
FIG. 6B is a representative exploded view of a preferred embodiment of a holster sub-assembly 470 of a cleaning system 100 of the present invention.
Figure 6C:
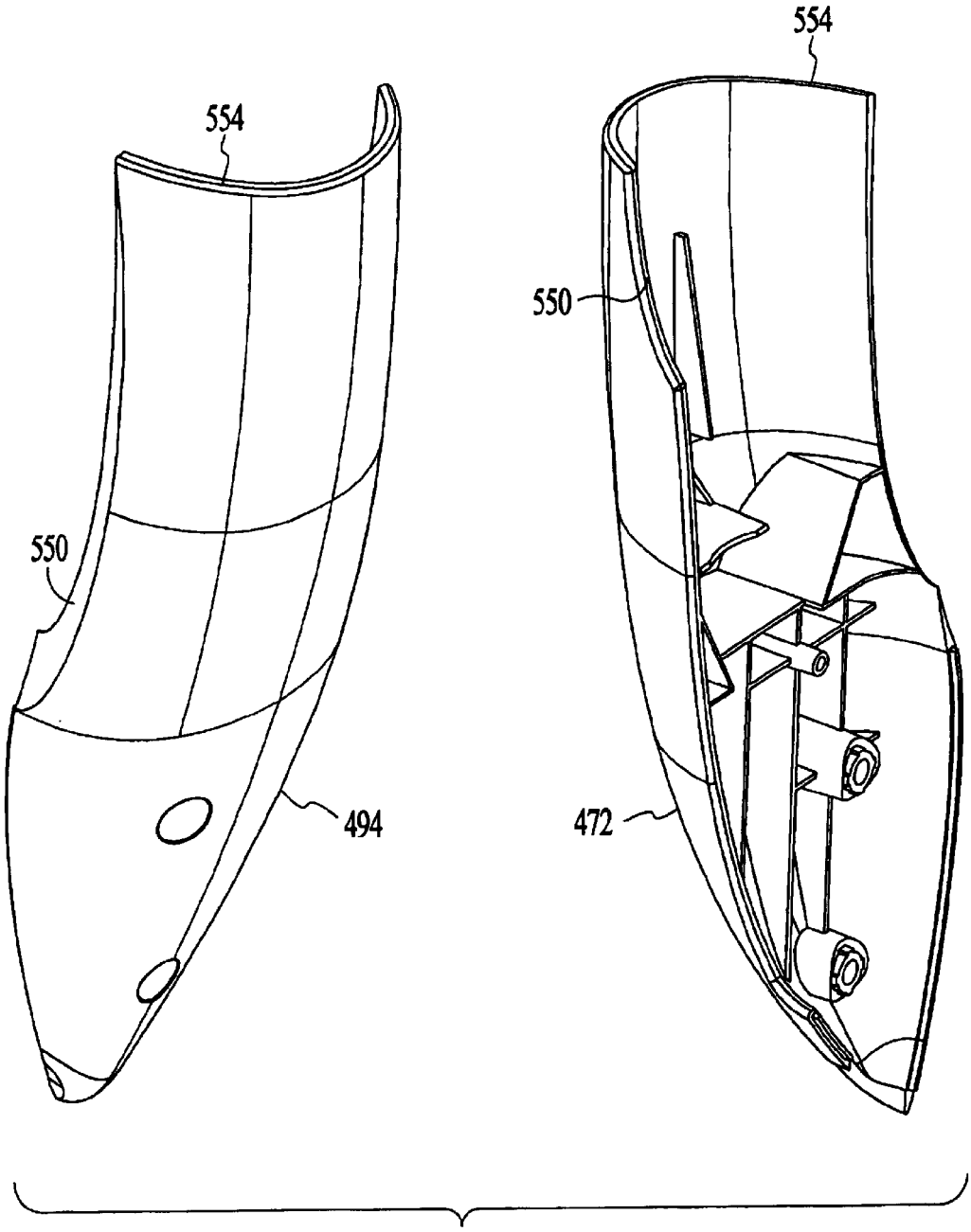
FIG. 6C is a representative isometric view of left side cradle portion and right side cradle portion of a preferred embodiment of a holster sub-assembly 470 of a cleaning system 100 of the present invention.

FIG. 6B is a representative exploded view of a preferred embodiment of a holster sub-assembly 470 of a cleaning system 100 of the present invention. FIG. 6C is a representative isometric view of left side cradle portion 472 and right side cradle portion 474 of a preferred embodiment of a holster sub-assembly 470 of a cleaning system 100 of the present invention.

The left side cradle portion 472 and right side cradle portion 474 can be injection or blow molded of rigid plastic. Tab portions, mating adhesion points, or other coupling means on the mating faces of the left side cradle portion 472 and right side cradle portion 474 couple the cradle portions together detachably or permanently.

As shown in FIG. 6B, cylindrical slide member 460 fits within hollow internal opening 462 at the proximal end 494 of the tubular section 492. Therefore, the slide member 460 is moved distally through the hollow internal opening 462 at the end of the tubular section 492. Distally, it engages bearingly upon valve lever 478 or other structure extending trans-axially through or at least into tubular section 492 as shown. Proximally, a shaft coupling member 496 retains the slide member 460, which is biased proximally by spring 498 or other biasing member, disposed within the opening 462 of tubular shaft section 492 between the proximal end portion 461 of the slide 460 and the biasing arm 475 of the lever portion 478.

Figure 7A:
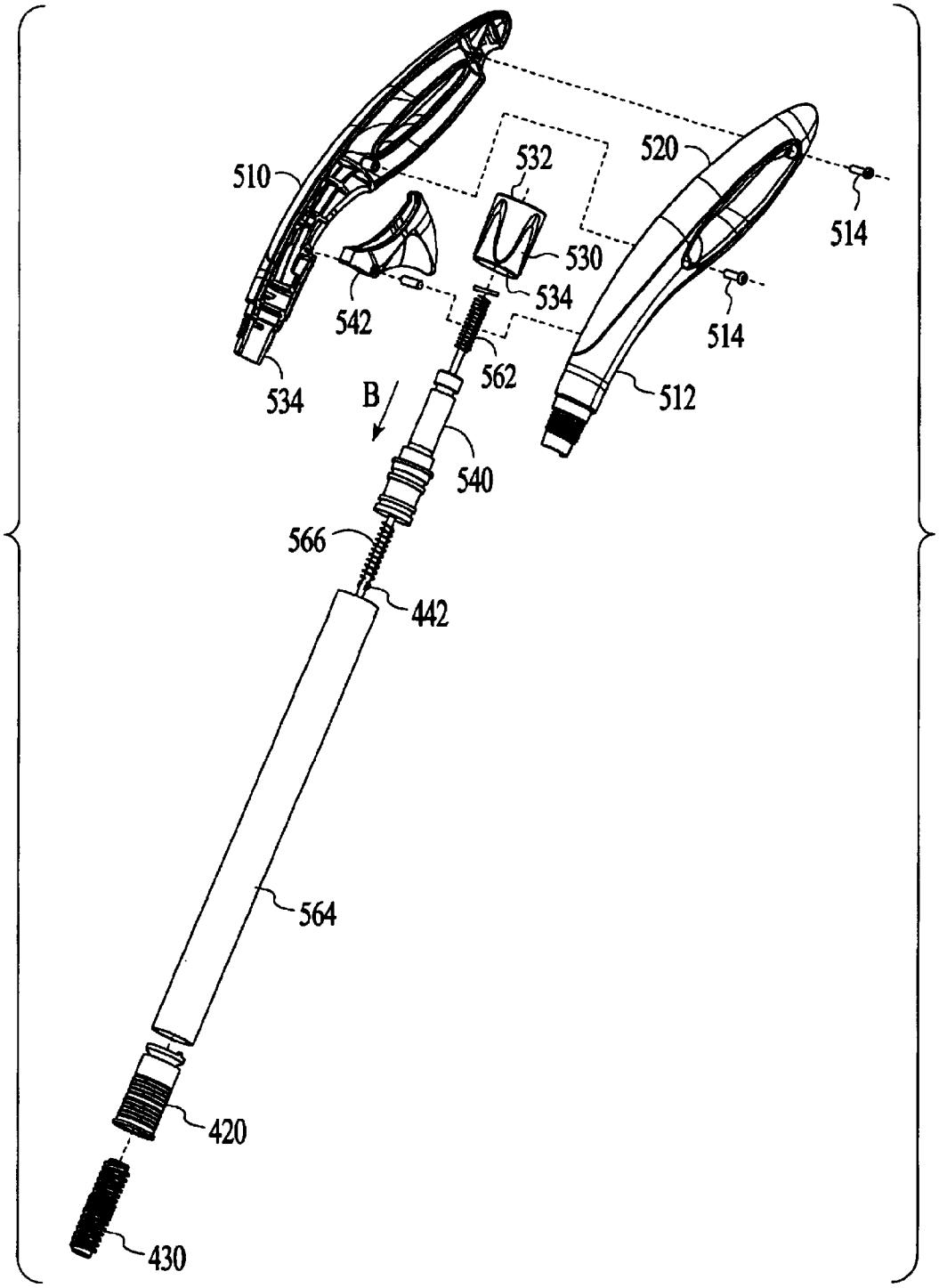
FIG. 7A is a representative exploded view of a preferred embodiment of a proximal end 501 of a handle sub-assembly 400 of a cleaning system 100 of the present invention.
Figure 7B:
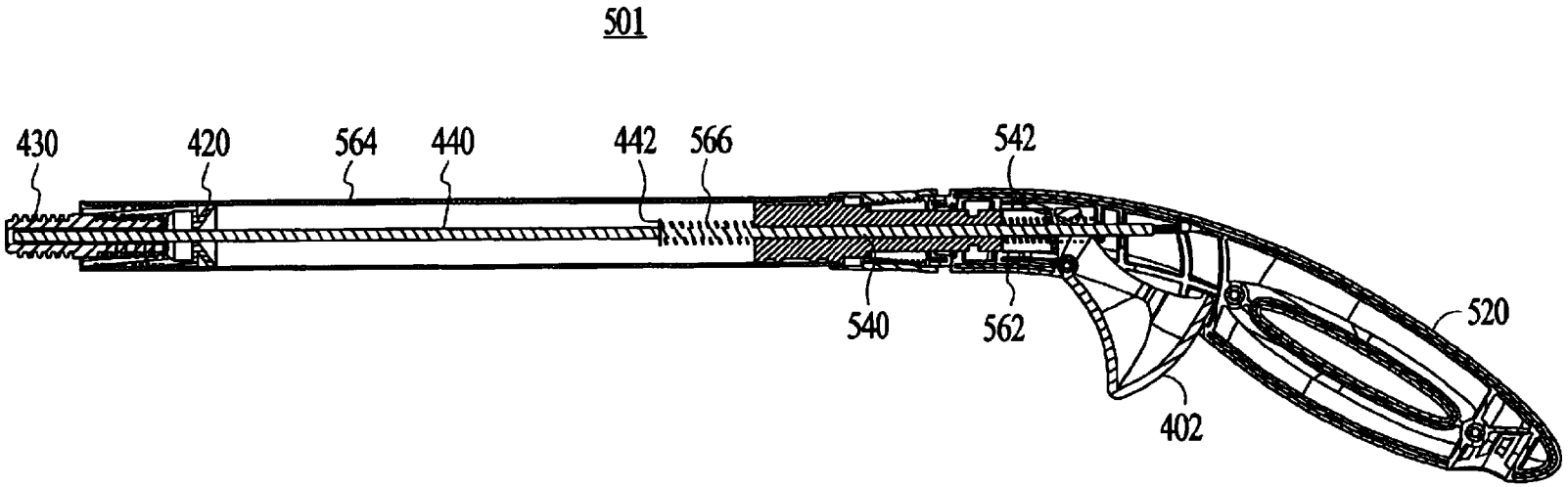
FIG. 7B is a representative section view of a preferred embodiment of a proximal end 501 of a handle sub-assembly 400 of a cleaning system 100 of the present invention.

FIG. 7A is a representative exploded view of a preferred embodiment of a proximal end 501 of a handle sub-assembly 400 of a cleaning system 100 of the present invention. FIG. 7B is a representative section view of a preferred embodiment of a proximal end 501 of a handle sub-assembly 400 of a cleaning system 100 of the present invention.

As shown, the right handle portion 510 couples with the left handle portion 512 through detachable or permanent mating means 514. Together with an optional overmolded portion 520, the three sections form an ergonomic hand grip for the distal end 500 of the handle assembly 400. As shown, trigger member 402 is retained within the assembly 500 with trigger pin 560. First spring means 562 biases the trigger in a set position.

As shown, upper portion 532 of the collar portion 530 engages the distal ends 534 of right and left handle portions 510 and 512, respectively. Thus, handle coupling 540 is retained between the collar 530 and the right and left handle portions 510 and 512, respectively, and slides within proximal shaft portion 564. Pull rod 440 extends through handling coupling 540 and proximal shaft portion 564. Second spring means 566 is positioned over the pull rod 440 retained in position between slide stop 442. At a distal end, shaft sleeve 420, as shown in FIGS. 5A and 5D, couples to proximal shaft portion 564, with shaft coupling member 430 threadingly engaged thereto, as shown in FIGS. 5A and 5C.

As trigger 402 is squeezed manually or otherwise, bearing surface 542 on trigger 402 bears thrustingly upon proximal end 544 of handle coupling 540 to drive the handle coupling 540 distally in direction B. The distal end 546 of handle coupling 540 bears upon push rod 440 through second spring means 566. In a preferred embodiment, the handle assembly 501 is automatically self-adjusting. Upon initial assembly, a first draw on the trigger 402 sets the correct distances for trigger travel as it translates to activation of the valve assembly 800 on the reservoir 500. The action is a modified ratchet mechanism as found on caulking guns and other extrusion or pump devices.

Figure 8A:
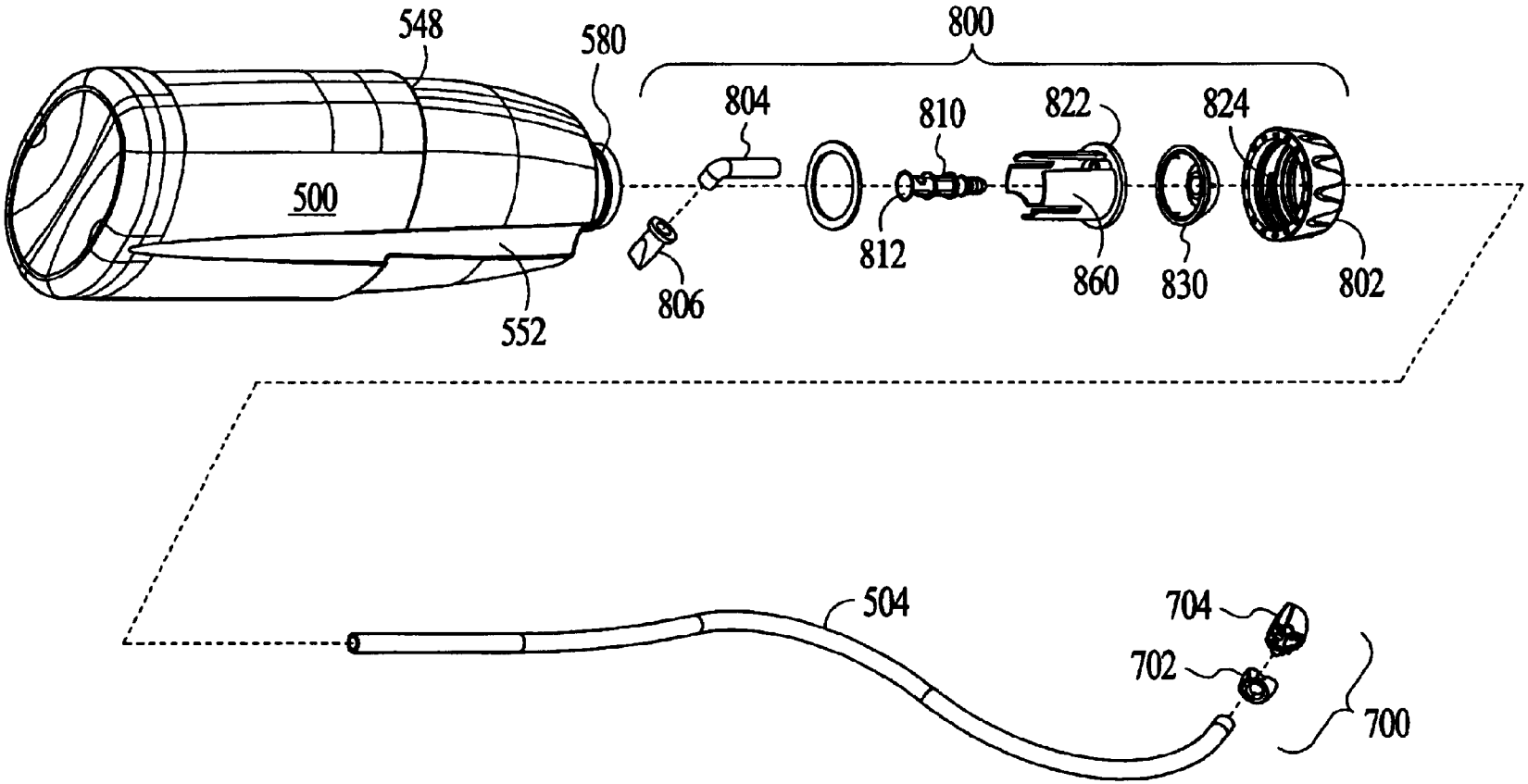
FIG. 8A is a representative exploded view of a preferred embodiment of a cleaning fluid reservoir 500 and valve sub-assembly 800 with flexible fluid delivery tubing 504 and nozzle assembly 700 of a cleaning system 100 of the present invention.
Figure 8B:
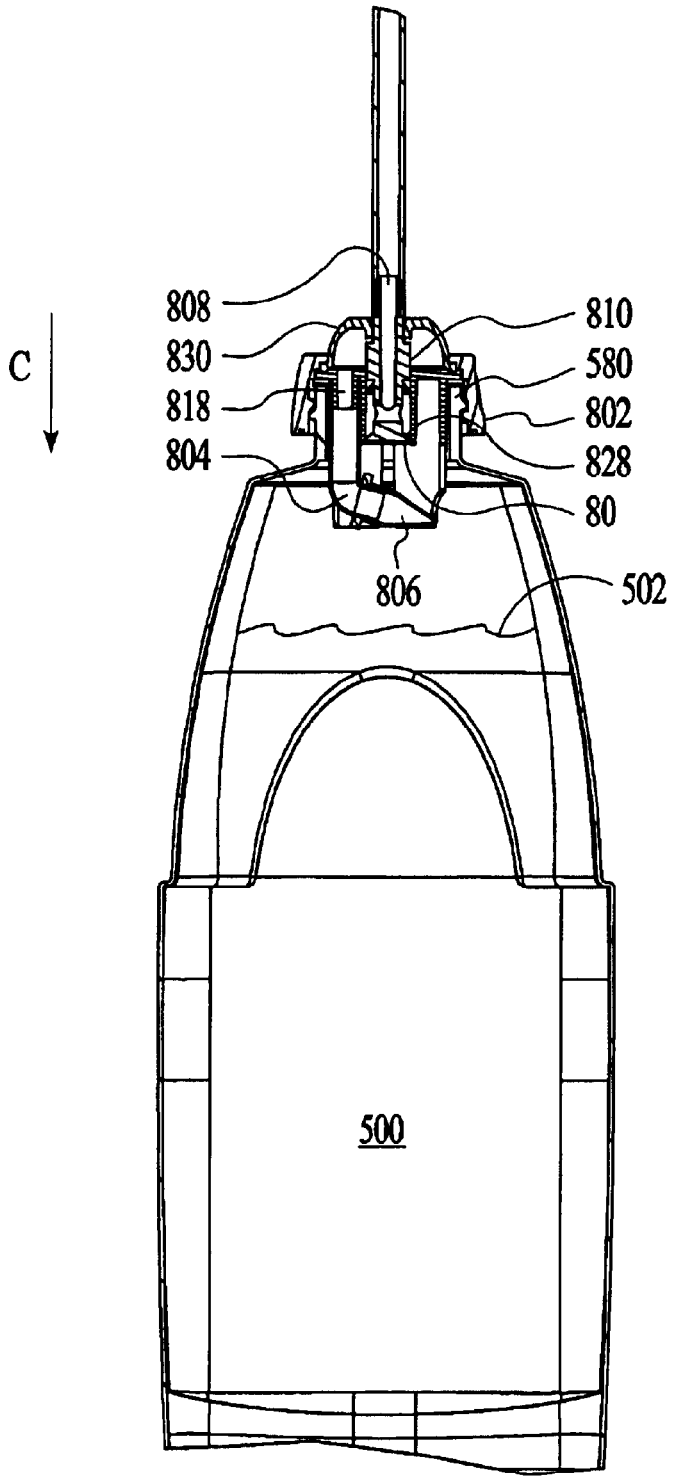
FIG. 8B is a representative section view of a preferred embodiment of a cleaning fluid reservoir 500 and valve sub-assembly 800 with flexible fluid delivery tubing 504.
Figure 8C:
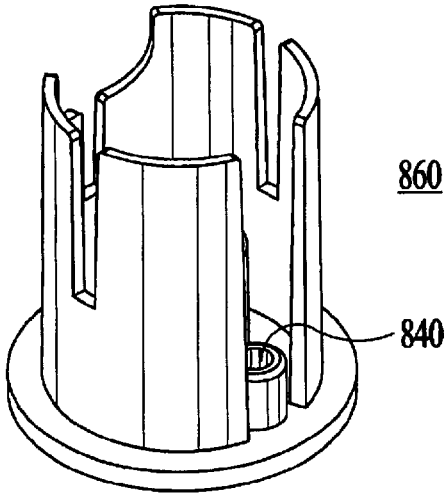
FIG. 8C is a representative upper isometric view of a preferred embodiment of a valve cap portion 860 of a valve sub-assembly 800 of a cleaning system 100 of the present invention.
Figure 8D:
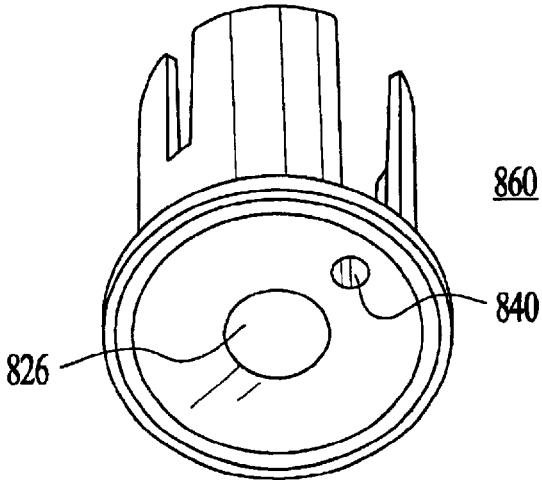
FIG. 8D is a representative lower isometric view of a preferred embodiment of a valve cap portion 860 of a valve sub-assembly 800 of a cleaning system 100 of the present invention.
Figure 8E:
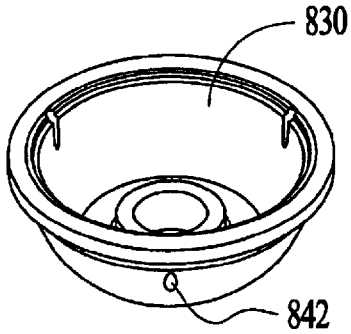
FIG. 8E is a representative isometric view of a preferred embodiment of a flex dome portion 830 of a valve sub-assembly 800 of a cleaning system 100 of the present invention.
Figure 8F:
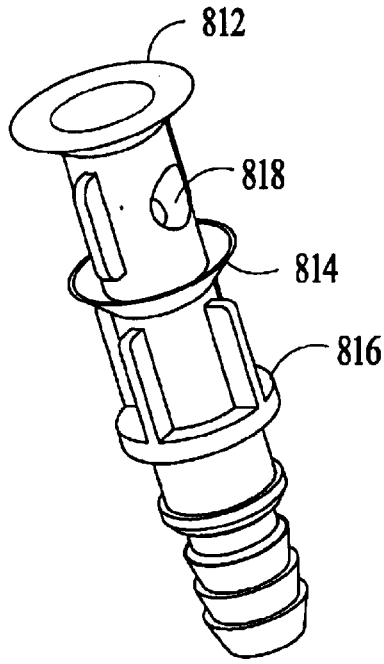
FIG. 8F is a representative isometric view of a preferred embodiment of a valve post 810 of a valve sub-assembly 800 of a cleaning system 100 of the present invention.
Figure 8G:
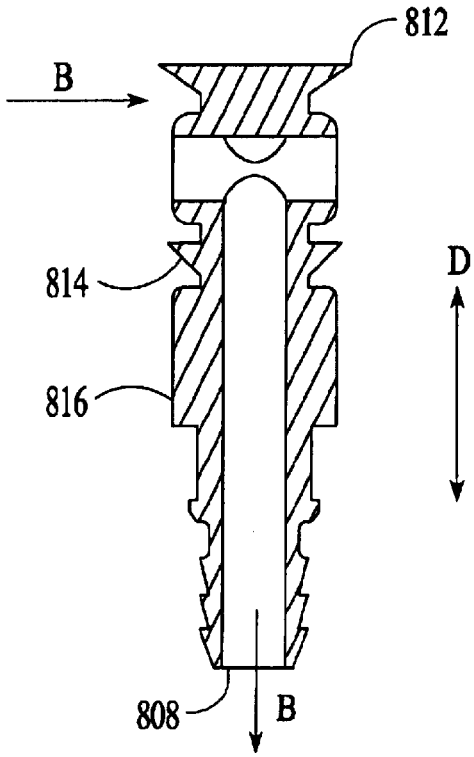
FIG. 8G is a representative section view of a preferred embodiment of a valve post 810 of a valve sub-assembly 800 of a cleaning system 100 of the present invention.
Figure 8H:
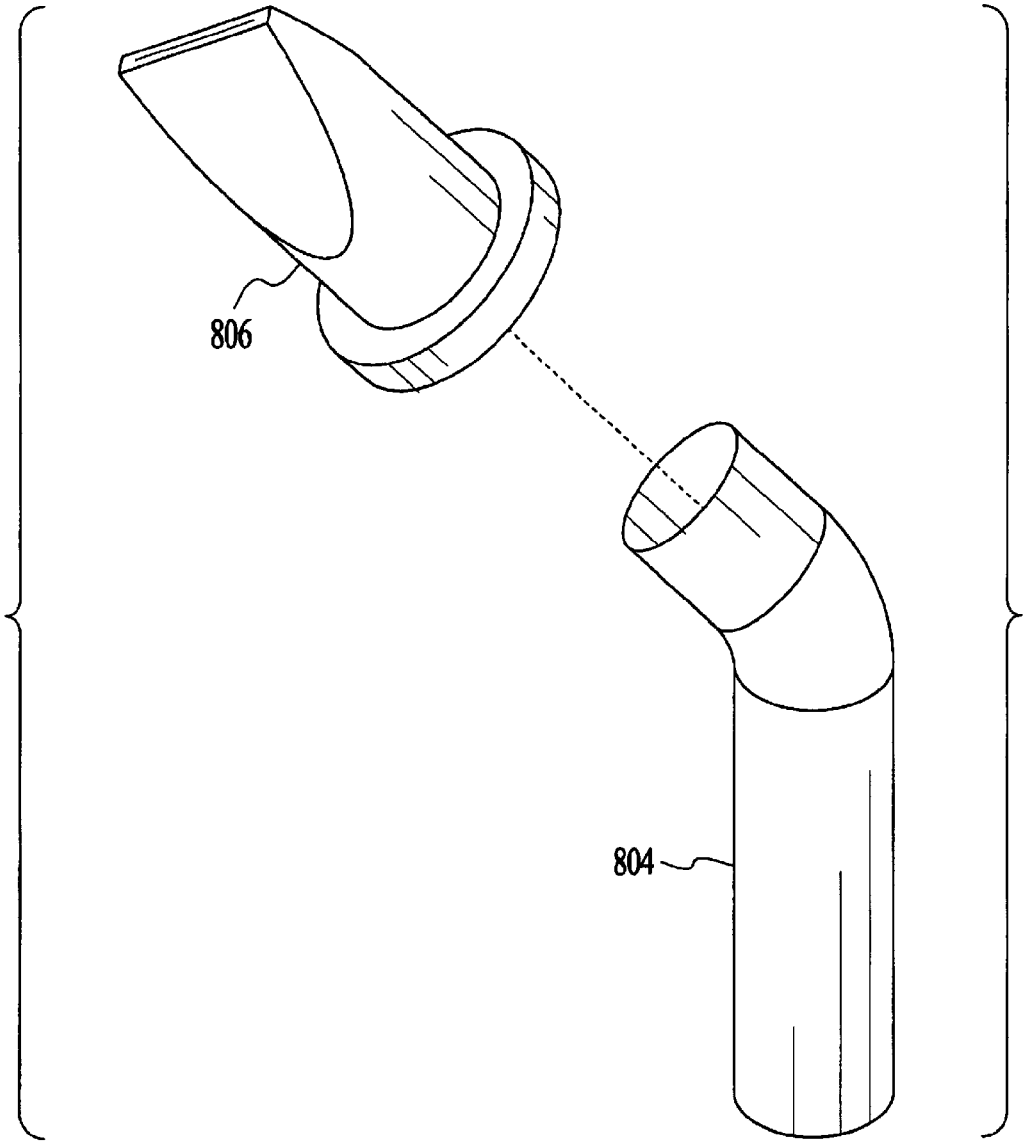
FIG. 8H is a representative detail view of a preferred embodiment of a dip tube 804 and duck bill valve 840 of a valve sub-assembly 800 of a cleaning system 100 of the present invention.

FIG. 8A is a representative exploded view of a preferred embodiment of a cleaning fluid reservoir 500 and valve sub-assembly 800 with flexible fluid delivery tubing 504 and nozzle assembly 700 of a cleaning system 100 of the present invention. FIG. 8B is a representative section view of a preferred embodiment of a cleaning fluid reservoir 500 and valve sub-assembly 800 with flexible fluid delivery tubing 504. FIG. 8C is a representative upper isometric view of a preferred embodiment of a valve cap portion 860 of a valve sub-assembly 800 of a cleaning system 100 of the present invention. FIG. 8D is a representative lower isometric view of a preferred embodiment of a valve cap portion 860 of a valve sub-assembly 800 of a cleaning system 100 of the present invention. FIG. 8E is a representative isometric view of a preferred embodiment of a flex dome portion 830 of a valve sub-assembly 800 of a cleaning system 100 of the present invention. FIG. 8F is a representative isometric view of a preferred embodiment of a valve post 810 of a valve sub-assembly 800 of a cleaning system 100 of the present invention. FIG. 8G is a representative section view of a preferred embodiment of a valve post 810 of a valve sub-assembly 800 of a cleaning system 100 of the present invention. FIG. 8H is a representative detail view of a preferred embodiment of a dip tube 804 and duck bill valve 840 of a valve sub-assembly 800 of a cleaning system 100 of the present invention.

The valve sub-assembly 800 essentially comprises, in a preferred embodiment, a retaining cap portion 802 which fits over the neck 580 of a fluid reservoir Ascending, when in operating position, from the retaining cap portion 802 there is an elongated dip tube 804 with a duck-bill type flow restrictor or valve 806 at the distal end of the dip tube 804.

The outer peripheral edge 822 of the valve cap portion 860 is seated onto an inner flange 824 of the retaining cap portion 802. The valve post 810 is disposed within the central opening 826 through the valve cap portion 860, and the flex dome portion 830 is mounted opposite the valve cap portion 860 with the valve post 810 extending through the assembly 800. In the normally closed position, as shown in FIG. 8C, a first sealing portion 812 of the valve post 810 mates with the upper lip 828 of the central opening 826 and prevents flow through the opening 818 and through the exit port 808.

However, when the valve post 810 is moved upwards as shown by directional indicating arrow C, then the fluid 502 is allowed to flow through opening 818 and through exit port 808. It will be understood that the flex dome portion 830 serves to maintain the valve assembly 800 in a normally closed position, i.e., with the first sealing portion 812 seated firmly against the upper lip 828 of the central opening 826. As the flex dome 830 flexes, the valve post 810 moves axially within the central opening 826 through the valve cap portion 860.

Figure 8I:
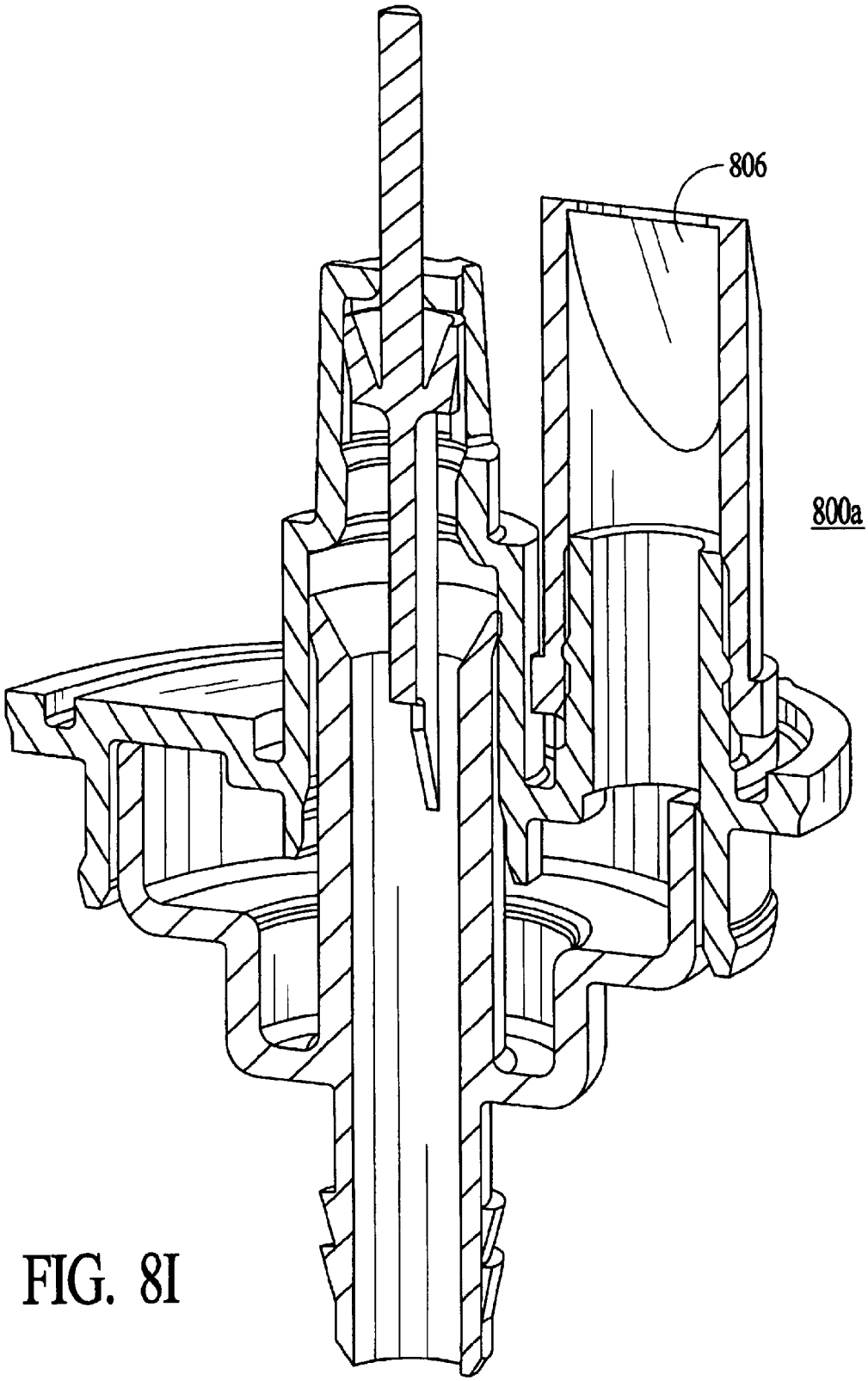
FIG. 8I is a representative isometric view of another preferred embodiment of a valve sub-assembly 800*a* of a cleaning system 100 of the present invention.
Figure 8J:
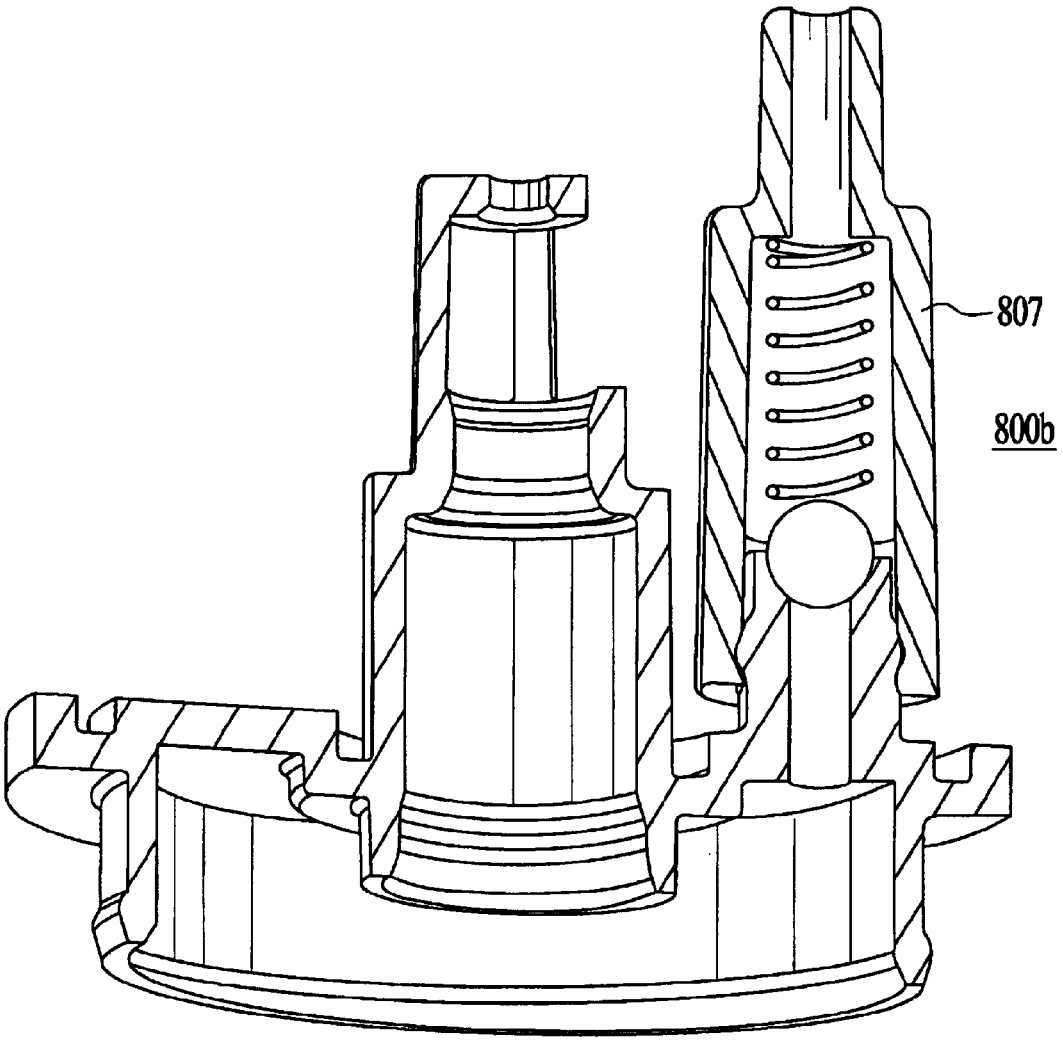
FIG. 8J is a representative isometric section view of another preferred embodiment of a valve sub-assembly 800*a* of a cleaning system 100 of the present invention.

Thus, it will be apparent from the foregoing and the following that as cleaning fluid 502 flows out of the fluid reservoir 500, in order to prevent creating a vacuum in the fluid reservoir 500 while dispensing fluid, thereby interfering with liquid flow by gravity, dip tube 804 which is seated into the side opening 840 allows air to enter the fluid reservoir 500. Air vent opening 842 in flex dome portion 830 provides open communication with the atmosphere through dip tube 804. The duck bill valve 806 or other fluid restrictor means prevents flow of cleaning fluid 502 into the dip tube 804 while at the same time permitting flow of air into the fluid reservoir 500 to replace the volume of cleaning solution or fluid 502 utilized. Thus it will be understood that the system 100 described herein operates by gravity flow of the cleaning fluid through the valve post 810 based upon a pressure head created by remaining fluid in the fluid reservoir 500. FIG. 8I is a representative isometric section view of another preferred embodiment of a valve sub-assembly 800*a* of a cleaning system 100 of the present invention. FIG. 8J is a representative isometric section view of yet another preferred embodiment of a valve sub-assembly 800*b* of a cleaning system 100 of the present invention. It will be understood that the valve assembly 800*a* includes the duck bill valve portion 806 without the dip tube portion 804 of the prior embodiments. In yet another preferred embodiment, the valve assembly 800*b* comprises a ball and spring-type check valve 807. It will be understood that other means for venting the fluid reservoir 500 will also be included within the scope of the present invention.

In either case, the duck bill valve 806 or the ball and spring-type check valve 807 or other, as fluid flow trickles out of the system, the volume of the remaining fluid within the fixed-volume reservoir becomes smaller. In order to ventilate the reservoir 500 as the system is in operation, i.e., to maintain essentially atmospheric pressure therewithin as the cleaning fluid 502 flows out of the reservoir 500, once a slightly negative pressure is achieved which is sufficient to overcome the closing force of the valve subassembly 800 or 800*a* or 800*b*, flow of air from the atmosphere flows in a single direction into the reservoir 500, thereby maintaining essentially atmospheric pressure within the reservoir 500 at all times. This system will also provide a uniform flow of cleaning fluid 502 out of the reservoir 500.

Figure 9A:
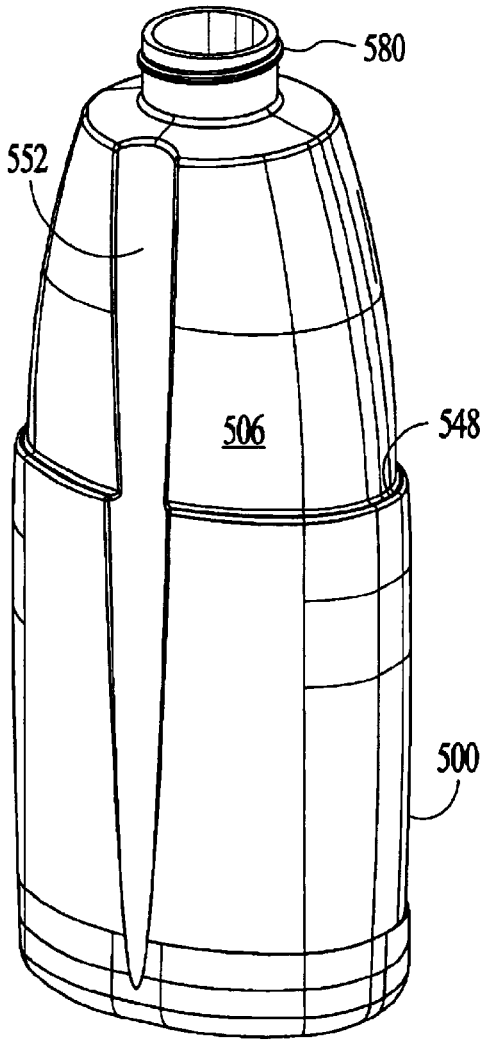
FIG. 9A is a representative upper side view of a preferred embodiment of a cleaning fluid reservoir 500 of a cleaning system 100 of the present invention.
Figure 9B:
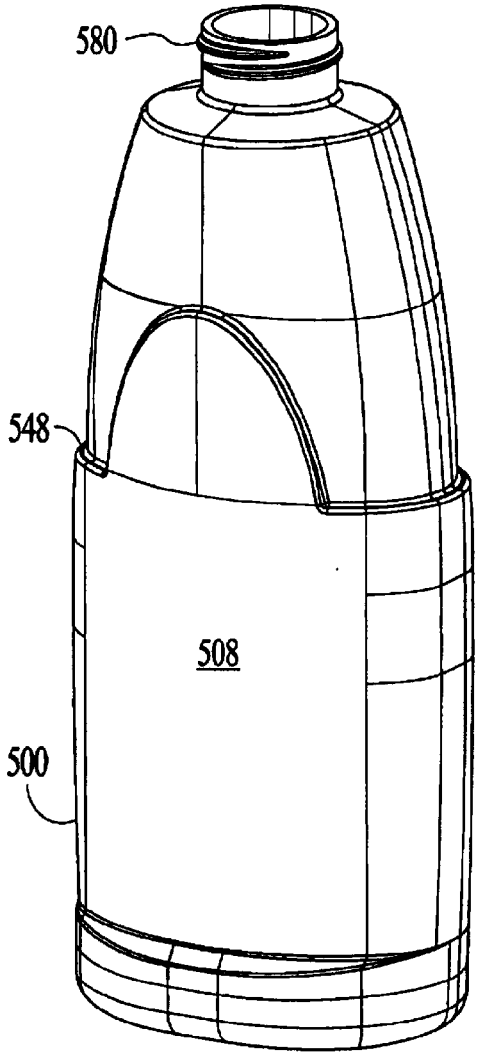
FIG. 9B is a representative lower side view of a preferred embodiment of a cleaning fluid reservoir 500 of a cleaning system 100 of the present invention.

FIG. 9A is a representative upper side view of a preferred embodiment of a cleaning fluid reservoir 500 of a cleaning system 100 of the present invention. FIG. 9B is a representative lower side view of a preferred embodiment of a cleaning fluid reservoir 500 of a cleaning system 100 of the present invention.

It will be understood that the fluid reservoir 500 will contain any desired cleaning fluid or solution 502, including water, etc. In the event that the fluid reservoir 500 is not used with the system 100, in the example of spare or inventories of cleaning fluid reservoirs 500, the reservoirs 500 can be closed using a standard or custom closure cap.

It will be understood by those skilled in the art, based upon the foregoing and upon the following, that the liquid cleaner 502 in the fluid reservoir 500 is essentially water, optionally with low levels of active and/or inactive ingredients. Such cleaning fluid system 502 will be comprised of surfactants and/or solvents, perhaps combined with a water soluble polymer, such as polyacrylate, which actually acts like a clear floor wax. Other cleaning enhancers, floor polishes, anti-streaking agents, fragrances, etc. may be useful in such system 502.

In a preferred embodiment, the cleaning solution provides a no-rinse, single layer, one-step method for cleaning and polishing surfaces including walls, floors, ceilings, leaving a streak-free, non-tacky, clean surface non-attractive to dirt, soils, debris, etc. The device of the present invention ca be used with a single, apply and wipe off solution that cleans without the need to rinse, and which leaves a shine and is not tacky or sticky. In a preferred embodiment, the cleaning fluid 502 comprises a sanitization fluid which serves to sanitize the surface being cleaned, coated or otherwise covered. In preferred embodiments, the cleaning fluid 502 comprises de-odorizing and/or odorizing components.

The advanced cleaning system of the present invention 100 will be particularly suited for cleaning, polishing, or applying a cleaning, shining or other fluid to wood, tile, marble, vinyl, floor covering, hard surfaces, asphalt tile, glass terrazzo, slate, rock, metallic, polymeric, composite or other surfaces.

In a preferred embodiment, the valve sub-assembly 800 of a cleaning system 100 of the present invention is designed such that air does not flow through dip tube 804 and across restrictor valve 806 into fluid reservoir 500 until a certain predetermined volume of liquid has been withdrawn from the reservoir. As the cleaning fluid 502 flows through the system and out the nozzle assembly 700, a slight vacuum develops within the empty space above the remaining liquid 502 in the reservoir 500, before air enters the system to fill the vacuum. The valve subassembly 800 becomes a flow control valve for the cleaning fluid 502 by controlling the air flow into the reservoir 500 and/or the cleaning fluid 502 flow out of the reservoir 500. This method of controlling the flow of cleaning fluid through the system 100 will include other means for controlling the flow, including other control valves, manual, battery or electrically driven or actuated pumps, aerosol mechanism, etc., and will be included within the scope of this invention.

In a preferred embodiment, the reservoir means 500 is keyed, as shown, to fit into the holster assembly 600 in a particular way. This permits orientation of the valve assembly 800 in the holster assembly 600 as desired. The key means can also comprise a locking mechanism to retain the reservoir 500 within the holster portion 600. This locking mechanism can be part of the reservoir 500, such as a clamp, clip, groove or slot with mating portion on the handle portion 400 somewhere, or the locking means can be mounted to or otherwise part of the handle portion 400, such as a clamp, spring-loaded clip, or equivalent secured to shaft section 410 or elsewhere on the system. Based on the foregoing, any combination of locking means and/or keying means for the reservoir 500 to the system 100 is included within the scope of the present invention.

Figure 11:
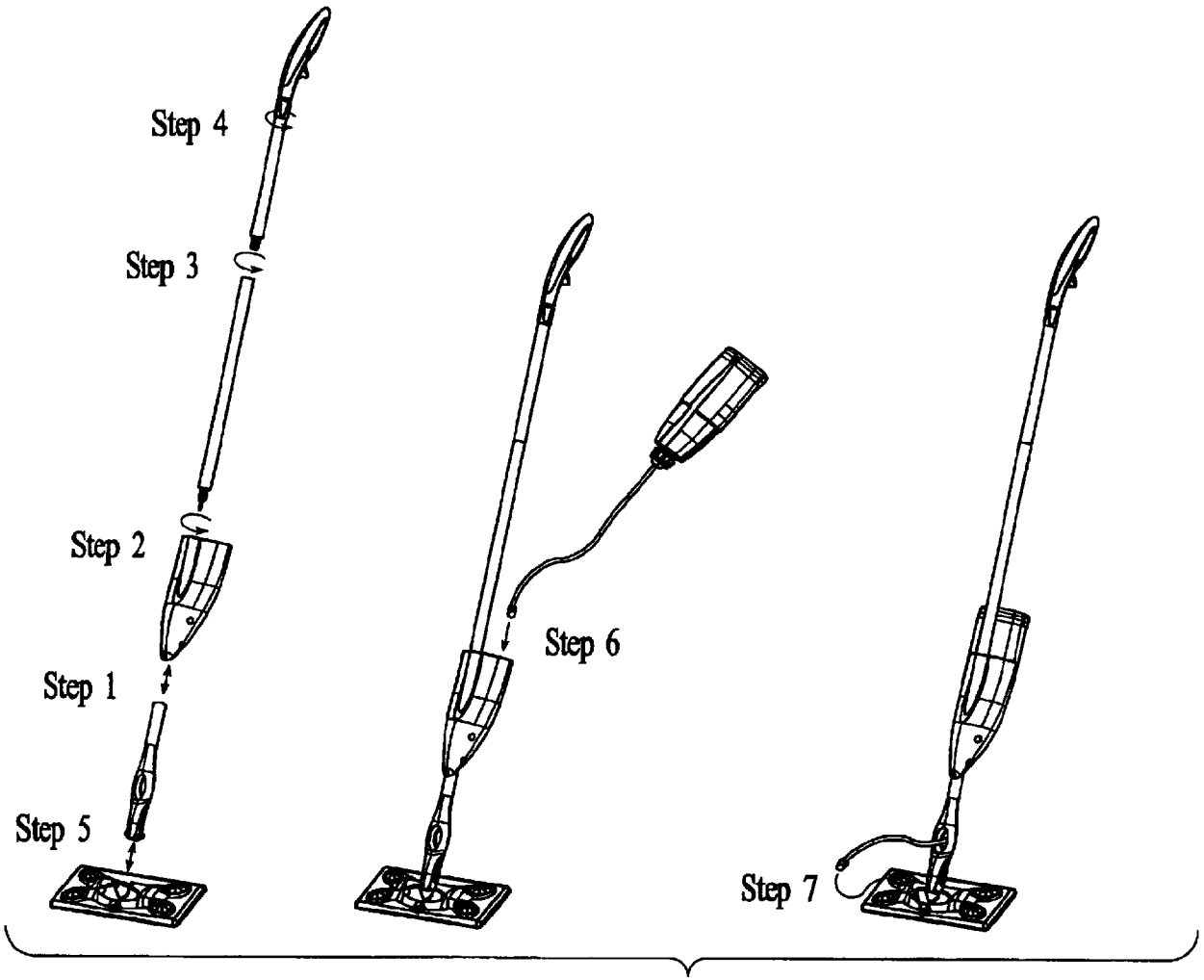
FIG. 11 is a representative schematic view of a preferred embodiment of a method of assembly of a cleaning system 100 of the present invention.

As best shown in FIGS. 1, 6B, 6C, 8A and 9A, the removable coupling means, a system for conveniently coupling and detaching the reservoir, comprises a shaped holster portion with a keyed locking means adapted to receive and lock into place a cleaning fluid reservoir with a correspondingly-shaped mating portion thereon. As shown in FIGS. 1 and 11, the reservoir portion 500 seats inside the cradle or holster 600. The removable reservoir 500 has an upper portion 506 having a slightly smaller geometry than its lower portion 508, such that the reservoir location is positioned by stepped portion 548 within the cradle portion 600. The outer edge 554 of the cradle portion 600 firmly seats the reservoir means 500. An external groove 550 located on a peripheral portion of the cradle portion 600 with a correspondingly-shaped mating portion 552 on the reservoir 500 accommodates the elongated shaft section 400*a* or handle 400 at an angle as shown.

In a preferred embodiment, the reservoir 500 has 2 or more compartments, these can be used for containing various chemicals, compounds, cleaners, shining agents, water, etc. If there are 2 chambers, and there is a mixing or common sprayer head, then 2 different liquids can be dispensed, for example, an oxidant bleach in one, a chelating agent in the other (see U.S. Pat. No. 5,767,055 issued Jun. 16, 1998 to Choy, incorporated herein by reference, in its entirety). These can be individually or commonly actuated, with selection means adapted to the specific type of reservoir or multiple-reservoir system used. Multi-chamber reservoirs will also be included within the scope of the present invention.

Figure 10A:
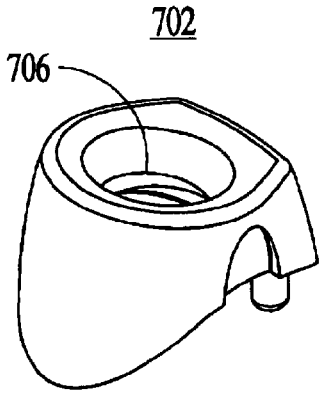
FIG. 10A is a representative upper isometric view of a preferred embodiment of a top portion 702 of a nozzle sub-assembly 700 of a cleaning system 100 of the present invention.
Figure 10B:
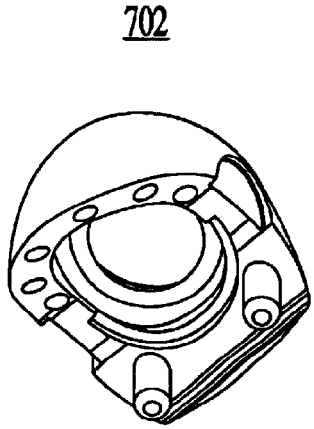
FIG. 10B is a representative lower isometric view of a preferred embodiment of a top portion 702 of a nozzle sub-assembly 700 of a cleaning system 100 of the present invention.
Figure 10C:
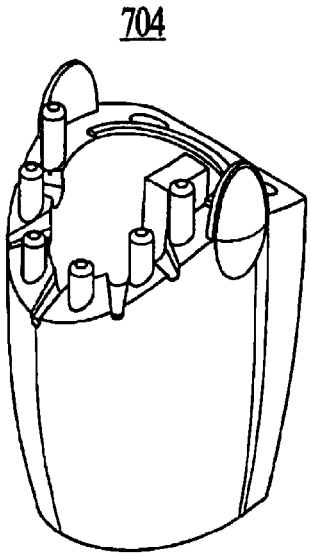
FIG. 10C is a representative upper isometric view of a preferred embodiment of a lower portion 704 of a nozzle sub-assembly 700 of a cleaning system 100 of the present invention.
Figure 10D:
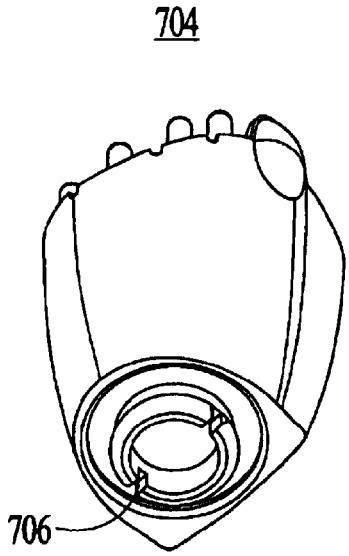
FIG. 10D is a representative lower isometric view of a preferred embodiment of a lower portion 704 of a nozzle sub-assembly 700 of a cleaning system 100 of the present invention.
Figure 10E:
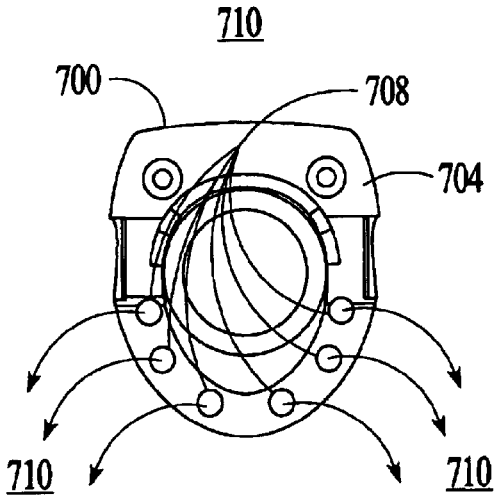
FIG. 10E is a representative top view of a preferred embodiment of a flow pattern 710 of cleaning fluid 502 flowing through the nozzle sub-assembly 700 of a cleaning system 100 of the present invention.
Figure 10F:
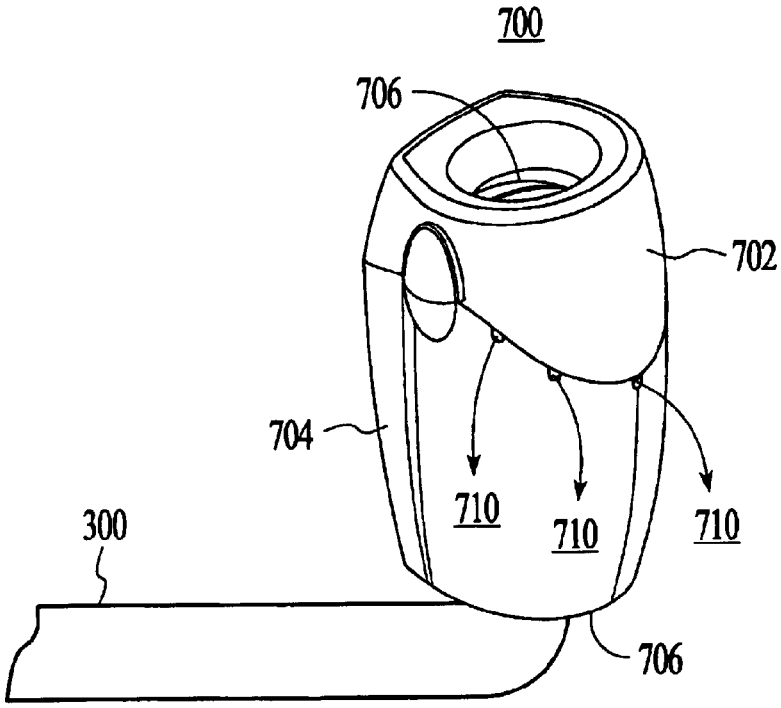
FIG. 10F is a representative perspective view of a preferred embodiment of a flow pattern 710 of cleaning fluid 502 flowing through the nozzle sub-assembly 700 of a cleaning system 100 of the present invention.

FIG. 10A is a representative upper isometric view of a preferred embodiment of a top portion 702 of a nozzle sub-assembly 700 of a cleaning system 100 of the present invention. FIG. 10B is a representative lower isometric view of a preferred embodiment of a top portion 702 of a nozzle sub-assembly 700 of a cleaning system 100 of the present invention. FIG. 10C is a representative upper isometric view of a preferred embodiment of a lower portion 704 of a nozzle sub-assembly 700 of a cleaning system 100 of the present invention. FIG. 10D is a representative lower isometric view of a preferred embodiment of a lower portion 704 of a nozzle sub-assembly 700 of a cleaning system 100 of the present invention.

In a preferred embodiment, ergonomic or high-friction finger grip portions 707 of lower nozzle portion 704 enhance ease of use. It will be understood that these may be material such as rubber or other suitable polymer or other material stubs, appliques or laminates. They could also comprise deformations or protrusions or other formed, shaped or integrated means, as shown.

The snap means 706 or other means for mounting the nozzle 300 to the head assembly 300 can be replaced with any equivalent, including o-ring mounts, snap mounts, screw in, threaded or bayonet mounted, with or without spring-loaded mechanism, as may be most desirable for enhancing utility. A break-away or pop-off, snap-on nozzle assembly 700 will prevent damage to the nozzle assembly 700, the head assembly 300, or to furniture, drapery, etc. Such will also be useful for storage of the system 100.

As described above, manual activation of the finger trigger 402 causes pull rod 440 to be axially moved distally, the linkages between the proximal shaft section 564 and the mid section 400*a* and between the mid section 400*a* and the tubular shaft section 492 of the causing the pull rod 440 to bear distally upon slide 460. As slide 460 is moved distally disposed within the opening 462 of tubular shaft section 492, lever 478 is pivoted so as to bear upwardly against the flex dome portion 830 of the valve sub-assembly 800. As the valve post 810 is un-seated, fluid flows downwardly, by force of gravity, from reservoir 500, through valve post 810, central opening 826 of valve cap 860, flexible delivery tubing 504, and nozzle assembly 700.

It will be understood that in another preferred embodiment, the flex dome portion 830 can be replaced with a spring loaded or other biased, pumping means.

In a preferred embodiment, the seals of the valve post 810 can be enhanced, such as through the use of o-rings, flat seals, cone seals, quad surface and quad ring seals, gland seals, etc.

As described above, the present system is a gravity-fed system, although manually pumped and aerosol or other pressurized delivery systems are included within the scope of the present invention and are claimed herein. As cleaning fluid flows through delivery tube 504, it will emerge from the nozzle assembly 700 as a trickle, cascade, dribble, drip, drizzle, drop, dispersion, seep, spray, stream, sprinkle or other emission having any predetermined or random flow pattern 710. The flow pattern 710 may also be varying or modulating. Either one or both of the upper portion 702 and the lower portion 704 of the nozzle assembly 700 has a means 706 for coupling the assembly 700 together, i.e., for coupling a first portion 702 and a second portion 704, as well as for coupling a nozzle assembly 700 to the head sub-assembly 300, including a snap, groove, bayonet mount, mating, helically threaded grooves, hook and loop material (Velcro®) or other attachment mechanism or means. The nozzle 700 could also, in a preferred embodiment, be formed integrally within the head assembly 300, such as comprising one or more unitary molded portions, such that a delivery tube 504 plugs into or otherwise ports directly thereinto.

In a preferred embodiment, the nozzle 700 minimizes vapors, misting, fogging and/or other phase change loss of the cleaning solution during dispensing the fluid 502.

Flow through the orifices 708 of the lower portion 704 or any other portion or portions of the nozzle assembly 700 results in a flow pattern 710 as shown in FIGS. 10E–10F. In a preferred embodiment, the orifices 708 are about 0.5 millimeters in diameter, or more or less, and are directed directly outward, forward, downward, at an angle, to the front, back, side or other, etc.

In a preferred embodiment, the nozzle assembly 700 results in a 5-stream trickle pattern with the following specifications:

| Stream | Azimuth Angle | Elevation Angle |
|---|---|---|
| Single | 0° | −27° |
| Pair | +/−43° | −19° |
| Pair | +/−71.6° | −15° |

Based on the foregoing, it will be understood that within the scope of the present invention, the direction of the flow of cleaning fluid 502 as it emerges from an orifice 708 on the nozzle assembly 700 can vary from an angle between about parallel to the floor, or other surface to be cleaned, to about 30 degrees above parallel, to about 30 degrees below the parallel. In terms of flow pattern of the cleaning fluid 502, the flow can be directed upward, to form an arching trickle or stream, or it can be directed parallel to the surface, or it can be directed somewhat toward the surface to be cleaned.

In a preferred embodiment, the flow of cleaning fluid 502 through the nozzle assembly 700 is optimized to provide an even, uniform distribution, trickle pattern of cleaning fluid 502 in front of the cleaning head assembly 300. The optimum cleaning fluid pattern is a circular area in front of and to the sides in front of the head portion 300. In another preferred trickle distribution pattern, the cleaning fluid 502 is dispensed evenly, in a straight line, essentially in front of the cleaning head portion 300. Flow of cleaning fluid 502 is adequate through all of the orifices 708, rather than being insufficient at the sides. This embodiment is an improvement over systems in which trickle of fluid at the side portions might be slightly less or event totally insufficient, whereas the flow in the center of the nozzle is adequate, due to greater pressure drop through the outside orifices.

FIG. 10E is a representative top view of a preferred embodiment of a flow pattern 710 of cleaning fluid 502 flowing through the nozzle sub-assembly 700 of a cleaning system 100 of the present invention. FIG. 10F is a representative perspective view of a preferred embodiment of a flow pattern 710 of cleaning fluid 502 flowing through the nozzle sub-assembly 700 of a cleaning system 100 of the present invention.

As viewed from above, as shown in FIG. 10E, the flow pattern 710 is outwardly diverging. As viewed from the side in a cross section view, the flow pattern 710 is semi-cone shaped. It will be understood that while fluid may emerge at an angle directed toward or away from or perpendicular to the surface to be cleaned 712, i.e., the floor, the system 100 described herein is primarily a gravity-fed system. In other words, fluid emanating from the nozzle assembly will have an initial direction of flow which may or may not include vertical components, i.e., the fluid directed downward perpendicular to the plane of the floor 712, and would also have some horizontal components, i.e., directed either directly outwardly perpendicular to the surface to be cleaned 712 or directed somewhat toward the surface 712. Furthermore, as a result of the force of gravity acting upon that fluid flow, the flow will develop vertical directional components therein.

Another unique aspect of the present invention is the virtually endless possibility of variations in flow pattern achievable using a nozzle assembly 700 such as shown and described herein. Any known or new and unique variation in nozzle design, including unitary design formed by molding, casting, turning or milling, or any other material additional or removal process, or any multi-section design formed by any of the preceding. Fluid can flow through one or more orifices 708 directed at any angle or angles toward the floor or other surface to be cleaned 712, or at any angle or angles directly perpendicular to the surface 712, or at any angle or angles between 0 and 90 degrees from directly up and away from the floor, although for a floor cleaning system, the latter type would potentially be of less utility.

FIG. 11 is a representative schematic view of a preferred embodiment of a method of assembly of a cleaning system 100 of the present invention. From the foregoing and the following, it will be understood that the cleaning system 100 of the present invention includes and claims to be a fully assembled system and method of use, as well as a system which can be assembled, disassembled, is telescoping or collapsible, or otherwise portable and/or compressible in overall largest dimension.

The present cleaning system 100 invention includes, as described herein, one or more proximal handle assemblies 500, one or more shaft sections 410 of a handle sub-assembly 400, a holster sub-assembly 470 or other similar functional means, a yoke section 450 or similar functional means, a head sub-assembly 300 or similar functional means, and a cleaning fluid reservoir 500 or similar functional means having a fluid delivery tube 504 or similar functional means and a nozzle assembly 700 which mounts onto the head assembly 300 or similar functional means.

In a preferred embodiment, a kit 100 for wet and/or dry cleaning includes one or more proximal handle assemblies 500, one or more shaft sections 410 of a handle sub-assembly 400, a holster sub-assembly 470 or other similar functional means, a yoke section 450 or similar functional means, a head sub-assembly 300 or similar functional means, and a cleaning fluid reservoir 500 or similar functional means having a fluid delivery tube 504 or similar functional means and a nozzle assembly 700 which mounts onto the head assembly 300 or similar functional means.

In a preferred embodiment, the system comprises a re-usable handle sub-assembly 400, one or more replaceable cleaning pads 200. Additionally, the handle sub-assembly 400 includes the holster sub-assembly 600. The fluid reservoir 500 can be provided to the user sealed or temporarily closed. Additionally, the nozzle assembly 700, fluid delivery tube 504 and/or valve assembly 800 can be replaceable or non-replaceable, and can be provided with every reservoir 500 cleaning fluid 502 refill, or separately or otherwise.

The method for assembling the kit 100 or cleaning system 100 of the present invention includes the following steps, not intended to be exhaustive, necessary, or all-inclusive and without any other imitations presumed thereby:

- coupling temporarily or permanently one or more shaft sections 410 together;
- coupling temporarily or permanently one or more holster assemblies 600 to the system 100;
- coupling temporarily or permanently one or more yoke sections 450 to the system 100;
- coupling temporarily or permanently one or more head assemblies 300 to the system 100;
- coupling temporarily or permanently one or more proximal handle assemblies 500 to the system 100;
- installing temporarily or permanently one or more fluid reservoirs 500, each having its own associated one or more fluid delivery tubes 504 and one or more nozzle assemblies 700, into the one or more holster assemblies 600;
- mounting temporarily or permanently one or more of the nozzle assemblies 700 of the one or more fluid reservoirs 500 onto the one or more of the head assemblies 300;
- securing temporarily or permanently one or more cleaning pads 200 or cleaning cloths 200 to the one or more head assemblies 300 with the cleaning pad retaining means 308;
- placing the cleaning pad 200 or cleaning cloth 200 onto the surface to be cleaned 712 and moving it back and forth one or more times over a portion of the surface to be cleaned 712;
- dispensing an initial volume of cleaning fluid 502 onto the surface to be cleaned 712 and cleaning the surface to be cleaned 712 therewith;
- dispensing additional volumes of cleaning fluid 502 onto the surface to be cleaned 712 and repeat cleaning the surface to be cleaned 712;
- absorbing dust, dirt, debris, spilled fluids or dispensed cleaning fluid 502 onto the cleaning pad 200 or cloth 200;
- replacing temporarily or permanently one or more cleaning pads 200 or cleaning cloths 200 on the one or more head assemblies 300 with the cleaning pad retaining means 308;
- replacing temporarily or permanently one or more fluid reservoirs 500 into the one or more holster assemblies 600; and
- disassembling the wet cleaning kit 100 or cleaning system 100 for transportation, storage, or as desired.

Improved Nozzle Design

Figure 12A:
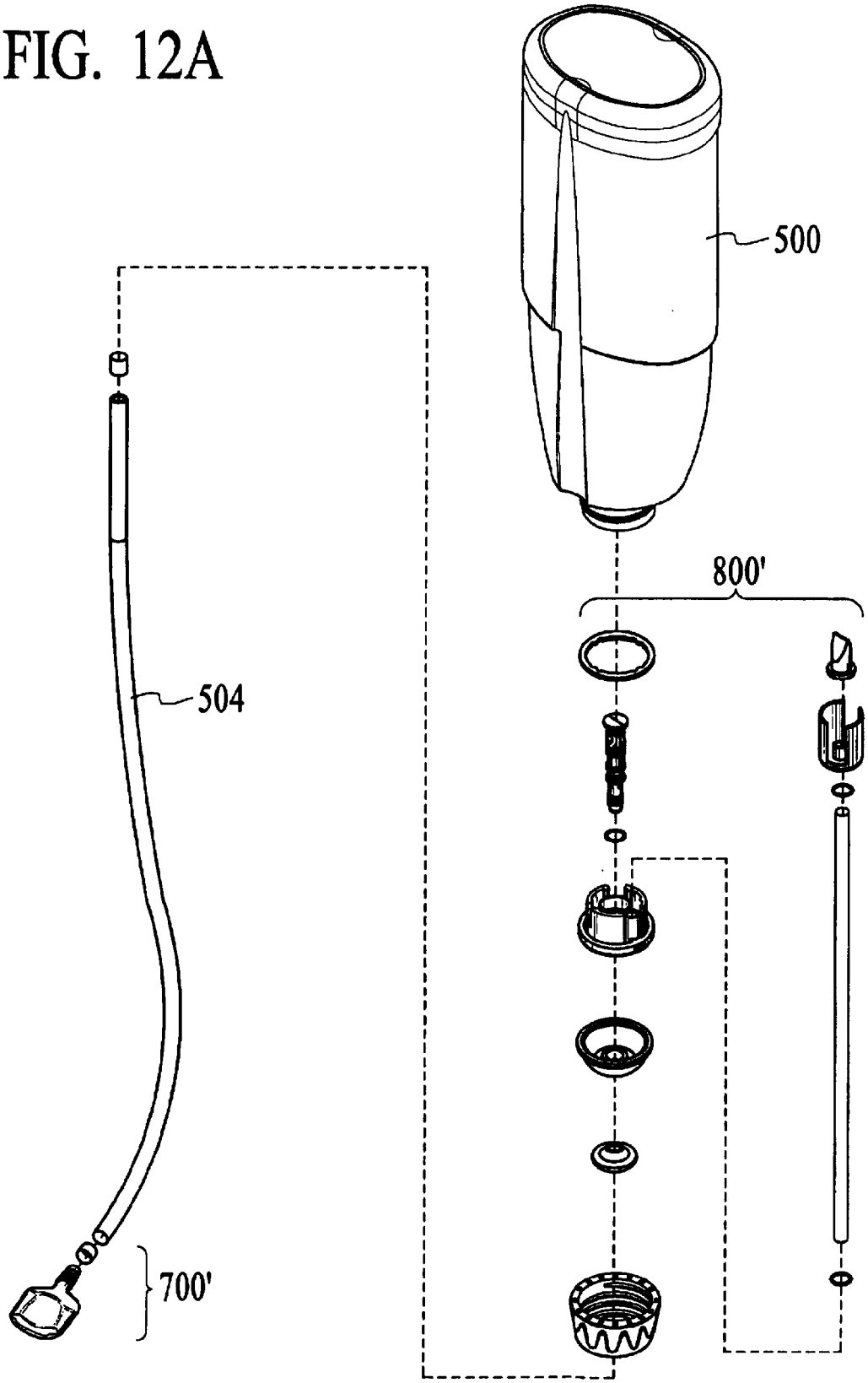
FIG. 12A is a representative exploded view of another preferred embodiment of a cleaning fluid reservoir 500 and valve sub-assembly 800' with flexible fluid delivery tubing 504 and nozzle assembly 700' of a cleaning system 100' of the present invention.
Figure 12B:
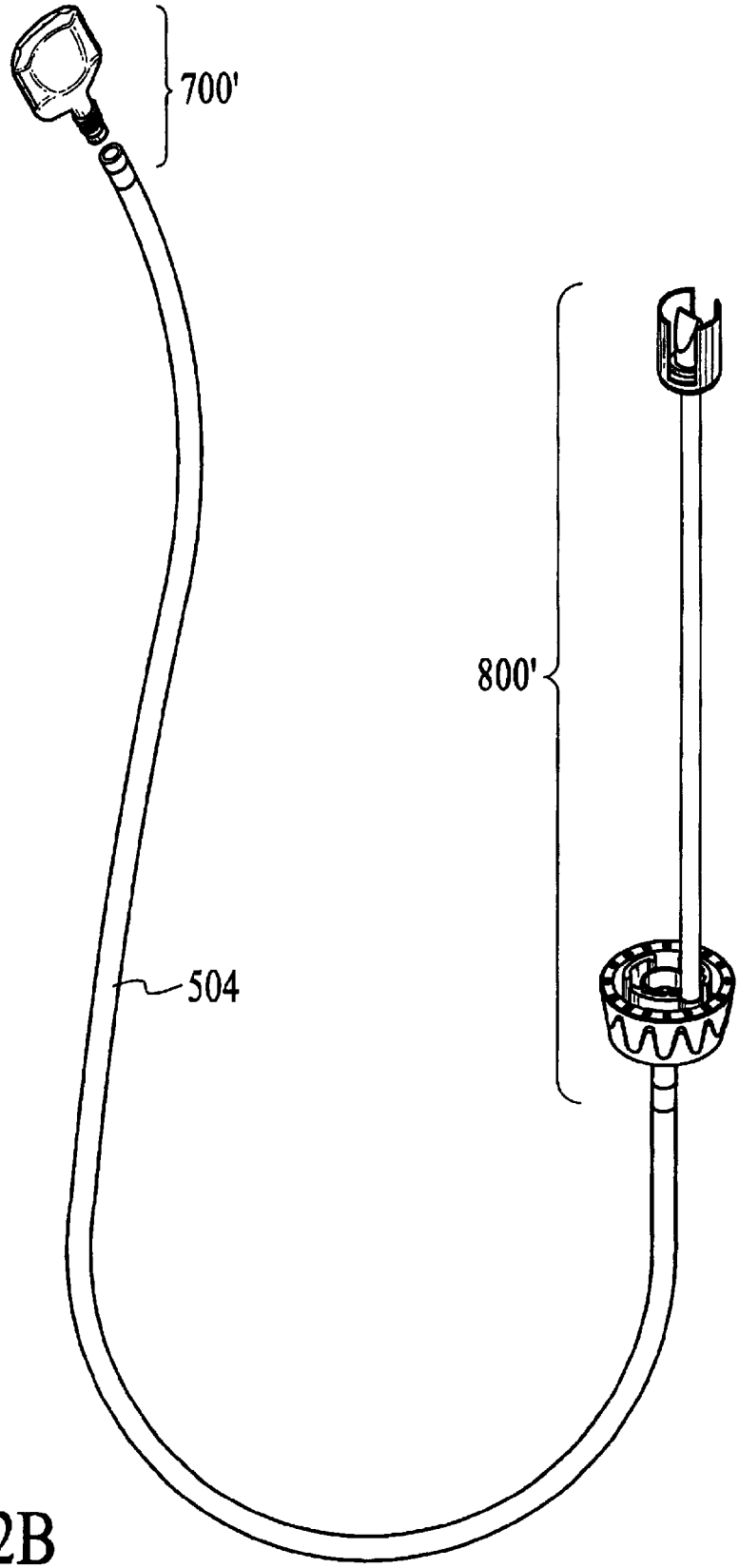
FIG. 12B is a representative assembled view of the valve sub-assembly 800' and nozzle assembly 700' shown in FIG. 12A.
Figure 12C:
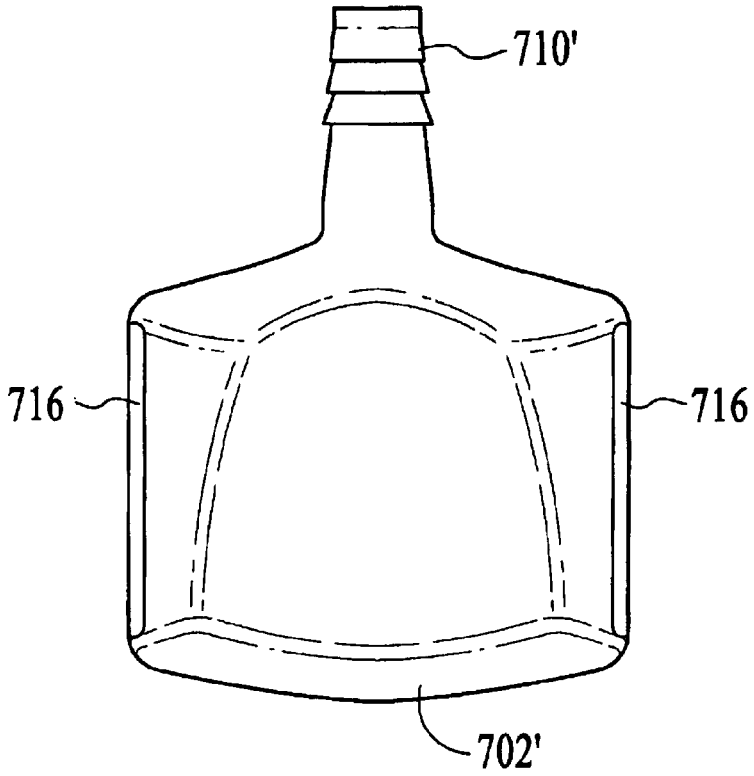
Figure 12D:
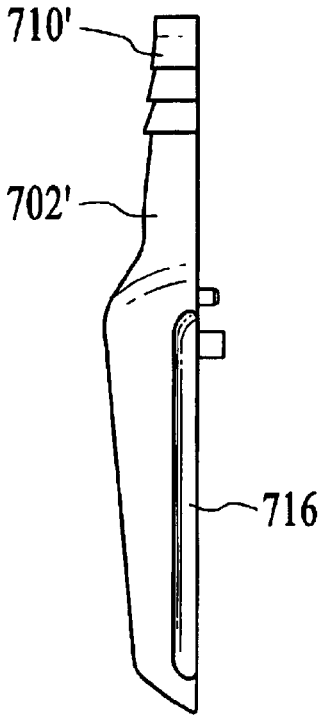

FIG. 12A is a representative exploded view of another preferred embodiment of a cleaning fluid reservoir 500 and valve sub-assembly 800' with flexible fluid delivery tubing 504 and nozzle assembly 700' of a cleaning system 100' of the present invention. FIG. 12B is a representative assembled view of the valve sub-assembly 800' and nozzle assembly 700' shown in FIG. 12A.

FIGS. 12C–12G are representative detail views of portions of the nozzle assembly 700' shown in FIGS. 12A and 12B. The nozzle assembly 700' essentially comprises an upper nozzle portion 702', a lower nozzle portion 704', a connecting means 706' and a plurality of orifices 708'. Optional hose barbs 710' or similar structure or means serves to better secure the nozzle assembly 700' to the flexible tubing portion 504. When coupled together, the 2 halves of the nozzle 700' form a fluid inlet 712' and an internal fluid chamber 714'.

The nozzle orifices 708' are not symmetrical, and they have no geometric centerline as such. This is an intentional design feature. Computational fluid dynamics were utilized to simulate the projected angle of the flow. Also, surface tension effects at the nozzle 700' and air interface 720' deflect the stream, downward towards the floor, and outward towards the side of the mop, as the pressure drops. The actual centerline of the flow is below horizontal as designed. Nominal centerlines can approximate the average position of the streams.

It will be understood that there are 2 preferred embodiments of the present invention. In FIG. 12F, the front portion 721' of the upper portion of the nozzle 700' slopes gently to the leading edge air interface 720'. The front portion 722' is essentially vertical. The x-y axis is shown superimposed centered at the leading edge air interface 720' for comparison. At the leading edge 720', it will be understood that the top portion of the fluid nozzle 700' slightly overhangs the lower portion, such that the leading edge 720' is a sharp, defined edge. Furthermore, in the embodiment shown in FIG. 12G, the front portion 723' of the lower portion of the nozzle 700' is cut back, providing an angle less than 90 degrees. In this manner, both the embodiments of FIGS. 12F and 12G will provide a sharp lip, overbite or overhanging leading edge 720'. This is important in the gravitational fed system of the present invention. Though slight, surface tension and other similar cohesive forces will act upon the cleaning or other fluid 502 as it leaves the orifices 708'. In a pumped or force-fed fluid distribution system such as in the prior art, or where the fluid is forced out using other than the force of gravity, this slight cohesive, surface-tension effect is unimportant. However, in the present design, the elimination of these forces by providing the sharp lip leading edge air interface 720' will enhance the operation, provide less overall pressure drop of the fluid 502 as it travels through the fluid path, resulting in greater laminar qualities, farther spreading or greater distribution of fluid 502, and greater volume of distributed fluid 502 than heretofore possible.

Although the present invention is not so limited, one preferred flow of fluid from a nozzle assembly 700' is laminar, as distinguished from turbulent. Laminar flow is sometimes characterized in terms of a Reynolds number. The Reynolds number, Re, is a dimensionless quantity which is the ratio of inertial forces to viscous forces. The number is defined as:

$$Re = \frac{\rho d v}{\mu}$$

where ρ is the density, d is a linear dimension, v is the velocity and $\mu$ is the viscosity. The numerator in the above equation denotes inertial forces while the denominator denotes viscous forces. For circular tubes the flow is laminar when $Re=D<v_z>r/m$ (where D is the diameter) is less than about $2.1\times10^3$, although a stable sinuous motion sets in at a Reynolds number of about 1225. Above $2.1\times10^3$ laminar motion may be maintained temporarily if the tubes are very smooth and free from vibrations, but if the system is disturbed or if there is any appreciable surface roughness the laminar motion will give way to the random motion that characterizes turbulent flow.

Laminar flow occurs when the streamlines (fluid flow lines) are orderly and parallel to the direction of fluid flow, while turbulent flow is chaotic and is not characterized by orderly streamlines.

The velocity, $\bar{v}_z$ of any streamline in laminar flow is $$v_z = v_{z\max}\left(1-\left(\frac{r}{R}\right)^2\right),$$

where r is the radius and r is any radial distance from the center of the pipe to the circumference. $\bar{V}_{zmax}$ occurs at the center of the pipe when r=0. The average velocity, $v_z$ of any streamline in turbulent or plug flow is approximately $$\bar{v}_z = \bar{v}_{z,\max}1-\left(\frac{r}{R}\right)^{\frac{1}{7}}$$

where R is the radius and r is any radial distance from the center of the pipe to the circumference. $v_{z\ max}$ occurs at the center of the pipe when r=0.

In the context of laminar flow, as an example, the nozzle assembly of the present invention provides an effective liquid flow which means that the liquid will not dribble from the nozzle orifice 708' but rather will land at least about 2" in front of the nozzle. The only force causing the liquid to flow within the system is gravitational force. The nozzle is designed with the appropriate number of orifices 708' to minimize pressure loss through it and to be aligned at near horizontal or low angles above or below the horizontal to allow the liquid to eject with a velocity of ~250 cm/s or higher, as an example. An important aspect of this invention is that the liquid flow is not described as a spray but rather like a flow (e.g., water flowing from a faucet).

A conventional gravity fed system has the limitation of causing effective flow only when the system is held vertically (90° with the horizontal), with the effectiveness decreasing as the angle decreases. In the present invention, maintaining effective flow through the nozzle is a challenge because of the low pressure available. From a fluid mechanics point of view, effective flow means high velocity of the fluid. If the velocity of the liquid is low (in this case, for example, ≦~100 cm/s), the liquid will not possess the momentum to overcome the cohesive forces which cause the liquid to "cling" to the surface of the nozzle. In such a scenario, the liquid will dribble or curl when ejected from the nozzle. A role of the nozzle is to cause the least pressure drop in order to efficiently eject the liquid (i.e., with the highest velocity).

The relation between fluid velocity ejecting from the nozzle and the horizontal distance it strikes at is expressed below:

$$y = x\tan\theta - \frac{g}{2v_o^2\cos^2\theta}x^2 \tag{1}$$

where y is the vertical distance of the nozzle orifice 708' to the ground x is the horizontal distance of the nozzle orifice 708' to where the liquid strikes the ground θ is the angle at which the liquid ejects from the nozzle from the horizontal g is the acceleration due to gravity $v_o$ is the velocity at which the liquid exits the orifice 708'. In the instance when the liquid ejects horizontally or at low angles relative to the horizontal, q~0, and hence tan θ~0, cos q~1. Therefore, (1) above becomes:

$$y \approx -\frac{g}{2v_o^2}x^2 \tag{2}$$

Equation 2, rearranged becomes:

$$x \approx \sqrt{\frac{2|y|}{g}}\,v_o \tag{3}$$

Clearly, the distance at which the liquid strikes the ground and therefore dribbling, curling, etc. is related to the velocity of liquid exiting the nozzle. Other effects, such as surface tension, etc. may also affect the flow, but to a lesser extent.

The cross sectional area, a, of the nozzle orifice 708' directly affects the liquid velocity, $v_o$ as $$a = \frac{Q}{v_o} \tag{4}$$

where Q is the volumetric flow rate for the nozzle orifice 708'.

Reducing the number of orifices 708' to 4 has meant that roughly a quarter of the total volumetric rate will flow from a single orifice 708' and therefore the area would not have to be reduced to unworkable dimensions (to prevent clogging). The nozzle geometry has been chosen to allow liquid to eject with a velocity of ~160–300 cm/s, where curling/dribbling is not seen when the tool is kept at low angles and/or when the bottle is almost empty. This does not preclude the use of a larger or smaller number of orifices 708' (2–6 orifices), so long as curling/dribbling is not seen.

In a preferred embodiment, the nozzle 700' includes a recess (not shown) in the underside that allows a snap in the mophead 300' to retain the nozzle 700' to the mophead360', but allows low effort removal by the user. Attachment of the two nozzle halves can be via sonic welding, adhesive, solvent bonding or any combination thereof. Stepped parting lines can angle fluid streams downward, as an example, relative to a longitudinal centerline of the nozzle 700'. Streams can also be angled downward by mounting a nozzle 700' with streams that project horizontally at a permanent downward angle as indicated. Streams can be directed upward by inverting the internal design or by mounting a nozzle with streams that project horizontally at a permanent upward angle. Similarly, the streams can be angled obliquely to the longitudinal centerline and on either side. The nozzle orifice 708' attributes can optimize stream velocity. For example, the following characteristics of the nozzle 720 can be utilized:

- Area Taper Ratio for orifice 708' lengths 0.100" and longer: Orifice 708' area measured 0.100" upstream from exit divided by Orifice 708' exit area: 0.5:1 to 10:1
- Area Taper ratio for orifice 708' lengths 0.100" and shorter. Inlet area/exit area: 0.5:1 to 10:1
- Orifice 708' widths (e.g., 744 in FIG. 12E) can be between about 0.012" to 0.200"
- Orifice 708' heights (e.g., 746, FIG. 12H) can be between about 0.012" to 0.200"

Each orifice 708' directs and shapes the fluid flow into a single stream from a plenum 712' in the nozzle 700' to an exit opening at the terminal end of the orifice 708'. The cross sectional shape of the orifices 708' can be trapezoidal, triangular, rectangular, round, elliptical, or a combination of the foregoing, as an example. The corners of the orifices 708' may be blended with constant or variable size fillets, chamfers, cone shapes, or complex geometries defined by non-uniform rational B-splines. In addition to the stepped parting lines mentioned above, other internal features in the nozzle 700' may be used to change the exit elevation of the fluid stream downward or upward.

Figure 13:
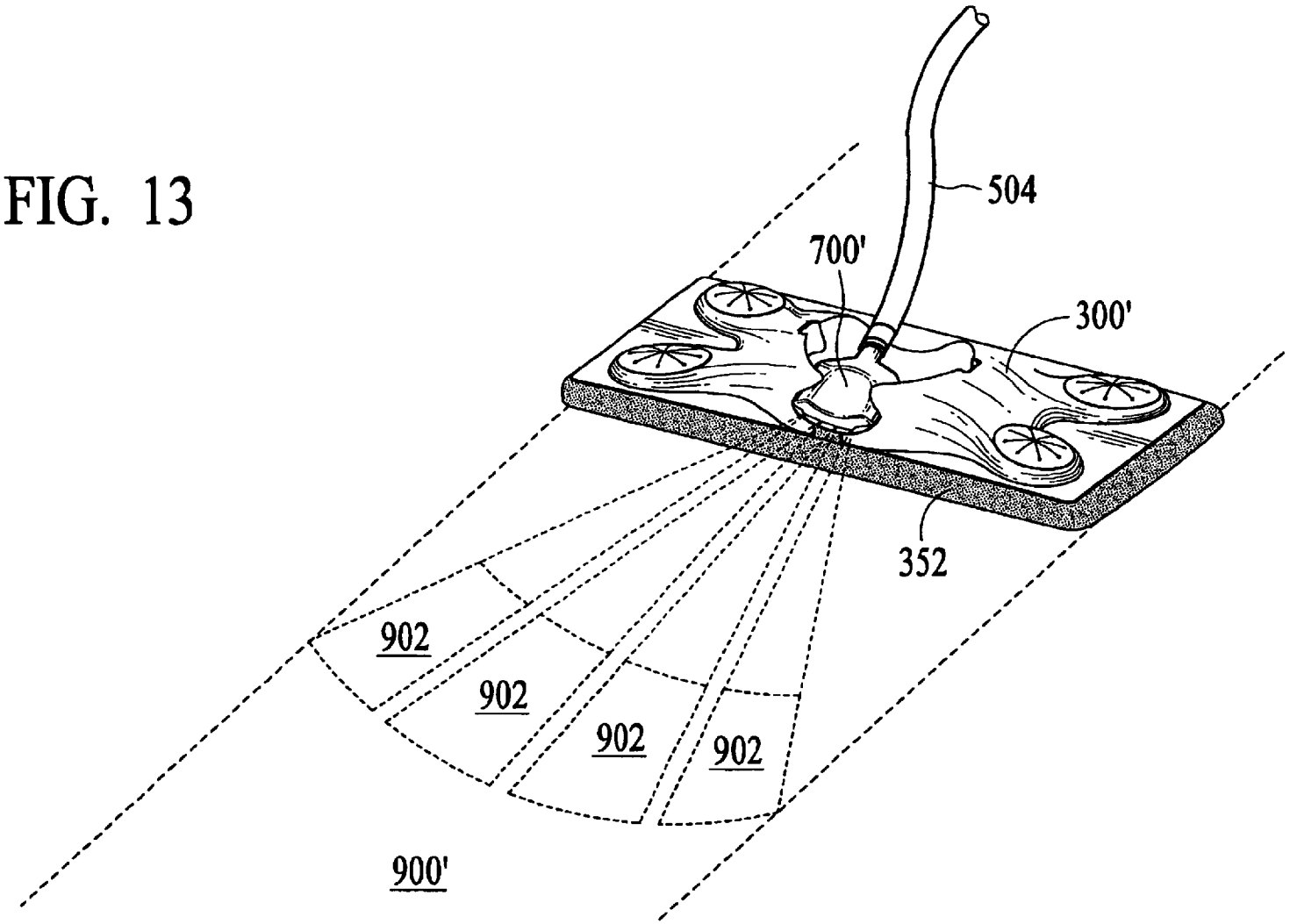
FIG. 13 is a representative isometric view of the nozzle sub-assembly 700' shown in FIGS. 12A–12G mounted onto the head portion 300' of a cleaning system 100' of the present invention.

FIG. 13 is a representative isometric view of the nozzle sub-assembly 700' shown in FIGS. 12A–12E mounted onto the head portion 300' of a cleaning system 100' of the present invention. It will be understood, as described above, that the nozzle assembly 700' can be affixed temporarily, permanently, removably or otherwise directly to the head portion 300' such as by a snap fit, optionally with side sliders 716 or other attachment means, and optional bottom side tab, indentation or detent on nozzle lower 704' (not shown) configuration to fit the nozzle assembly 700' in a specific position.

Optimized Stream Pattern

Figure 14A:
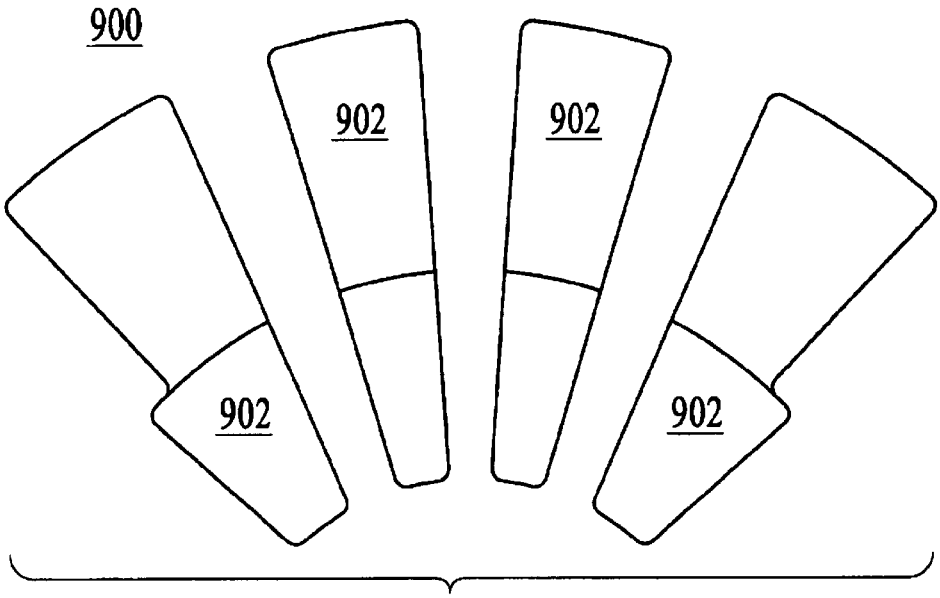
FIG. 14A is a representative schematic view of a preferred embodiment of a stream pattern 900 developed by a cleaning system 100' of the present invention.

FIG. 14A is a representative schematic view of a preferred embodiment of a stream pattern 900 developed by a cleaning system 100' of the present invention. In a preferred embodiment, the 4 separate orifices 708' of the nozzle assembly 700' each produce a partial stream pattern 902 having an essentially narrowing rectangular shape. The overall stream pattern 900 is essentially partially annular or annular sector shaped. It will be understood that there is no fluid distribution immediately in front of the nozzle assembly 700', which results in the stream shape having an annular rather than semi-circular (piece of pie) shape. The emanating stream from each separate orifice 708' tends to broaden as it travels farther, also having an annular sector shape. Thus it will be understood that the stream pattern developed by the tool of the present invention 100' having a full fluid reservoir 508 will be produced farther away from the nozzle orifice 708' and air interface 720'.

A number of important considerations have been identified to optimize the efficacy of the cleaning system 100'. These aspects of the stream pattern 900 are useful, novel and unique.

1. Even Fluid Distribution

The nozzle 700' of the present invention is capable of providing an even, uniform distribution of cleaning fluid 502 in front of or across the leading edge 352 or width of the cleaning head portion 300'. This design avoids puddling of cleaning fluid 502 or other liquid in the center or at the ends of the cleaning head portion 300'. This also aids and enhances distribution of the cleaning or other type of liquid 502 spread upon the surface to be treated.

2. Optimized Fluid Distribution Location

The nozzle 700' of the present invention provides a fluid distribution or stream pattern 902 at the most advantageous efficient and convenient location possible, i.e., directly in front of the cleaning head portion 300', at a width of not more than about the width of the cleaning head portion 300', and at a distance in front of the cleaning head portion 300' not farther than about one sweep length from the cleaning head portion 300'. It will be understood that one sweep length is essentially about the length of the sweep or stroke of the cleaning head portion 300', from its original, back-most position moving forward and then from the front being drawn backwards across the surface being treated. The sweep is essentially the length of the average mopping, stroking or sweeping of the tool cleaning head 300' on the horizontal surface, from the back to front and front to back.

3. Optimized Residency Period

It has been found that the uniform fluid distribution of the nozzle assembly 700' of the present invention 100' provides an increased period of residency of the fluid 502 on the surface being treated. As the liquid 502 is distributed onto the surface to be treated, the residency period of the fluid on the surface can be increased by providing a cleaning tool 100' which distributes the fluid 502 as it is used. Once the fluid 502 is distributed from the nozzle 700', the fluid rests upon the surface and acts thereon, whether the fluid is a cleaner, a bleaching agent, a wax or sealant or other protectant, a coating such as a paint or colorants, additional layers of surface material such as varnish, polyurethane, etc., for a period of time. Thereafter, excess fluid is removed or it dries in place, or any reaction with the fluid 502 which is intended to occur has completed. In any event, once the fluid 502 is distributed evenly, in essentially the stream pattern 900 as delivered, it will have a longer residence time on the surface being treated and thus be more effective in serving its purpose.

4. Visual Indicator to User

It will be apparent that as the fluid 502 is distributed from the nozzle 700' in a fluid distribution pattern 900 of the present invention, the user can visually verify preliminary uniform and sufficient distribution of cleaning fluid. This visual indicator of a properly shaped stream pattern 900 ensure uniform fluid distribution, sufficient fluid distribution, and prevent incomplete coverage as well as excessive fluid distribution in certain areas or overall. Thus, the user can see the fluid 502 as it is distributed into a uniform, even stream pattern 900 and any incomplete coverage or unequal distribution or other problem will be immediately apparent to the user.

5. Independent Variables

The present invention is a tool which produces the described stream pattern 900 regardless of other variables which would otherwise cause variation in the fluid distribution by the tools of the prior art. In particular, the stream pattern 900 can be expected to remain constant during use of fluid 502 regardless of whether the fluid reservoir 500 is 100% full, 75% full, 50% full or 25% full. It will be understood that in the prior art, the stream pattern developed by the tools of the prior art were a function of the volume of remaining fluid, i.e., the more fluid, the broader and more uniform the coverage, and the less fluid the less uniform the fluid distribution. In a more preferred embodiment, the stream pattern 900 is developed by the tool 100' in which the fluid reservoir 500 is between about 100% and about 25% full. In a more preferred embodiment, the stream pattern 900 is developed by the tool 100' in which the fluid reservoir 500 is between about 100% and about 20% full. In a more preferred embodiment, the stream pattern 900 is developed by the tool 100' in which the fluid reservoir 500 is between about 100% and about 15% full. In a more preferred embodiment, the stream pattern 900 is developed by the tool 100' in which the fluid reservoir 500 is between about 100% and about 10% full. In a more preferred embodiment, the stream pattern 900 is developed by the tool 100' in which the fluid reservoir 500 is between about 100% and about 5% full. In other words, as the fluid 502 in the fluid reservoir 500 is initially utilized and ultimately depleted, the system is designed to have an essentially static head pressure. According to the manufacturing specifications of the tool 100' present invention, on-going testing during development of the nozzle assembly 700' as well as during manufacture of the tools 100' ensures the uniform stream pattern 900. Another variable which has no effect on the stream pattern is the angle at which the handle portion 400 of the tool 100' is held. It will be understood that since the nozzle assembly 700' is mounted to the head portion 300', fluid distribution is essentially independent of the position of the handle portion 400. The system 100' is designed to be functional whatever the angular orientation of the pivotable handle portion 400 or position of the handle portion 400 relative to the surface being cleaned. Therefore, whether the user is holding the tool 100' standing essentially straight up, or whether the handle portion 400 is slightly inclined, or the user is using the tool 100' with the handle portion 400 at a very small angle with respect to the horizontal floor surface, the stream pattern 900 is essentially completely formed and developed as described herein.

Fluid Path Performance Testing

Figure 14B:
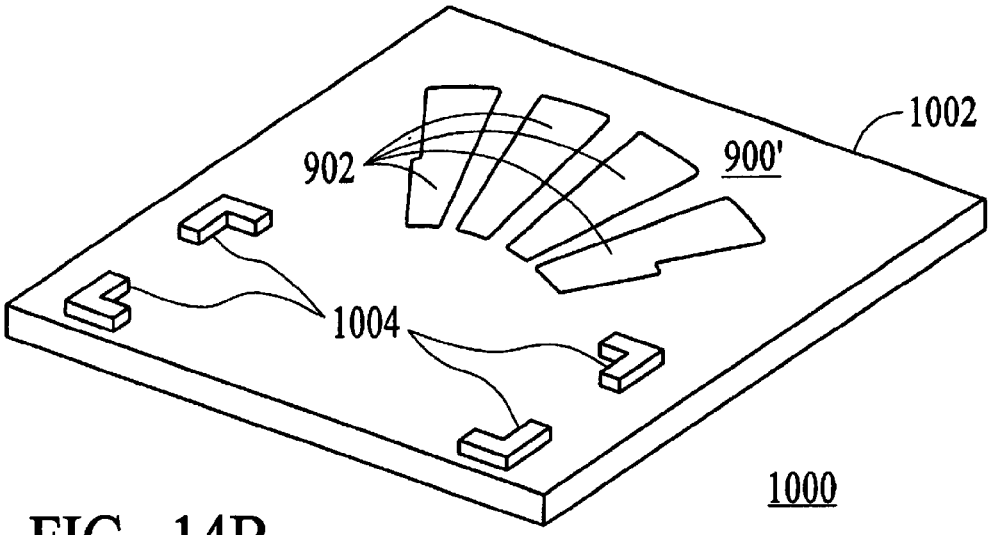
FIG. 14B is a representative schematic view of a preferred embodiment of a test station 1000 for conducting fluid path performance testing of a stream pattern developed by a cleaning system 100' of the present invention.

FIG. 14B is a representative schematic view of a preferred embodiment of a test station 1000 for conducting fluid path performance testing of a stream pattern 900 developed by a cleaning system 100' of the present invention. The test station 1000 essentially consists of a base portion 1002 with position markers or holders 1004 or similar position key structure, detents, indentations, etc., particularly and specifically designed for positioning the head portion 300' securely and immovably during the test procedure.

During the optimization process conducted during research and development of the advanced cleaning system of the present invention, quantitative tests were conducted to test multiple fluid path, nozzle 700' prototypes and valve designs. The following test method was used when a new fluid path design was under consideration:

Title: Fluid Path Performance Testing

I. Scope

This procedure describes quantitative tests designed to test multiple fluid path (nozzle 700' prototyping and valve designs) designs. This test method should be used when a new fluid path design is under consideration.

II. Test Product & Safety

Existing cleaner. Review MSDS of test product prior to use. Use the appropriate PPE (personal protection equipment) and follow the necessary precautions when handling the product.

III. Apparatus

A. Stream Pattern 900

Template

The stream pattern 900 template is a flat, acrylic slab with 4 cutouts that characterize the proper direction and span of each nozzle orifice 708 or 708' on the fluid path. The template was designed with a mophead cutout to keep the mophead stationary and in the correct position during stream testing.

B. Trigger Travel Gauge

The trigger travel gauge measures the distance the lever within the cradle travels when the trigger is actuated.

C. Vacuum Pressure Gauge & Vacuum Pressure Bottle

The vacuum pressure gauge measures the negative pressure inside the bottle during an actuation.

D. Test Sample Needs

1. Advanced cleaning system fluid paths
2. Advanced cleaning system fluid paths (test)
3. Advanced cleaning system
4. Advanced cleaning system bottled cleaner
5. Analytical scale, accuracy of 2 decimal places
6. Stopwatch
7. Ruler
8. 8.5"×11" laminated projection template IV. Test Outline 1. Flow rate—the quantitative measure of volumetric flow rate (mL/s) of the advanced cleaning system fluid path. The purpose of measuring flow rate is to confirm the product delivered to the floor is at parity to the existing fluid path. Differences in flow rate would be an indicator that the venting system or valve/nozzle 700' design might not be acceptable.

2. Projection—the quantitative measure of the distance each nozzle stream projects from the nozzle 700' with the advanced cleaning system fluid path. The purpose of measuring projection is to confirm the fluid path's product delivery is at parity to the existing fluid path. Differences in projection would be an indicator the venting system or valve/nozzle design might not be acceptable.

3. Vacuum Pressure—the quantitative measure of the negative pressure inside the advanced cleaning system bottle during actuations of the advanced cleaning system. The purpose of measuring the vacuum pressure is to confirm the fluid path consistently vents the bottle without abnormally high peak or operating pressure readings.

4. Spread—the quantitative measure of the total side-to-side distance covered by the 4 streams from the advanced cleaning system fluid path. The purpose of measuring spread is to confirm the fluid path's consistency in delivering product without any disruption from inadequate venting, etc.

V. Test Setup

All Testing is performed in two distinct positions:

1. Normal Use Angle with Full Bottle—47 o mop angle with 710 mL of product represents the best performance of the advanced cleaning system
2. Lower Use Angle with Low Liquid Level: 33 o mop angle with 100 mL of product, represents the worst-case advanced cleaning system performance (i.e. a consumer cleaning under a table with a nearly empty advanced cleaning system bottle).

VI. Test Quantities & Controls

A minimum of 30 prototype fluid paths should be used to compare to the existing production fluid paths. A minimum of 10 current production fluid paths is recommended for control samples. A comparison between current fluid paths and test fluid paths should be performed in all areas of the test outline (see section V above).

VII. Test Procedure

The collection of test data for flow rate, projection, spread, and vacuum pressure can be efficiently combined once the tester feels comfortable obtaining multiple data points. For example, vacuum pressure and projection can be collected during one actuation for one fluid path.

A. Flow Rate

1. Place the stream template on top of a bus tray.
2. Using an approved advanced cleaning system mop that has passed the complete tool 100' Critical Control criteria, verify the trigger travel is acceptable.
3. Place the trigger travel gauge (see pictures above) in a fully assembled mop.
4. Zero the gauge. Pull the trigger until it can no longer move to fully actuate the lever. This is the distance the lever traveled in a full stroke of the trigger.
5. Record the trigger travel.
6. Insert the advanced cleaning system mop into the mophead guide on top of the template.
7. Adjust the bus tray and mop so that the mop is at 47-degrees. A 47-degree angle is equivalent to a vertical distance of 36" between the mop handle to the base of the stream template.
8. Fill a bottle with 710 mL of advanced cleaning system product.
9. Attach a fluid path to the bottle and insert the bottle into the advanced cleaning system cradle.
10. Place a beaker (or another type of collection device) on the analytical scale and zero.
11. Using the beaker and stopwatch, collect the product from the nozzle 700' for a 10 second count. Weigh the beaker. Repeat two more times.

12. Once you have three data points, calculate the volume using the specific gravity of the advanced cleaning system cleaner. Average the three data points and divide by 10 to obtain the average flow rate in mL/s.
13. Follow the same procedure for the lower use angle.
14. Adjust the bus tray so that the mop is at 33-degrees. A 33-degree angle is equivalent to a vertical distance of 27" between the mop handle to the base of the stream template.
15. Reduce the product amount in the bottle to 100 mL.
16. Record all results.

B. Projection

1. Follow steps 1–9 of the flow rate procedure with one additional step. Attach a laminated projection template to the bottom of the acrylic stream template.
2. Adjust the advanced cleaning system mop until the normal use position is maintained.
3. Actuate the trigger on the advanced cleaning system mop and estimate the stream projection and stream angle from each nozzle orifice 708'. Colored advanced cleaning system cleaner may aid in identifying projection and angle.
4. Follow the same procedure for the lower use position.
5. Record all results.

C. Vacuum Pressure

1. Follow steps 2–5 in the flow rate procedure using the advanced cleaning system mop with the vacuum pressure gauge attached to it. If the mop does not meet the requirements in the complete tool 100', remove the vacuum gauge and affix it to a new mop that does meet the requirements.
2. Fill the vacuum gauge bottle (bottle with tube connection) with 710 mL of advanced cleaning system product.
3. Attach a fluid path to the bottle and insert the bottle into the cradle.
4. Remove the product from the tube connection on the bottle by first turning the bottle over. Use your finger nail to press down on the surface of the quick disconnect junction. The product should be purged from the tubing. A slight tilt of the bottle away from the product will ensure product from inside the bottle does not travel into the tubing connection.
5. Zero out the vacuum pressure gauge on the mop by inserting a small screwdriver (or a thin pen) into the quick disconnect junction connected to the actual gauge and press down. Check the pressure gauge to make sure there is not a pressure reading.
6. Connect the bottle tubing to the vacuum pressure gauge tubing using the quick disconnection junctions.
7. Place the advanced cleaning system mop directly into the bus tray.
8. Adjust the advanced cleaning system mop until the normal use position is maintained.
9. Actuate the trigger on the advanced cleaning system mop and record the peak pressure (highest pressure reached on the vacuum gauge) and the operating pressure.
10. Follow the same procedure for the lower use position.
11. Record all results.

D. Spread

1. Follow steps 2–5 in the flow rate procedure.
2. Fill a bottle with 710 mL of advanced cleaning system product.
3. Attach a fluid path to the bottle and insert the bottle into the advanced cleaning system cradle.
4. Clear away floor space approximately 15–20 ft in length.
5. Estimate the normal use position while holding the advanced cleaning system handle.
6. Fully actuate the trigger and slowly move backwards at a rate of 0.5 ft/s for a total distance of 12 ft minimum. You will create four stripes on the floor. See picture.
7. Use a ruler to measure the widest and most narrow regions.
8. Record all results.
9. Perform the same procedure above but with only 100 mL of cleaner at the normal use position (47-degrees). NOTE: This is an exception to the two positions described in the test setup (section VI).
10. Record all results.

VIII. Data Collection and Reporting

The data for both the test samples and control samples should be placed in an Excel spreadsheet.

IX. Success Criteria

All test samples must perform at parity to the existing fluid paths (controls) to be considered acceptable.

FIG. 15 is a table showing experimental data obtained utilizing the test station 1000 shown in FIG. 14B. The data from FIG. 15 is presented below as Table 1.

TABLE 1

PERFORMANCE TESTING DATA
Valves are Final Unit Cavity parts
Vent tube has 2 o-rings
flex dome = 70 durometer
o-ring = 70 durometer
Testing: Flex Dome is always filled during testing.
Washers were new design with longer posts (changed OD)
Duck Bills: 30D oil-filled (orange)

| Test # | 47° Flowrate ml/s | 33° Flowrate ml/s | 33° Stream Projection, Inside | 33° Stream Projection, Outside | 47° Stream Angle, Inside | 47° Stream Projection, Inside | 47° Stream Projection, Outside | 47° Stream Angle, Inside | 33° Stream Angle, Outside | 47° Vacuum Pressure | 33° Vacuum Pressure |
|---|---|---|---|---|---|---|---|---|---|---|---|
| 1 | 3.56 | 2.6 | 1.75 | 2 | 6L/15R | 35L/41R | 2.25 | 6L/15R | 41 | −2.5 | −2.7 |
| 2 | 3.73 | 2.76 | 1.5 | 1.75 | 9L/12R | 38 | 2 | 6L/15R | 41 | −2.8 | −2.6 |
| 3 | 3.67 | 2.76 | 1.5 | 2 | 6L/9R | 38L/35R | 2 | 6L/12R | 38 | −2.6 | −2.7 |
| 4 | 3.72 | 2.66 | 1.5 | 1.75 | 6L/9R | 35 | 2.25 | 6L/12R | 41L/38R | −2.8 | −2.4 |

TABLE 1-continued

| | | | | | | | | | | | |
|---|---|---|---|---|---|---|---|---|---|---|---|
| 5 | 3.65 | 2.67 | 1.75 | 2 | 6L/15R | 38 | 2 | 6L/15R | 41 | −3.2 | −2.8 |
| 6 | 3.82 | 2.44 | 1.5 | 2 | 6L/12R | 35 | 2 | 6L/12R | 38 | −2.9 | −2.3 |
| 7 | 3.94 | 2.68 | 1.75 | 2 | 3L/12R | 35L/38R | 2.25 | 3L/12R | 38 | −2.5 | −2 |
| 8 | 3.63 | 2.65 | 1.75 | 2 | 6L/15R | 35L/38R | 2.25 | 6L/15R | 41 | −2.8 | −2.4 |
| 9 | 3.86 | 2.64 | 1.5 | 1.75 | 6L/15R | 35L/38R | 2 | 6L/15R | 41 | −2.9 | −2.6 |
| 10 | 3.76 | 2.8 | 1.75 | 2 | 6L/12R | 38 | 2 | 6L/12R | 38 | −3 | −2.5 |
| 11 | 3.59 | 2.65 | 1.75 | 2 | 6L/12R | 32R/35R | 2.5 | 6L/12R | 32L/35R | −2.9 | −2.7 |
| 12 | 3.43 | 2.51 | 1.75 | 2 | 6L/12R | 29L/35R | 2.5 | 6L/12R | 29L/35R | −3 | −3 |
| 13 | 3.72 | 2.7 | 1.75 | 2 | 3L/12R | 29L/35R | 2.25 | 3L/12R | 29L/35R | −3.5 | −2.8 |
| 14 | 3.99 | 2.62 | 1.75 | 2.5 | 3L/12R | 26L/35R | 2.5 | 3L/12R | 29L/35R | −2.5 | −3.1 |
| Avg | 3.72 | 2.65 | 1.65 | 1.98 | #DIV/01 | na | 2.20 | na | 39.67 | −2.85 | −2.61 |
| std | 0.15 | 0.10 | 0.12 | 0.18 | #DIV/01 | na | 0.20 | na | 1.58 | 0.28 | 0.29 |
| high | 3.99 | 2.8 | 1.75 | 2.5 | 15 | 41 | 2.5 | 15 | 41 | −2.5 | −2 |
| low | 3.43 | 2.44 | 1.5 | 1.75 | 3 | 26 | 2 | 3 | 26 | −3.5 | −3.1 |

Manufacturing Standards

The following test method was developed for use as a manufacturing standard to ensure conformity with the optimum nozzle design.

Title: Stream Pattern 900 Testing for Fluid Path Subassembly

I. Scope

There will be two test methods discussed here. The first is a test method only for determining the stream pattern 900 of the nozzle 700' of the fluid path subassembly. The second is a method for testing the nozzle stream pattern 900 using a complete fluid path and final tool 100'.

II. Reagents

A. Liquid Cleaning Product

1. The liquid cleaning product may be an eye and skin irritant. Eye protection and gloves should be used when performing the seal integrity/leak test.

III. Apparatus

A. Nozzle 700' Stream Tester

1. An open inverted bottle with a fluid path attached without a nozzle 700' . The nozzle 700' is mounted in the end of the tube and held in either a tool 100' or hands to test.

B. Advanced Cleaning System Tool/Bottle

1. An advanced cleaning system tool 100' that has passed the complete tool Critical Control inspection checks will be used for testing a complete fluid path subassembly for correct stream characteristics. A production bottle with product will be used.

C. Stream Pattern 900 Target

1. This is a template with 4 holes. The template has a holding device to hold the mop head in the correct position before testing the stream pattern 900.

IV. Stream Pattern 900 Testing of Nozzle ONLY

A. Sampling

1. The test number of nozzle 700's outlined in Fluid Path Critical Control Std.

B. Procedure

1. Attach the nozzle hose barb end to the test apparatus.
2. Fill the apparatus with product to the level that meets an equivalent of the maximum head pressure (11.625 lb equivalent to full bottle 710 g at 47 degrees or 36 inches from the tip of the handle to the mop head plane).
3. Snap the nozzle 700' to the holding fixture.
4. Open the valve to allow liquid to flow through the nozzle 700' .
5. When streams are fully developed record the pass/fail stream pattern 900 for each orifice 708' in the data sheet. A nozzle 700' passes when all of the streams are present and are fully developed. If air at orifice 708' impedes flow, wipe surface of the nozzle 700' and let streams develop and retest. Note the failure and cause of failures. Use troubleshooting table.
   a) Use a stream test template if the stream pattern 900 is questionable. For the stream template, a nozzle 700' passes when all of the streams go through the holes designated for each stream. The nozzle 700' fails if any stream does not pass through the designated hole.
   b) Fully developed streams are defined as streams that have minimum amount of air at the orifice interface 720' and project with a minimum amount of air in the stream. With a new valve, holding the valve open for 5–10 seconds helps streams fully develop.
6. Release the valve.
7. Open the valve to allow liquid to flow through the nozzle 700'.
8. Check the nozzle 700' for any leaks around the sonic weld parting line especially between the orifice 708's and at the hose barb interface 710'.
   a) If nozzle 700' is leaking around the sonic weld parting line. Reject the part.

V. Stream Pattern 900 Testing of Complete Fluid Path

A. Sampling

1. At least one completely assembled fluid path should be tested along with a completely assembled tool 100' that has passed all tests.

B. Procedure

1. Check trigger travel of assembled tool 100'.
2. Attach the fluid path to a bottle filled with product (710 g).
3. Place the bottle 500 into the tool cradle 600 and thread the nozzle 700' through the u-joint and snap it into place on the enclosure.
4. Place the enclosure into the holding cell on the stream pattern 900 template.
5. Hold the mop handle at 47 degrees (the tip of the handle at 36 inches from the base of template).
6. Pull the trigger and hold for 15 seconds.
7. When streams are fully developed, record the pass/fail stream pattern 900 for each orifice 708' in the Data sheet. A fluid assembly passes when all of the streams go through the holes designated for each stream. The fluid assembly fails if any stream does not pass through the designated hole. Note the cause of failures seen outside of the given box pattern for a given head pressure. Use troubleshooting table.
   a) Fully developed streams are defined as streams that have minimum amount of air at the orifice interface 720' and project with a minimum amount of air in the stream. With a new valve, holding the valve open for 5–10 seconds helps streams fully develop.

8. Repeat steps 6 through 9 two more times.
9. When removing the bottle actuate valve and check the nozzle 700' for any leaks around the sonic weld parting line especially between the orifices and at the hose barb interface 710'.
   a) If nozzle 700' is leaking around the sonic weld parting line. Reject the part.
10. Repeat steps 2 through 7 for a minimum head pressure 4.375 in-lb (100 g of liquid in bottle with valve at 33 degree angle—equivalent to holding the tip of the handle at 26.8 inches from mop head plane). Use the set of holes in the template closest to the mop head. If air impedes the flow at the low angle, prime the valve at a higher angle and when product dispenses lower to 33 degree angle for test.

VI. Troubleshooting Guide

A. Troubleshooting table

| | Symptom | Cause |
|---|---|---|
| 1. | Stream hooks to side | Insufficient weld between orifice 708' and nozzle 700' wall<br>Too much flash<br>Air bubbles in line - retest with developed streams |
| 2. | Leaking from sonic weld parting line | Insufficient weld |
| 3. | Stream does not meet projection in front of mop head | Sonically welded too far, thus decreasing size of orifice 708' |
| 4. | Streams diminish quickly as valve is actuated | Duck bill is out of specification (i.e. not cut or sticks) |

Off-head Mounted Nozzle Improvement

Figure 16A:
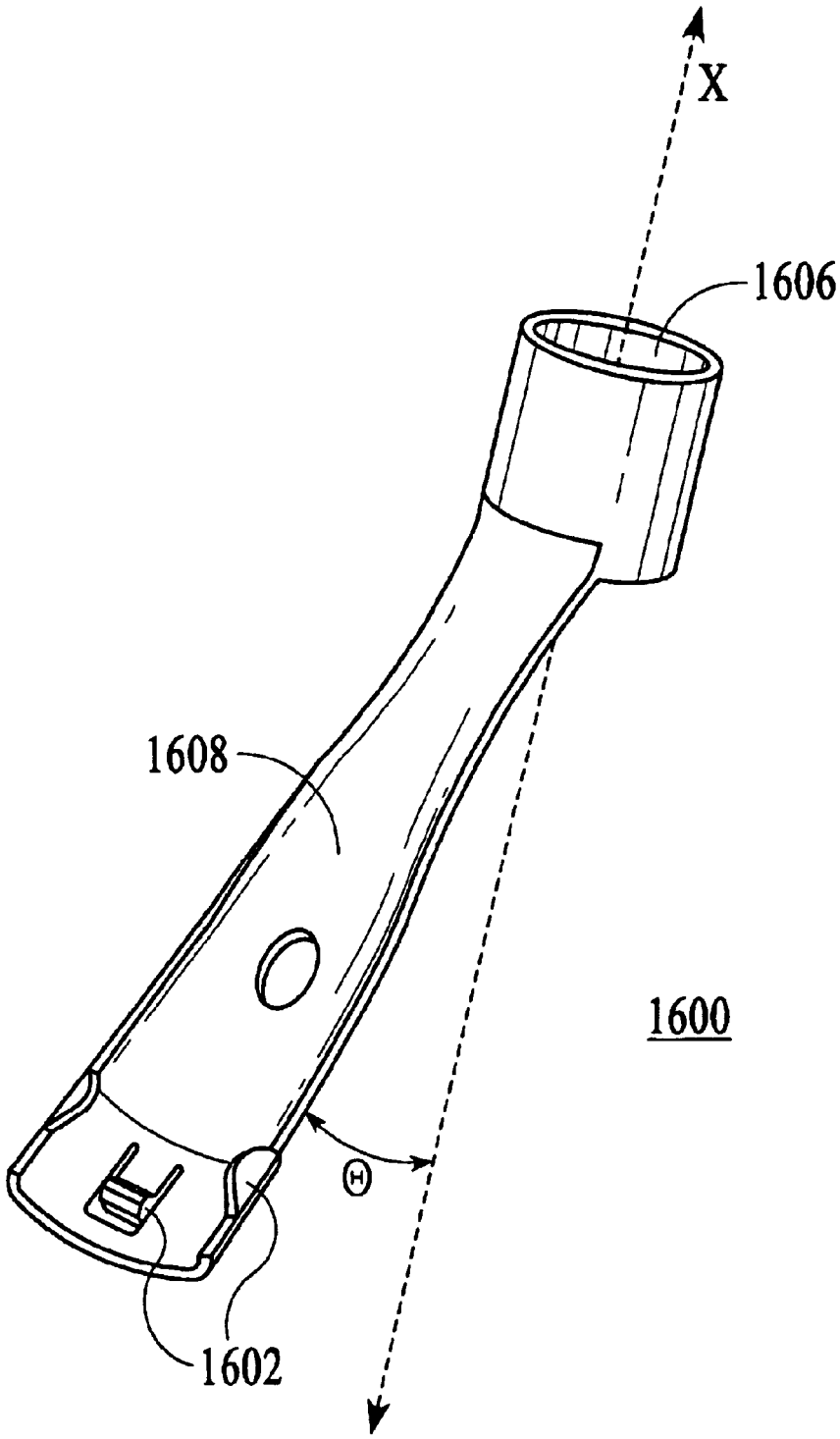
FIG. 16A is a representative isometric view of a handle extending portion such as a ramp or stem portion or other handle coupling 1600 with a top-mounting nozzle coupling 1602.
Figure 16B:
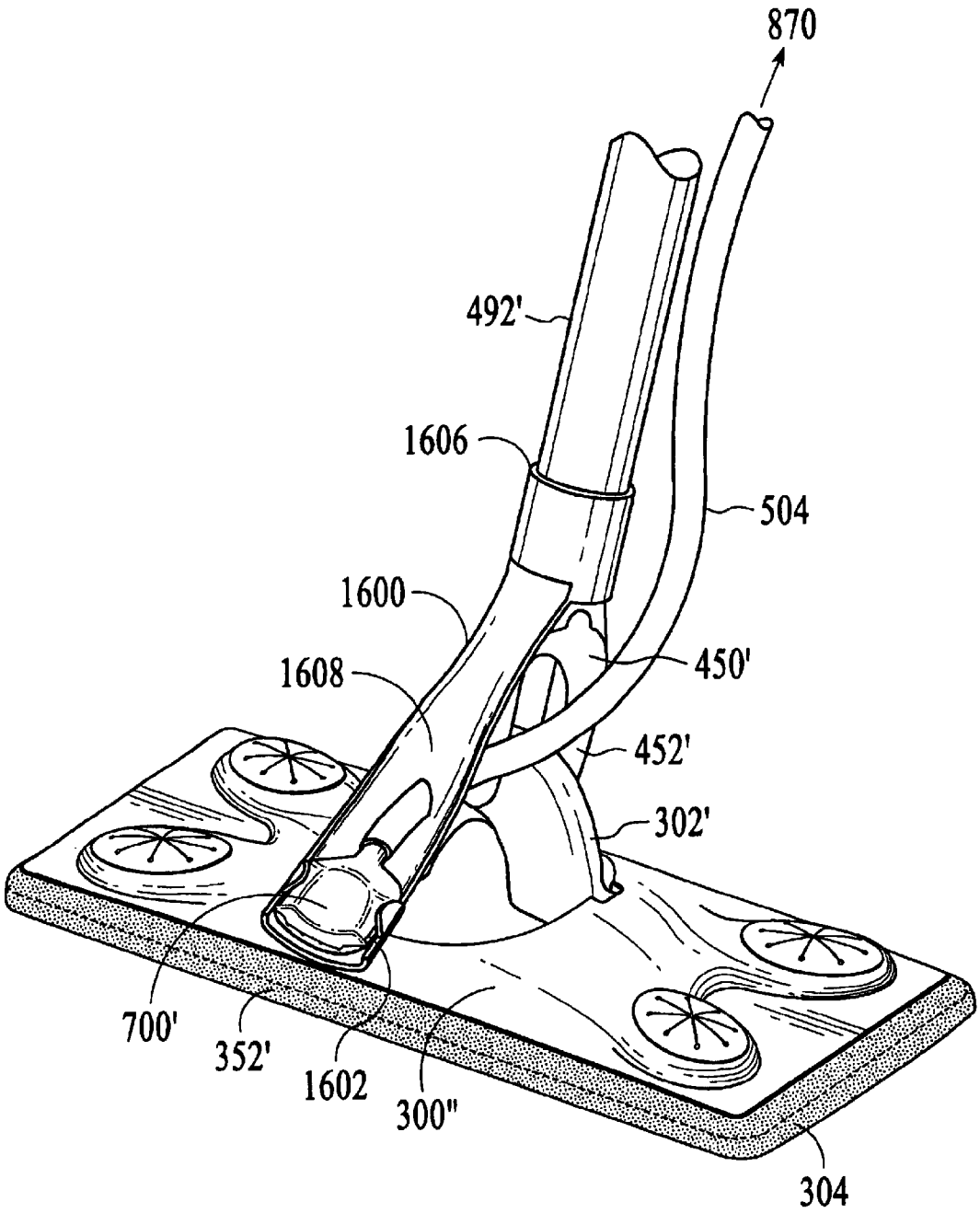
FIG. 16B is a representative view of the handle ramp or other handle coupling 1600 shown in FIG. 16A coupled to the lower tubular section 492' of a handle portion (not shown) of a cleaning system of the present invention.

FIG. 16A is a representative isometric view of a handle extending portion such stem portion or other handle coupling 1600 with a top-mounting nozzle coupling 1602. FIG. 16B is a representative view of the handle extender coupling 1600 shown in FIG. 16A coupled to the lower tubular section 492' of a handle portion 400 (shown in FIG. 1) of a cleaning system of the present invention. The handle extender coupling 1600 is a structural attachment or integral portion of the lower tubular section 492' of the handle assembly. A tubular handle coupling portion 1606 is adapted to couple the extender coupling 1600 to the lower tubular section 492' of the handle assembly. It will be understood that the extended portion 1608 of the extender coupling 1600 can be essentially tongue-shaped, i.e., rectangular, slightly or more or less triangulated or tapered.

The extender portion 1600 extends from the distal end of the lower tubular section 492' to adjacent the mop head 300". Locating the nozzle portion 700' off of the head also provides the advantage of eliminating interference by the cleaning pad 200 with fluid flow from the nozzle 700'. By locating the nozzle portion 700' on the handle portion 492' or elsewhere on the handle 400 such that the nozzle 700' is located adjacent the leading edge 352' of the head portion 300", the fluid distribution or stream pattern 900 developed through the nozzle 300' is identical or essentially identical or similar to the fluid distribution or stream pattern 900 developed through the nozzle 300 of the head-mounted nozzle system 100. Even as the handle portion 400 is raised or lowered, i.e., as a user would use the advanced cleaning system 100' of the present invention, lifting the handle 400 to created long, sweeping strokes and lowering the handle 400 to clean beneath furniture, household and plumbing appliances, etc.

As shown and described herein, offset angle θ defined by the angle between the ramp or elongated portion 1608 and the central axis χ of the extender portion 1600 is an angle between about 0 and about 45 degrees, or more or less. It will be understood that by variation in the angle θ as well as length of the extender coupling 1600, positioning the nozzle portion 300 in a predetermined position, i.e., essentially directly in front of and above the front, top surface portion 306 and leading edge 352' of the head portion 300", to provide a fluid distribution pattern 900 as desired can be achieved.

The mop head 300" is similar to those described above, i.e., mop heads 300 and 300', the attachment or fitment for coupling the nozzle portion 700 or 700' to the mop head 300' of the present invention is unnecessary. The top surface 302" of the mop head 300" can be smooth, flat or other convenient shape. Star-shaped pinchers or similar inserts 308 or other cleaning pad 200 attaching mechanism or structure are used to retain a removable cleaning pad 200.

Another feature of the extender coupling 1600 for the off-head mounted nozzle 700' is a very slight curvature in the end of the extended portion 1608. As shown, the curvature is concave, such that the top-mounting nozzle coupling 1602 retains the nozzle portion 700' from below the nozzle 700', which clips into place from on top. The flexible tube section 504 extends upward from the nozzle 700' to the fluid reservoir top-mounting nozzle coupling 502. The nozzle portion 700' can easily be snapped into place during assembly, and if accidentally bumped or knocked out of place, it can easily be replaced by the user.

Figure 16C:
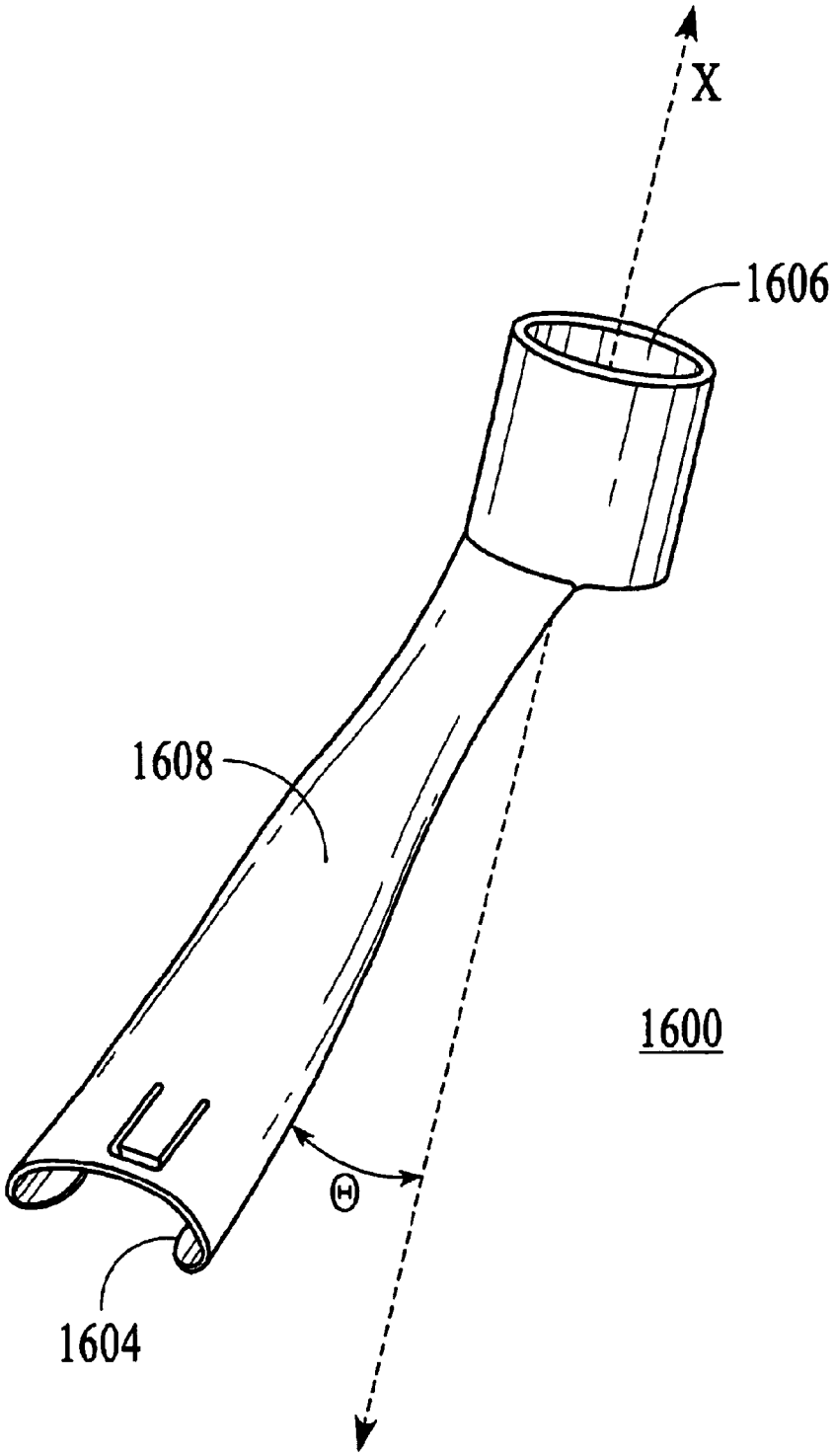
FIG. 16C is a representative isometric view of a handle ramp or other handle coupling 1600 with an under-mounted nozzle coupling 1604.
Figure 16D:
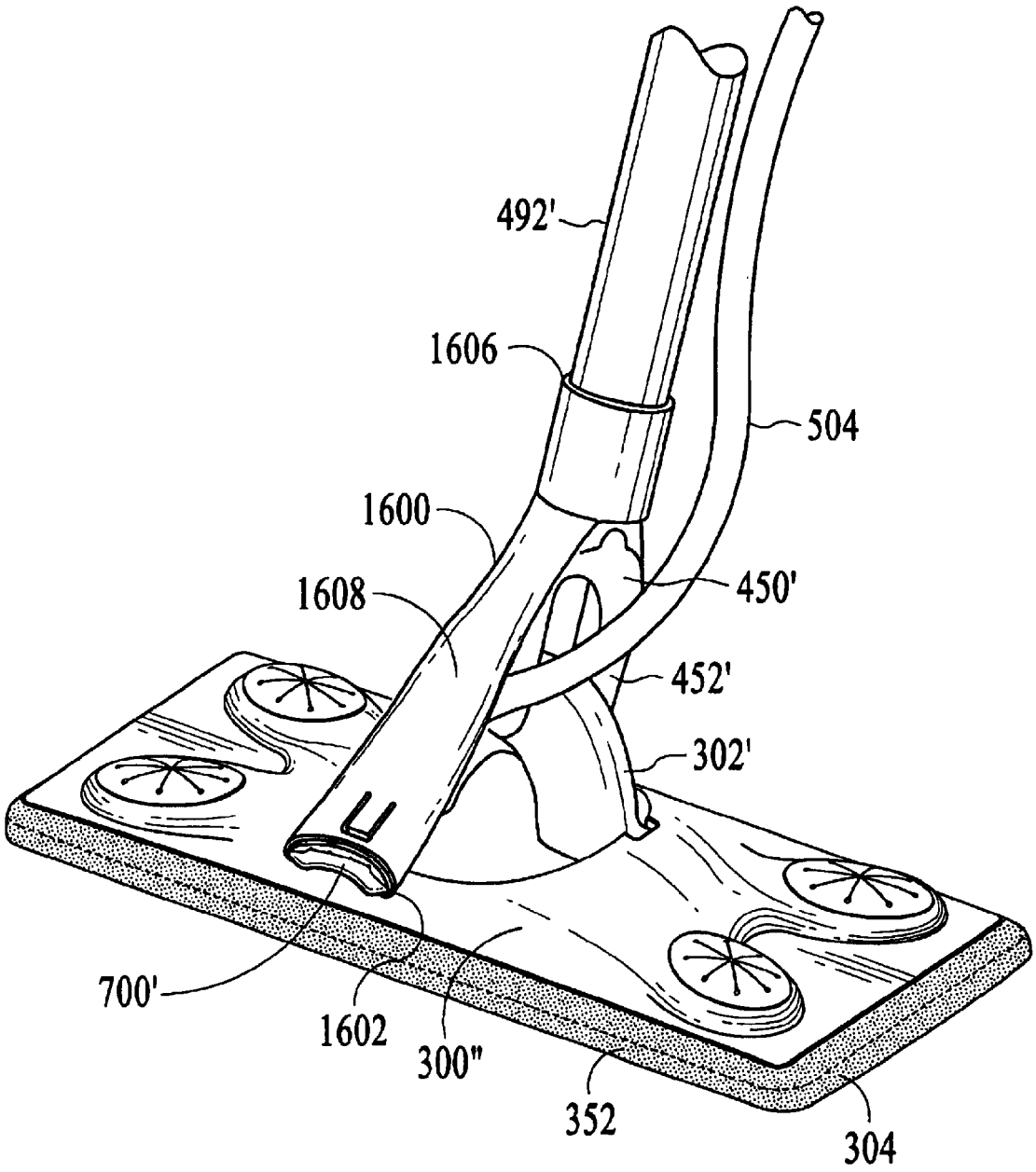
FIG. 16D is a representative view of the handle ramp or other handle coupling 1600 shown in FIG. 16C coupled to the lower tubular section 492' of a handle portion (not shown) of a cleaning system of the present invention.

FIG. 16C is a representative isometric view of a handle extender coupling 1600 with an under-mounted nozzle coupling 1604. FIG. 16D is a representative view of the handle extender coupling 1600 shown in FIG. 16C coupled to the lower tubular section 492' of a handle portion (not shown) of a cleaning system of the present invention. It will be understood, based on the foregoing, that in another embodiment of the present invention 100', the extender coupling 1600 for the off-head mounted nozzle 700' has a very slight convex curvature in the end of the extended portion 1608. As shown, the under-mounting nozzle coupling 1604 retains the nozzle portion 700' from on top of the nozzle 700', which clips into place from below the distal end 1604 of the convex extender 1600. The nozzle portion 700' is thus somewhat more protected from being bumped or knocked out of place during use or storage. Similarly, the flexible tube section 504 extends upward from the nozzle 700' to the fluid reservoir top-mounting nozzle coupling 502 from underneath the ramp-like extender 1600, also protected from snagging on objects, including furniture, household appliances, etc.

While the top-mounting nozzle coupling 1604 and the under-mounting nozzle coupling 1604 embodiments are different, similarities include the side-wrapping edges and snap-fitment or resilient, flexible position clip. It will be known that minor variations of the top-mounting nozzle coupling 1604 and the under-mounting nozzle coupling 1604 will be included within the scope of the present invention. In general, however, providing the structural means for attaching the fluid distribution nozzle 700' to the handle portion 400 extending from the handle portion 400 slightly to adjacent the head portion 300" allows a user to raise and lower the handle portion 400 as desired or required, within reasonable usage patterns, but the fluid or stream distribution pattern 900 remains essentially consistent in shape.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

We claim:

1. A gravity-fed cleaning system comprising:

a handle portion with a proximal end and a distal end, the handle portion including a housing adapted to receive a replaceable cleaning fluid reservoir, the handle portion further including an extender portion the extender portion having two ends, one end attached to the handle portion adjacent the distal end thereof, and further having a fluid nozzle coupled to the other end of the extender portion adjacent the distal end of the handle portion adjacent the distal end of the handle portion;

a cleaning head portion coupled to the distal end of the handle portion with a yoke section such that the nozzle is located directly above and in front of a leading edge of the cleaning head portion, the cleaning head portion further comprising a mechanical securing device for retaining a removable cleaning pad; and a replaceable cleaning fluid reservoir received within the housing, the cleaning fluid reservoir fluidically coupled to the nozzle.

2. The cleaning system of claim 1 in which the extender portion has a predetermined, operative curvature.

3. The cleaning system of claim 2 in which the extender portion has a predetermined, operative concave curvature.

4. The cleaning system of claim 2 in which the extender portion has a predetermined, operative convex curvature.

5. The cleaning system of claim 1 in which the extender portion further comprises an attaching portion for removably coupling the nozzle portion to the extender portion.

6. The cleaning system of claim 5 which the attaching portion comprises a center notch and side wrapping arm portions.

7. The cleaning system of claim 1 further comprising a cleaning pad.

8. The cleaning system of claim 7 in which the cleaning pad comprises a notched portion for permitting flow of cleaning fluid from the cleaning head portion to the surface to be cleaned.

9. The cleaning system of claim 1 in which the mechanical secure device for retaining a removable cleaning pad comprises a plurality of flexible, slotted pincher members.

10. The cleaning system of claim 1 in which the handle portion further comprises a finger-actuated trigger mechanism for controllably dispensing cleaning fluid.

11. A gravity-fed, hard surface cleaning system comprising:

a handle portion with a proximal end and a distal end, the handle portion further including a housing adapted to receive a replaceable fluid reservoir;

a cleaning head portion coupled to the distal end of the handle portion with a yoke section, the cleaning head portion further comprising a mechanical secure for retaining a removable cleaning pad;

a replaceable cleaning fluid reservoir adapted to be received within the housing; an extender portion having two ends and a fluid nozzle mounted on one end of the extender portion the other end attached to the handle portion adjacent the distal end thereof such that the nozzle is located directly above and in front of a leading edge of the cleaning head portion, the cleaning fluid reservoir fluidically coupled to the fluid nozzle.

12. The cleaning system of claim 11 further comprising a cleaning pad.

13. The cleaning system of claim 12 in which the cleaning pad comprises a notched portion for permitting flow of cleaning fluid from the cleaning head portion to the surface to be cleaned.

14. The cleaning system of claim 11 in which the mechanical secure for retaining a removable cleaning pad comprises a plurality of flexible, slotted pincher members.

15. The cleaning system of claim 11 in which the handle portion further comprises a finger-actuated trigger mechanism for controllably dispensing cleaning fluid.

16. A gravity-fed cleaning system:

a handle portion with a proximal end and a distal end, the handle portion further including a housing for receiving a replaceable cleaning fluid reservoir;

a cleaning head portion coupled to the distal end of the handle portion with a yoke section, the cleaning head portion having an essentially convex lower surface and further comprising a mechanical secure for retaining a removable cleaning pad;

a replaceable cleaning fluid reservoir adapted to be received within the housing; an extender portion having two ends and a fluid nozzle mounted on one of the extender portion, the other end attached to the handle portion adjacent the distal end thereof such that the nozzle is located directly above and in front of a leading edge of the cleaning head portion, the cleaning fluid reservoir fluidically coupled to the fluid nozzle.

17. The cleaning system of claim 16 in which the convex lower surface has a predetermined radius of curvature.

18. The cleaning system of claim 16 in which the convex lower surface has a radius of curvature between about 1 inch and about 20 inches.

19. The cleaning system of claim 16 in which the convex lower surface has a radius of curvature between about 4 inch and about 12 inches.

20. The cleaning system of claim 16 in which the cleaning head portion is essentially rectangular in shape.

21. The cleaning system of claim 16 in which the cleaning head portion further comprises means for retaining a removable cleaning pad.

22. The cleaning system of claim 16 in which the cleaning head portion comprises a plurality of flexible, slotted members for retaining a removable cleaning pad.

* * * * *

UNITED STATES PATENT AND TRADEMARK OFFICE

CERTIFICATE OF CORRECTION

PATENT NO. : 6,964,535 B2
APPLICATION NO. : 10/350804
DATED : November 15, 2005
INVENTOR(S) : Bell et al.

It is certified that error appears in the above-identified patent and that said Letters Patent is hereby corrected as shown below:

Please replace the paragraph starting at column 7, line 1-3 with the following paragraph:

~~FIG. 8d~~ FIG. 8I is a representative isometric section view of another ~~preferred~~ embodiment of a valve sub-assembly 800a of a cleaning system 100 of the present invention.

Please replace the paragraph starting at column 7, line 4-6, with the following paragraph:

~~FIG. 8K~~ FIG. 8J is a representative isometric section view of yet another ~~preferred~~ embodiment of a valve sub-assembly 800b of a cleaning system 100 of the present invention.

Please replace the paragraph starting at column 18, line 24, with the following 2 seperate paragraphs:

Thus, it will be apparent from the foregoing and the following that as cleaning fluid 502 flows out of the fluid reservoir 500, in order to prevent creating a vacuum in the fluid reservoir 500 while dispensing fluid, thereby interfering with liquid flow by gravity, dip tube 804 which is seated into the side opening 840 allows air to enter the fluid reservoir 500. Air vent opening 842 in flex dome portion 830 provides open communication with the atmosphere through dip tube 804. The duck bill valve 806 or other fluid restrictor means prevents flow of cleaning fluid 502 into the dip tube 804 while at the same time permitting flow of air into the fluid reservoir 500 to replace the volume of cleaning solution or fluid 502 utilized. Thus it will be understood that the system 100 described herein operates by gravity flow of the cleaning fluid through the valve post 810 based upon a pressure head created by remaining fluid in the fluid reservoir 500.

FIG. 8I is a representative isometric section view of another preferred embodiment of a valve sub-assembly 800a of a cleaning system 100 of the present invention. FIG. 8J is a representative isometric section view of yet another preferred embodiment of a valve sub-assembly 800b of a cleaning system 100 of the present invention. It will be understood that the valve assembly 800a includes the duck bill valve portion 806 without the dip tube portion 804 of the prior embodiments. In yet another preferred embodiment, the valve assembly 800b comprises a ball and spring-type check valve 807. It will be understood that other means for venting the fluid reservoir 500 will also be included within the scope of the present invention.

4. Please replace claim 1 with the following claim:

Claim 1 (corrected) A gravity-fed cleaning system comprising:
a handle portion with a proximal end and a distal end, the handle portion including a housing adapted to receive a replaceable cleaning fluid reservoir, the handle portion further including an extender portion, the extender portion having two ends, one end attached to the handle portion adjacent the distal end thereof, and further having a fluid nozzle coupled to It is certified that error appears in the above-identified patent and that said Letters Patent is hereby corrected as shown below:

the other end of the extender portion; ~~adjacent the distal end of the handle portion~~ ~~adjacent the distal end of the handle portion;~~ a cleaning head portion coupled to the distal end of the handle portion with a yoke section such that the nozzle is located directly above and in front of a leading edge of the cleaning head portion, the cleaning head portion further comprising a mechanical securing device for retaining a removable cleaning pad; and a replaceable cleaning fluid reservoir received within the housing, the cleaning fluid reservoir fluidically coupled to the nozzle.

5. Please replace claim 6 with the following claim:
Claim 6 (corrected) The cleaning system of Claim 5 in which the attaching portion comprises a center notch and side wrapping arm portions.

6. Please replace claim 11 with the following claim:
Claim 11 (corrected) A gravity-fed, hard surface cleaning system comprising:
a handle portion with a proximal end and a distal end, the handle portion further including a housing adapted to receive a replaceable fluid reservoir, a cleaning head portion coupled to the distal end of the handle portion with a yoke section, the cleaning head portion further comprising a mechanical secure for retaining a removable cleaning pad;

a replaceable cleaning fluid reservoir adapted to be received within the housing; an extender portion having two ends; and a fluid nozzle mounted on one end of the extender portion , the other end attached to the handle portion adjacent the distal end thereof such that the nozzle is located directly above and in front of a leading edge of the cleaning head portion, the cleaning fluid reservoir fluidically coupled to the fluid nozzle.

7. Please replace claim 16 with the following claim:
Claim 16 (corrected) A gravity-fed cleaning system:
a handle portion with a proximal end and a distal end, the handle portion further including a housing for receiving a replaceable cleaning fluid reservoir;

a cleaning head portion coupled to the distal end of the handle portion with a yoke section, the cleaning head portion having an essentially convex lower surface and

UNITED STATES PATENT AND TRADEMARK OFFICE

CERTIFICATE OF CORRECTION

PATENT NO. : 6,964,535 B2
APPLICATION NO. : 10/350804
DATED : November 15, 2005
INVENTOR(S) : Bell et al.

It is certified that error appears in the above-identified patent and that said Letters Patent is hereby corrected as shown below:

further comprising a mechanical secure for retaining a removable cleaning pad;

a replaceable cleaning fluid reservoir adapted to be received within the housing;
~~an extender portion having two ends; and~~ an extender portion having two ends; and a fluid nozzle mounted on one end of the extender portion, the other end attached to the handle portion adjacent the distal end thereof such that the nozzle is located directly above and in front of a leading edge of the cleaning head portion, the cleaning fluid reservoir fluidically coupled to the fluid nozzle.

Signed and Sealed this

Twenty-second Day of August, 2006

JON W. DUDAS
*Director of the United States Patent and Trademark Office*